US006473669B2

(12) United States Patent
Rajala et al.

(10) Patent No.: US 6,473,669 B2
(45) Date of Patent: Oct. 29, 2002

(54) CONTROLLING WEB TENSION, AND ACCUMULATING LENGTHS OF WEB, BY ACTIVELY CONTROLLING VELOCITY AND ACCELERATION OF A FESTOON

(75) Inventors: Gregory John Rajala, Neenah; Robert Donald Lorenz, Madison, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/978,474

(22) Filed: Oct. 16, 2001

(65) Prior Publication Data

US 2002/0059013 A1 May 16, 2002

Related U.S. Application Data

(63) Continuation-in-part of application No. 09/110,753, filed on Jul. 3, 1998, now Pat. No. 6,314,333.

(51) Int. Cl.[7] ..... G06F 19/00

(52) U.S. Cl. ..... 700/122; 700/129; 700/127; 318/6; 318/7

(58) Field of Search ..... 700/122, 129, 700/127; 318/6, 7; 226/44

(56) References Cited

U.S. PATENT DOCUMENTS

| | | | | |
|---|---|---|---|---|
| 3,659,767 | A | 5/1972 | Martin | 226/195 |
| 3,809,335 | A | 5/1974 | Mantey | 242/186 |
| 3,936,008 | A | 2/1976 | Crum | 242/75.44 |
| 4,000,865 | A | 1/1977 | Gaskins | 242/75.43 |
| 4,081,301 | A | 3/1978 | Buell | 156/164 |
| 4,103,840 | A | 8/1978 | Dowd | 242/67.3 R |
| 4,151,594 | A | 4/1979 | Stern | 364/400 |
| 4,229,243 | A | 10/1980 | Ellinor | 156/269 |
| 4,239,578 | A | 12/1980 | Gore | 156/361 |
| 4,261,782 | A | 4/1981 | Teed | 156/361 |
| 4,293,367 | A | 10/1981 | Klasek et al. | 156/494 |
| 4,309,236 | A | 1/1982 | Teed | 156/164 |
| 4,405,397 | A | 9/1983 | Teed | 156/164 |
| 4,458,467 | A | 7/1984 | Shulman et al. | |
| 4,464,217 | A | 8/1984 | Dickover et al. | |

(List continued on next page.)

FOREIGN PATENT DOCUMENTS

| | | | |
|---|---|---|---|
| EP | 0476818 A1 | 3/1992 | D05B/35/06 |
| GB | 2241424 A | 9/1991 | A41H/43/00 |
| GB | 2248380 B | 4/1992 | A61F/13/15 |
| JP | 4028363 | 1/1992 | A61F/13/54 |
| JP | 4028364 | 1/1992 | A61F/13/54 |

*Primary Examiner*—James P. Trammell
*Assistant Examiner*—Firmin Backer
(74) *Attorney, Agent, or Firm*—Wilhelm Law Service; Thomas D. Wilhelm

(57) ABSTRACT

This invention pertains to processing continuous webs such as paper, film, composites, and the like, in dynamic continuous processing operations. More particularly, it relates to accumulating limited lengths of such continuous webs and to controlling tension in such continuous webs during the processing operation. Both tension control and limited accumulations are achieved in a festoon system by connecting a corresponding festoon to actuator or the like, sensing variables such as position, tension, velocity, and acceleration parameters related to the web and the festoon, and providing active force commands, in response to the sensed variables, to cause translational movement, generally including a target acceleration, in the upper festoon rolls to control tension disturbances in the web while providing limited accumulation of a length of the web. In some applications of the invention, the festoon control system is used to attenuate tension disturbances. In other applications of the invention, the festoon control system is used to create controlled tension disturbances.

53 Claims, 28 Drawing Sheets

U.S. PATENT DOCUMENTS

| | | | | | |
|---|---|---|---|---|---|
| 4,479,836 | A | | 10/1984 | Dickover et al. | |
| 4,572,098 | A | | 2/1986 | Chiu | |
| 4,572,752 | A | | 2/1986 | Jensen et al. | 156/64 |
| 4,645,109 | A | | 2/1987 | Fleissner | 226/42 |
| 4,704,171 | A | * | 11/1987 | Thompson et al. | 156/164 |
| 4,786,346 | A | | 11/1988 | Ales et al. | 156/160 |
| 4,801,345 | A | | 1/1989 | Dussaud | 156/164 |
| 4,838,969 | A | | 6/1989 | Nomura et al. | 156/160 |
| 4,845,969 | A | * | 7/1989 | Niino et al. | 72/11.3 |
| 4,854,989 | A | | 8/1989 | Singheimer | 156/161 |
| 4,889,293 | A | | 12/1989 | Duke et al. | 242/75.51 |
| 4,915,282 | A | | 4/1990 | Martin et al. | 226/119 |
| 4,915,767 | A | | 4/1990 | Rajala et al. | 156/440 |
| 4,917,746 | A | | 4/1990 | Kons et al. | 156/164 |
| 4,941,939 | A | | 7/1990 | Nomura et al. | 156/495 |
| 4,946,539 | A | | 8/1990 | Ales et al. | 156/495 |
| 5,080,741 | A | | 1/1992 | Nomura et al. | 156/201 |
| 5,086,964 | A | | 2/1992 | Blaser | 226/108 |
| 5,091,039 | A | | 2/1992 | Ujimoto et al. | 156/519 |
| 5,113,678 | A | * | 5/1992 | Mannaka et al. | 164/413 |
| 5,147,487 | A | | 9/1992 | Nomura et al. | 156/164 |
| 5,178,341 | A | | 1/1993 | Ditto | 242/75.51 |
| 5,213,645 | A | | 5/1993 | Nomura et al. | 156/164 |
| 5,221,390 | A | | 6/1993 | Persson et al. | 156/164 |
| 5,236,539 | A | | 8/1993 | Rogberg et al. | 156/495 |
| 5,275,676 | A | | 1/1994 | Rooyakkers et al. | 156/164 |
| 5,357,178 | A | | 10/1994 | Kapitan | 318/7 |
| 5,366,130 | A | | 11/1994 | Fukuda | 226/44 |
| 5,485,386 | A | | 1/1996 | Andreasson | 364/471 |
| 5,517,914 | A | | 5/1996 | Tilton, Sr. | 101/226 |
| 5,602,747 | A | | 2/1997 | Rajala | 364/469.01 |
| 5,647,276 | A | | 7/1997 | Tilton, Sr. | 101/219 |
| 5,659,229 | A | | 8/1997 | Rajala | 318/6 |
| 5,660,066 | A | * | 8/1997 | Asano et al. | 72/11.4 |
| 5,679,195 | A | * | 10/1997 | O'Dwyer et al. | 156/159 |
| 5,806,783 | A | | 9/1998 | Turunen | 242/530.1 |

* cited by examiner

CONTROL BLOCK DIAGRAM
(2ND EMBODIMENT)

$F^*_{FRICTION}$
$F^*_{dSTATIC}$
$F^*_c$
$dF^*_{ce}/dt$
$A^*_p$
Sign($V_p$)
$K_a$
$K_2$
$M_a$
ZOH
$\frac{1}{M_2}$
$A_p$
$V_p$
$\Delta P$
$\frac{EA_o}{P}$
$F_c$
COMPUTE ACCELERATION
COMPUTE TENSION DERIVATIVE
CONTROL SYSTEM

CONTROL BLOCK DIAGRAM
(7TH EMBODIMENT)

$F^*_{FRICTION}$
$F^*_{dSTATIC}$
$F^*_c$
$dF^*_{ce}/dt$
$A^*_p$
Sign($V_p$)
$K_a$
$K_2$
M
ZOH
$\frac{1}{M_2}$
$A_p$
$V_p$
ΔP
$\frac{EA_o}{P}$
$F_c$
COMPUTE ACCELERATION AND VELOCITY
COMPUTE TENSION DERIVATIVE
CONTROL SYSTEM

CONTROLLING WEB TENSION, AND ACCUMULATING LENGTHS OF WEB, BY ACTIVELY CONTROLLING VELOCITY AND ACCELERATION OF A FESTOON

CROSS-REFERENCE TO RELATED APPLICATIONS

This application is a Continuation-in-part of U.S. application Ser. No. 09/110,753 filed Jul. 3, 1998 now U.S. Pat. No. 6,314,333 the entire disclosure of which is incorporated herein by reference.

FIELD OF THE INVENTION

This invention relates to the processing of continuous webs such as paper, film, composites, or the like, in dynamic continuous processing operations. More particularly, the invention relates to controlling tension in such continuous webs during the processing operation, and to temporarily accumulating limited lengths of such continuous webs.

BACKGROUND OF THE INVENTION

In the paper and plastic film industries, a dancer roll is widely used as a buffer between first and second sets of driving rolls in a line of processing machines. The first and second sets of driving rolls define respective first and second nips, which drive a continuous web. The dancer roll, which is positioned between the two sets of driving rolls, is also used in detecting the difference in speed between the first and second sets of driving rolls.

Typically, the basic purpose of a dancer roll is to maintain constant the tension on the continuous web which traverses the respective section of the processing line between the first and second sets of driving rolls, including traversing the dancer roll.

As the web traverses the section of the processing line, passing over the dancer roll, the dancer roll moves up and down in a track, serving two functions related to stabilizing the tension in the web. First, the dancer roll provides a tensioning force to the web. Second, the dancer roll temporarily absorbs the difference in drive speeds between the first and second sets of driving rolls, until such time as the drive speeds can be appropriately coordinated. However, the length of web which the dancer roll can absorb is limited to that length of web which traverses the upward path to the dancer roll and the downward path from the dancer roll.

A web extending between two drive rolls constitutes a web span. The first driving roll moves web mass into the span, and the second driving roll moves web mass out of the span. The quantity of web mass entering a span, per unit time, equals the web's cross-sectional area before it entered the span, times its velocity at the first driving roll. The quantity of web mass exiting a span, per unit time, equals the web's cross-sectional area in the span, times its velocity at the second driving roll. Mass conservation requires that over time, the web mass exiting the span must equal the mass entering the span. Web strain, which is proportional to tension, alters a web's cross-sectional area.

Typically, the dancer roll is suspended on a support system, wherein a generally static force supplied by the support system supports the dancer roll against an opposing force applied by the tension in the web and the weight of the dancer roll. The web tensioning force, created by the dancer system, causes a particular level of strain which produces a particular cross-sectional area in the web. Therefore, the web mass flowing out of the span is established by the second driving roll's velocity and the web tensioning force because the web tensioning force establishes web strain which in turn establishes the web's cross-sectional area. If the mass of web exiting the span is different from the mass of web entering the span, the dancer roll moves to compensate for the mass flow imbalance.

A dancer roll generally operates in the center of its range of travel. A position detector connected to the dancer roll recognizes any changes in dancer roll position, which signals a control system to either speed up or slow down the first and/or second pairs of driving rolls to bring the dancer back to the center of its travel range and reestablish the mass flow balance.

When the dancer roll is stationary, the dancer support system force, the weight of the dancer roll, and the web tension forces are in static equilibrium, and the web tension forces are at their steady state values. Whenever the dancer moves, the web tension forces change from their steady state values. This change in web tension forces supplies the effort that overcomes friction, viscous drag, and inertia, and causes the dancer motion. When the dancer moves very slowly, viscous drag and inertia forces are low and therefore the change in web tension is slight. However, during abrupt changes in mass flow, as during a machine speed ramp-up or ramp-down, the viscous drag, and inertia forces may be several times the web's steady state tension values.

The dancer roll's advantages are that it provides a web storage buffer which allows time to coordinate the speed of machine drives, and the dancer provides a relatively constant web tension force during steady state operation, or periods of gradual change. A limitation of dancer rolls, as conventionally used, is that under more dynamic circumstances, the dancer's ability to maintain constant web tension depends upon the dancer system's mass, drag, and friction.

In processing apparatus for processing a such continuous web, it is common practice to employ both a dancer roll, for purposes of tension control, and a festoon, biased to accumulate and temporarily hold a limited length of the continuous web, but a length substantially greater than the capacity of a dancer roll. The accumulated limited length of web is then played out, or an additional length accumulated, when processing of the continuous web is temporarily interrupted. Such temporary interruption can be, for example and without limitation, change and splicing of a feed/supply roll, or change and splicing of a wind-up roll. Other temporary interruptions can also be accommodated by using the festoon as an accumulator while maintaining operation of various steps in the web manufacture without having to shut the line down.

Such festoon is, by design, a low mass, low inertia device, and is typically biased so as to hold, at steady state operation, an accumulation of web material equivalent to approximately half its capacity for web accumulation. Thus, starting from steady state, the festoon can either accumulate more web if a downstream function is temporarily interrupted or can play out the accumulated length of web if an upstream function is temporarily interrupted. Critical to a festoon is its low mass, low inertia, design.

It is known to provide an active drive to the dancer roll, though such active drive is not known for a festoon, in order to improve performance over that of a static system, wherein the web is held under tension, but is not moving along the length of the web, whereby the dynamic disturbances, and the natural resonance frequencies of the dancer roll and the web are not accounted for, and whereby the resulting oscillations of the dancer roll can become unstable. Kuribayashi et al. "An Active Dancer Roller System for Tension Control of Wire and Sheet." University of Osaka Prefecture, Osaka, Japan, 1984.

More information about tension disturbances and response times is set forth in U.S. Pat. No. 5,659,229 issued Aug. 19, 1997, which is hereby incorporated by reference in its entirety. U.S. Pat. No. 5,659,229, however, controls the velocity of the dancer roll and does not directly control the acceleration of the dancer roll.

Thus, it is not known to provide an active dancer roll or an active festoon in a dynamic system wherein dynamic variations in operating parameters are used to calculate variable active drive force components for applying active and variable acceleration to the dancer roll or festoon, and wherein appropriate gain constants are used to affect response time without allowing the system to become unstable. Namely, it is not known to drive a dancer roll or festoon so as to nullify physical affects of actual mass and inertia of the dancer roll or festoon. Indeed, no variable drive parameter is known for a festoon.

SUMMARY OF THE DISCLOSURE

This invention provides novel festoon apparatus and methods. Festoons of the invention control tension and tension disturbances in a continuous web during processing of the web. The festoons of the invention also hold accumulations of limited lengths of the web sufficient to enable continuity of the web processing operation while absorbing the affects of short-term interruptions of web processing, either upstream or downstream of the festoon. Festoons of the invention are controlled so as to nullify the affects of mass and inertia on the ability of the festoon to respond to speed and tension changes in the web traversing the given section of the processing line, or to respond to differences in web speed at the in-feed and take-away nips, or to respond to large scale changes in web speed at the in-feed or take-away nips.

The invention comprehends processing apparatus defining a processing line, for advancing a continuous web of material through a processing step along a given section of the processing line. The processing apparatus comprises first and second rolls defining a first nip; third and fourth rolls defining a second nip, the first and second nips collectively defining the given section of the web; a festoon, including upper and lower festoon rolls, operating on the web in the given section of the processing line, thereby to control tension in the web and to accumulate a limited length of the web sufficient to sustain operation of the process on the length of web during routine temporary stoppages of web feed to the given section of the processing line or taking the web away from the given section of the processing line; an actuator applying net translational force to the upper festoon rolls; and a controller driving the festoon, and computing and controlling net translational acceleration of the upper festoon rolls such that the festoon is effective to control tension, at a desired level of constancy, and to accumulate a limited length of the web, in the respective section of the processing line.

In some embodiments the actuator applies a first static force component to the festoon upper rolls, having a first value and direction, balances the festoon upper rolls against static forces and the average dynamic tension in the respective section of the web, the controller outputting a second variable force component, through the actuator, effective to control the net actuating force imparted to the upper festoon rolls by the actuator, and effective to periodically adjust the value and direction of the second variable force component, each such value and direction of the second variable force component replacing the previous such value and direction of the second variable force component, and acting in combination with the first static force component to impart the target net translational acceleration to the upper festoon rolls, the second variable force component having a second value and direction, modifying the first static force component, such that the net translational acceleration of the upper festoon rolls is controlled by the net actuating force enabling the festoon to control the web tension, and further comprising apparatus for computing acceleration ($A_p$) of the upper festoon rolls. The controller preferably comprises a computer controller providing control commands to the actuator based on the computed acceleration of the upper festoon rolls.

Preferred embodiments include a sensor for sensing tension in the web after the festoon, the controller being adapted to use the sensed tension in computing the value and direction of the second variable force component, and for imparting the computed value and direction through the actuator to the upper festoon rolls.

In some embodiments, the sensor is effective to sense tension at least 1 time per second, preferably at least 500 times per second, more preferably at least 1000 times per second, and the controller is effective to recompute the value and direction of the second variable force component, thereby to adjust the value and direction of the computed second variable force component a like number of times.

In preferred embodiments, the controller controls the actuating force imparted to the upper festoon rolls, and thus controls acceleration of the upper festoon rolls, including compensating for any inertia imbalance of the festoon not compensated for by the first static force component.

In some embodiments, the apparatus includes an observer for computing translational acceleration ($A_p$) of the upper festoon rolls, the observer comprising one of (i) a subroutine in the computer program or (ii) an electrical circuit, which computes an estimated translational acceleration and an estimated translational velocity of the upper festoon rolls.

The processing apparatus of the invention preferably includes first apparatus for measuring a first velocity of the web after the festoon; second apparatus for measuring a second velocity of the web at the festoon; third apparatus for measuring translational velocity of the upper festoon rolls; and fourth apparatus for sensing the position of the upper festoon rolls.

The invention can include fifth apparatus for measuring web tension before the festoon; and sixth apparatus for measuring web tension after the festoon.

One equation for calculating the servo force is $$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein the translational velocity set-point $V^*_p$ of the upper festoon rolls reflects the equation:

$$V_p=[EA_0/(EA_0-F_c)][V_2(1-F_b/EA_0)-V_3(1-F_c/EA_0)],$$

to control the actuator based on the force so calculated, wherein:

$F^*_{d\ Static}$=static force component on the upper festoon rolls and is equal to $Mg+2F^*_c$.

$F_c$=tension in the web after the last movable festoon roller, $F^*_c$=tension in the web, target set point, per process design parameters, $F_b$=tension in the web ahead of the last movable festoon roller, $F^*_{friction}$=Friction in either direction resisting movement of the upper festoon rolls, $F^*_{servo}$=Force to be applied by the actuator, $b_a$=control gain constant regarding festoon translational velocity, in Newton seconds/meter, $k_a$=control gain constant regarding web tension, Mg=mass of the upper festoon rolls times gravity, $M_A$=active mass, $M_e$=active mass and physical mass, $V_p$=instantaneous translational velocity of the upper festoon rolls immediately prior to application of the second variable force component, Sign($V_p$)=positive or negative value depending on the direction of movement of the upper festoon rolls, $V_2$=velocity of the web at the last movable festoon roller, $V_3$=velocity of the web after the festoon, $V^*_p$=reference translational velocity of the upper festoon rolls, set point, r=radius of a respective pulley on the actuator, E=Modulus of elasticity of the web, $A_o$=cross-sectional area of the unstrained web, $A^*_p$=target translational acceleration of the upper festoon rolls, set point, and $A_p$=translational acceleration of the upper festoon rolls.

In some embodiments the target acceleration $A^*_p$ is computed using the equation:

$$A^*_p=[V^*_p-V_p]/\Delta T$$

where ΔT=scan time for the computer controller.

In preferred embodiments, the computer controller provides control commands to the actuator based on the sensed position of the upper festoon rolls, and the measured web tensions, acceleration and velocities, and thereby controls the actuating force imparted to the upper festoon rolls by the actuator thus either to maintain a substantially constant web tension or to provide a predetermined pattern of variations in the web tension.

In some embodiments, the apparatus includes first apparatus for measuring translational velocity of the upper festoon rolls; second apparatus for measuring web tension force after the festoon; and third apparatus for sensing the current of the actuator, with the controller optionally comprising a computer controller computing a derivative of web tension force from the web tension force over the past sensing intervals, and including an observer computing the translational velocity of the upper festoon rolls, and the computer controller computing a derivative of the web tension force.

The controller can comprise a computer controller, and including a fuzzy logic subroutine stored in the computer controller for computing a derivative of web tension force from the web tension force and the translational velocity of the upper festoon rolls, the fuzzy logic subroutine inputting web tension force error, the derivative of web tension force error, and acceleration error, the fuzzy logic subroutine proceeding through the step of fuzzy inferencing of the above errors, and de-fuzzifying of inferences to generate a command output signal, the fuzzy logic subroutine being executed during each scan of the sensing apparatus.

The processing apparatus can further include first apparatus for measuring translational velocity of the upper festoon rolls; and second apparatus for sensing the current of the actuator.

In some embodiments, the controller computes the estimated translational acceleration of the upper festoon rolls from the equation:

$$A_{pe}=[k_1(V_p-V_{pe})+k_{te}I-F^*_{d\ static}-F^*_{friction}\mathrm{Sign}(V_p)]/M_{2e}$$

where $A_{pe}$=estimated translational acceleration of the upper festoon rolls, $F^*_{d\ static}$=static force component on the upper festoon rolls and is equal to Mg+2$F^*_c$.

$F^*_{friction}$=Friction in either direction resisting movement of the upper festoon rolls, Sign($V_p$)=positive or negative value depending on the direction of movement of the upper festoon rolls, $k_1$=Observer gain, $V_p$=instantaneous translational velocity of the upper festoon rolls, $V_{pe}$=estimated translational velocity, $k_{te}$=Servo motor (actuator) torque constant estimate, I=actuator current, and $M_{2e}$=Estimated physical mass of the upper festoon rolls, with the process optionally including a zero order hold for storing force values for application to the upper festoon rolls, and optionally actively compensating for coulomb and viscous friction, and acceleration, to actively cancel the effects of mass.

In some embodiments the invention further includes first apparatus for measuring translational position of the upper festoon rolls; second apparatus for measuring web tension force after the festoon; and third apparatus for sensing the motor current of the actuator, optionally including an observer for computing estimated translational velocity and estimated translational acceleration of the upper festoon rolls from the change in position of the upper festoon rolls.

In some embodiments, the invention further includes first apparatus for measuring translational position of the upper festoon rolls; and second apparatus for sensing the motor current of the actuator; and an observer for computing translational acceleration of the upper festoon rolls.

In some embodiments, the invention includes first apparatus for measuring web tension $F_c$ after the festoon; and second apparatus for sensing the motor current of the actuator, optionally including an observer utilizing the motor current and force on the web, in combination with an estimate of system mass $M_{2e}$, to compute an estimate of translational acceleration $A_{pe}$ of the upper festoon rolls, the observer optionally integrating the translational acceleration to compute an estimate of translational velocity $V_{pe}$ and integrating the estimated translational velocity to compute an estimated web tension force $F_{ce}$, and changing values until the estimated web tension force equals the actual web tension force.

In some embodiments, the controller provides the control commands to the actuator thereby controlling the actuating force imparted to the upper festoon rolls by the actuator, and thus controlling acceleration of the upper festoon rolls, such that the actuator maintains inertial compensation for the festoon system.

In some embodiments, the first nip comprises a wind-up roll downstream from the festoon and the second nip comprises driving rolls upstream from the festoon, the controller sending control signals to the wind-up roll and the driving rolls.

In some embodiments, the invention includes first velocity apparatus for measuring a first velocity of the web after the festoon, and second velocity apparatus for measuring a second velocity of the web at the festoon, the controller comprising a computer controller computing a velocity command $V^*_p$ using the first and second sensed velocities and web tension before and after the festoon.

In some embodiments, the controller comprises a computer controller intentionally periodically varying the variable force component to unbalance the system, and thus the tension on the web by periodically inputting command forces through the actuator causing sudden temporary alternating upward and downward movements of the upper festoon rolls such that the upper festoon rolls intermittently impose alternating higher and lower levels of tension on the web, the periodic input of force optionally causing the alternating movements of the upper festoon rolls to be repeated more than 200 times per minute.

The invention also comprehends, in a processing operation wherein a continuous web of material is advanced through a processing step defined by first and second spaced nips, each nip being defined by a pair of nip rolls, a method of controlling web tension, and of accumulating a limited length of the web, in the respective section of web. The method comprises providing a festoon, having upper and lower festoon rolls, operative on the respective section of web; applying a first generally static force component to the upper festoon rolls, the first generally static force component having a first value and direction; applying a second variable force component to the upper festoon rolls, the second variable force component having a second value and direction, modifying the first generally static force component, and thereby modifying (i) the effect of the first generally static force component on the upper festoon rolls and (ii) corresponding translational acceleration of the upper festoon rolls; and adjusting the value and direction of the second variable force component repeatedly, each such adjusted value and direction of the second variable force component (i) replacing the previous such value and direction of the second variable force component and (ii) acting in combination with the first static force component to provide a target net translational acceleration to the upper festoon rolls.

The method can include adjusting the value and direction of the second variable force component at least 500 times per second.

The method can include sensing tension in the web after the festoon, and using the sensed tension to compute the value and direction of the second variable force component.

The method can include sensing tension in the respective section of the web at least 1 time per second, recomputing the value and direction of the second variable force component and thereby adjusting the value and direction of the computed second variable force component at least 1 time per second, and applying the recomputed value and direction to the festoon at least 1 time per second.

The invention can include adjusting the force components and target net translational acceleration so as to maintain an average dynamic tension in the web throughout the processing operation while controlling translational acceleration such that system effective mass equals the polar inertia of the upper festoon rolls collectively, divided by outer radius of the rolls, squared.

The method can include periodically and intentionally varying the variable force component to unbalance the system, and thus the tension on the web by periodically inputting command forces through the actuator causing sudden temporary alternating upward and downward movements of the upper festoon rolls such that the upper festoon rolls intermittently impose alternating higher and lower levels of tension on the web, optionally the periodic input of force causing the upward movement of the upper festoon rolls to be repeated more than 200 times per minute.

In some embodiments, the method includes the first and second force components being applied simultaneously to the upper festoon rolls as a single force, by an actuator, and wherein the step of applying a force to the upper festoon rolls include measuring a first velocity of the web after the festoon; measuring a second velocity of the web at the festoon; measuring translational velocity of the upper festoon rolls; sensing the position of the upper festoon rolls; measuring web tension before the festoon; and measuring web tension after the festoon, and applying the force to the upper festoon rolls computed according to the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein:

$F^*_{d\ static}$=static force component on the upper festoon rolls and is equal to $Mg+2F^*_c$.

$F^*_{friction}$=Friction in either direction resisting movement of the upper festoon rolls, $F_c$=tension in the web after the upper festoon rolls, $F^*_c$=tension in the web, target set point, per process design parameters, $F^*_{servo}$=Force generated by the actuator, $b_a$=control gain constant regarding translational velocity of the upper festoon rolls, in Newton seconds/meter, $k_a$=control gain constant regarding web tension, Mg=mass of the upper festoon rolls times gravity, $M_A$=active mass, $M_e$=active mass and physical mass, $V_p$=instantaneous translational velocity of the upper festoon rolls immediately prior to application of the second variable force component, $\mathrm{Sign}(V_p)$=positive or negative value depending on the direction of movement of the upper festoon rolls, $A^*_p$=reference translational acceleration of the upper festoon rolls, set point, $A_p$=translational acceleration of the upper festoon rolls, and wherein the translational velocity set-point $V^*_p$ of the upper festoon rolls reflects the equation:

$$V^*_p=[EA_o/(EA_o-F_c)][V_2(1-F_b/EA_o)-V_3(1-F_c/EA_o)],$$

to control the actuator based on the force so computed, wherein:

$F_b$=tension in the web ahead of the last movable festoon roller, $V_2$=velocity of the web at the last movable festoon roller, $V_3$=velocity of the web after the festoon, $V^*_p$=reference translational velocity of the upper festoon rolls, set point, r=radius of a respective pulley on the actuator, E=Modulus of elasticity of the web, and $A_o$=cross-sectional area of the unstrained web, and optionally the target acceleration $A^*_p$ being computed using the equation:

$$A^*_p=[V^*_p=V_p]/\Delta T$$

where ΔT=scan time, the computations being repeated and the force adjusted at least 1 time per second.

In other embodiments, the first and second force components are applied simultaneously to the upper festoon rolls as a single force, and wherein applying a force to the upper festoon rolls includes measuring translational velocity of the upper festoon rolls; measuring web tension force after the festoon; and sensing the current of the actuator, such measuring and sensing occurring during periodic sensing intervals. and computing a derivative of web tension force from the web tension force based on present and past sensing intervals; computing the translational velocity of the upper festoon rolls; and computing a derivative of the web tension force, the applying of a force to the upper festoon rolls optionally including executing a fuzzy logic subroutine by inputting web tension force error, the derivative of web tension force error, and acceleration error, the fuzzy logic subroutine proceeding through the step of fuzzy inferencing of the above errors, and de-fuzzifying inferences to generate a command output signal, the fuzzy logic subroutine being executed during each of the measuring and sensing intervals.

In some embodiments, the first and second force components are applied simultaneously to the upper festoon rolls as a single force, and wherein applying a force to the upper festoon rolls includes measuring the translational velocity of the upper festoon rolls; sensing the current of an actuator; and computing the estimated translational acceleration of the upper festoon rolls from the equation $$A_{pe}"[F^*_{d\ static}+F^*_{friction}\mathrm{Sign}(V_p)+k_1(V_p-V_{pe})+k_{te}I]/M_{2e}$$

where:

$A_{pe}$=estimated translational acceleration of the upper festoon rolls, $F^*_{d\ static}$=static force component on the upper festoon rolls and is equal to $Mg+2F^*_c$.

$F^*_{fraction}$=Friction in either direction resisting movement of the upper festoon rolls, $\mathrm{Sign}(V_p)$=positive or negative value depending on the direction of movement of the upper festoon rolls, $k_1$=Observer gain, $V_p$=instantaneous translational velocity of the upper festoon rolls, $V_{pe}$=estimated translational velocity, $k_{te}$=Servo motor (actuator) torque constant estimate, I=actuator current, and $M_{2e}$=Estimated physical mass of the upper festoon rolls.

In some embodiments, the first and second force components are applied simultaneously to the upper festoon rolls as a single force, and applying a force to the upper festoon rolls includes measuring the translational position of the upper festoon rolls; measuring web tension force after the festoon; and sensing the motor current of an actuator applying the force to the upper festoon rolls, the above measuring and sensing occurring at each sensing interval , the method further including computing a derivative of web tension from the present measured web tension and the web tension measured in the previous sensing interval, optionally including computing estimated translational velocity and estimated translational acceleration of upper festoon rolls from the change in position of the upper festoon rolls.

In some embodiments, the first and second force components are applied simultaneously to the upper festoon rolls as a single force, and applying a force to the upper festoon rolls includes measuring the translational position of the upper festoon rolls; and sensing the motor current of an actuator applying the force to the upper festoon rolls; computing an estimated translational velocity of the festoon upper rolls by subtracting the previous sensed value for translational position from the present sensed value of translational position and then dividing by the time interval between sensing of the values; and computing a new force command for application to the actuator in response to the earlier computed values.

In some embodiments, the first and second force components are applied simultaneously to the upper festoon rolls as a single force, and applying a force to the upper festoon rolls includes measuring web tension $F_c$ after the festoon;

(b) sensing motor current of an actuator; and utilizing the motor current and force on the web, in combination with an estimate of system mass $M_{2e}$, to compute an estimate of translational acceleration $A_{pe}$, optionally including integrating the translational acceleration to compute an estimate of translational velocity $V_{pe}$ and integrating the estimated translational velocity to compute an estimated web tension force $F_{ce}$.

Some embodiments of the invention include, in a processing operation wherein a continuous web of material is advanced through a processing step, a method of controlling the tension in the respective section of the web. The method comprises providing a festoon, having upper and lower festoon rolls, operative for controlling tension on the respective section of web; providing an actuator to apply an actuating force to the upper festoon rolls; measuring a first velocity of the web after the festoon; measuring a second velocity of the web at the festoon; measuring motor current of the actuator; measuring web tension before the festoon; measuring web tension after the festoon; measuring translational velocity of the upper festoon rolls; sensing the position of the upper festoon rolls; measuring acceleration of the upper festoon rolls; providing force control commands to the actuator based on the above measured values, including computed acceleration $A^*_p$ of the upper festoon rolls, to thereby control the actuating force imparted to the upper festoon rolls by the actuator to control the web tension, optionally including providing force control commands to the actuator based on the equation $$F^*_{servo}=F^*_{d\ static}+F^*_{friction}\mathrm{Sign}(V_p)+b_a(V^*_p=V_p)+k_a(F^*_c-F_c)+M_a(A^*_p-A_p),$$

wherein the translational velocity set-point $V^*_p$ of the upper festoon rolls reflects the equation $$V_p=[EA_o/(EA_o-F_c)][V_2(1-F_b/EA_o)-V_3(1-F_c/EA_o)],$$

to control the actuator based on the force so calculated wherein:

$F^*_{d\ static}$=static force component on the upper festoon rolls and is equal to $Mg+2F^*_c$, $F^*_{friction}$=Friction in either direction resisting movement of the upper festoon rolls, $F^*_{servo}$=Target force to be applied by the actuator, $F_c$=tension in the web after the festoon, $F^*_c$=target tension in the web, set point, $F_b$=tension in the web ahead of the last movable festoon roller, $b_a$=control gain constant re translational velocity of the upper festoon rolls, in Newton seconds/meter, $k_a$=control gain constant re web tension, Mg=mass of the upper festoon rolls times gravity, $M_A$=active mass, $M_e$=active mass and physical mass, $V_p$=instantaneous translational velocity of the upper festoon rolls, $\mathrm{Sign}(V_p)$=positive or negative value depending on the direction of movement of the upper festoon rolls, $V_2$=velocity of the web at the last movable festoon roller, $V_3$=velocity of the web after the festoon, $V^*_p$=target translational velocity of the upper festoon rolls, set point, r=radius of a respective pulley on the actuator, E=Modulus of elasticity of the web, $A_o$=cross-sectional area of the unstrained web, $A^*_p$=target translational acceleration of the upper festoon rolls, set point, and $A_p$=translational acceleration of the upper festoon rolls, optionally including computing the target acceleration $A^*_p$ using the equation:

$$A^*_p=[V_p=V_p]/\Delta T$$

where ΔT=scan time or interval between sensing of translational velocity.

Some embodiments include applying the actuator and thereby controlling acceleration of the upper festoon rolls, such that the actuator maintains inertial compensation for the upper festoon rolls.

Some embodiments comprehend processing apparatus defining a processing line, for advancing a continuous web of material through a processing step along a given section of the processing line. The processing apparatus comprises a first and second rolls defining a first nip; third and fourth rolls defining a second nip, the first and second nips collectively defining the given section of the web; a web storage buffer operating on the web in the given section of the processing line, thereby to control tension in the web and to accumulate a limited length of the web sufficient to sustain operation of the process on the length of web during routine temporary stoppages of web feed to the given section of the processing line or taking the web away from the given section of the processing line; an actuator applying net translational force to the web storage buffer; and a controller driving the web storage buffer, and computing and controlling net translational acceleration of the web storage buffer such that the web storage buffer is effective to control tension, at a desired level of constancy, and to accumulate a limited length of the we, in the respective section of the processing line.

BRIEF DESCRIPTION OF THE DRAWINGS

The present invention will be more fully understood and further advantages will become apparent when reference is made to the following detailed description of the invention and the drawings, in which.

Figure 1:
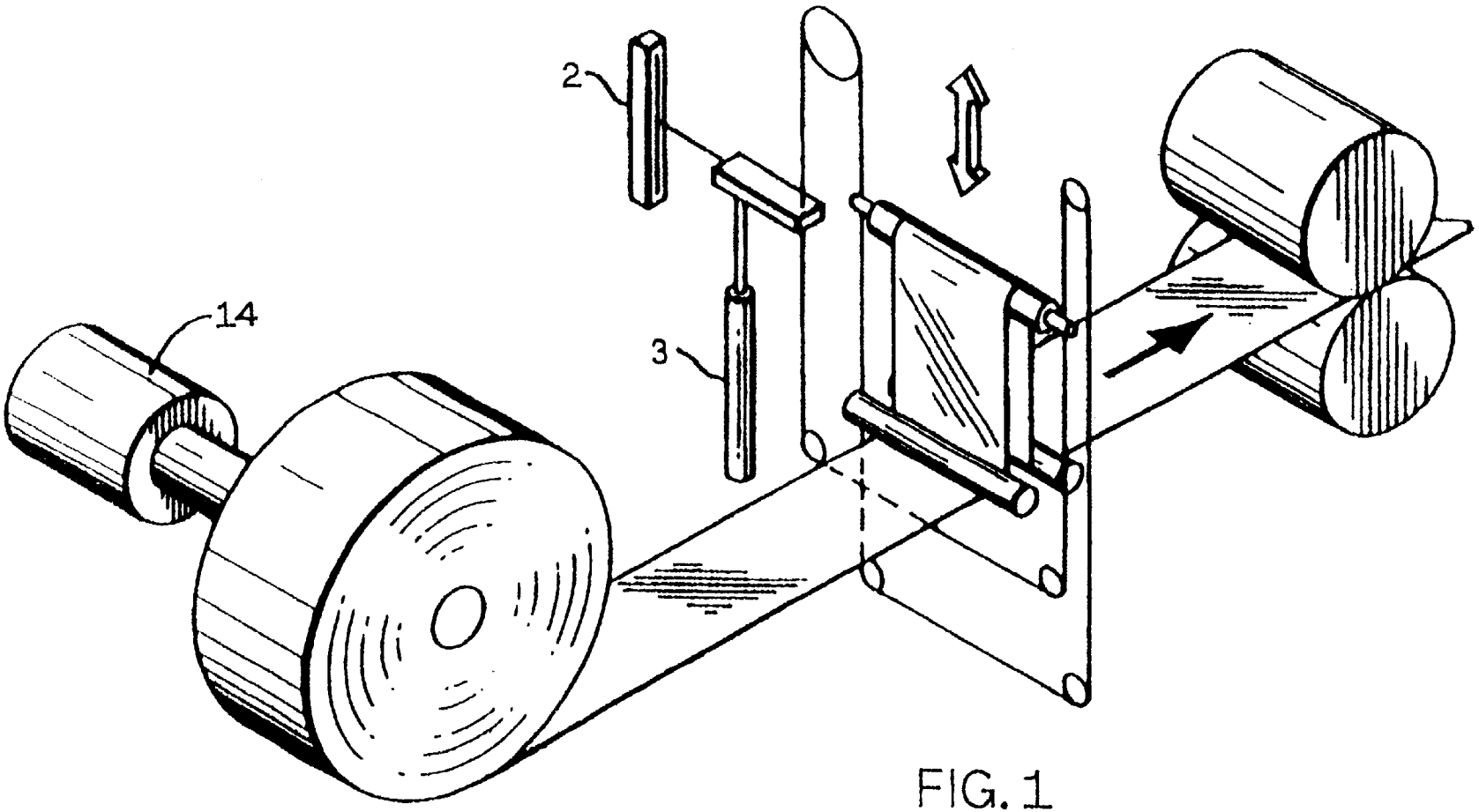
FIG. 1 PRIOR ART
FIG. 1 is a pictorial view of part of a conventional processing operation, showing a conventional dancer roll adjacent the unwind station.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The following detailed description is made in the context of a converting process. The invention can be appropriately applied to other flexible web processes.

FIG. 1 illustrates a typical conventional dancer roll control system. Speed of advance of web material is controlled by an unwind motor 14 in combination with the speed of the nip downstream of the dancer roll. The dancer system employs lower turning rolls, which are fixed in position, before and after the dancer roll, itself. The dancer roll moves vertically up and down within the operating window defined between the fixedly mounted lower turning rolls and the upper turning pulleys in the endless cable system. The position of the dancer roll in the operating window, relative to (i) the top of the window adjacent the upper turning pulleys and (ii) the bottom of the window adjacent the fixedly mounted turning rolls is sensed by position transducer 2. A generally static force having a vertical component is provided to the dancer roll support system by air cylinder 3.

In general, to the extent the process take-away speed exceeds the speed at which the web of raw material is supplied to the dancer roll, the static forces on the dancer roll cause the dancer roll to move downwardly within its operating window. As the dancer roll moves downwardly, the change in position is sensed by position transducer 2, which sends a corrective signal to unwind motor 14 to increase the speed of the unwind. The speed of the unwind, or the unwind nip, increases enough to return the dancer roll to the mid-point in its operating window.

By corollary, if the take-away speed lags the speed at which web material is supplied to the dancer roll, the static forces on the dancer roll cause the dancer roll to move upwardly within its operating window. As the dancer roll moves upwardly, the change in position is sensed by position transducer 2. As the dancer rises above the mid-point in the operating window, the position transducer sends a corresponding corrective signal to unwind motor 14 to decrease the speed of the unwind, or unwind nip, thereby returning the dancer roll to the mid-point in the operating window.

In either of the above cases, the corrective speed change can be made at the take-away nip rather than at the unwind or unwind nip. However, changing speed of the unwind is typically simpler, and is therefore preferred.

The above conventional dancer roll system is limited in that its response time is controlled by the gravitational contribution to vertical acceleration of the dancer roll, and by the mass of equipment in e.g. the unwind apparatus that must change speed in order to effect a change in the unwind speed.

Figure 2:
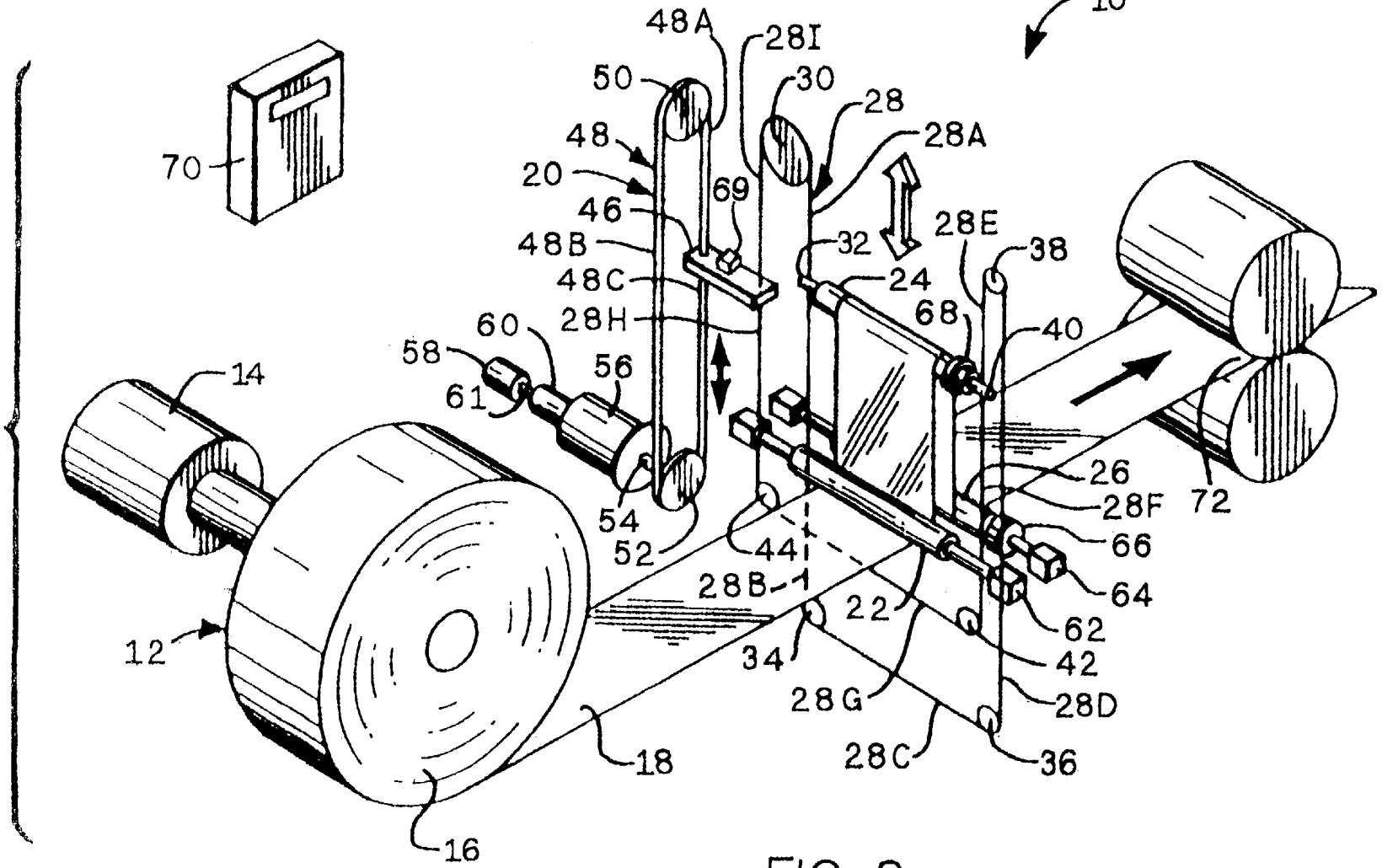
FIG. 2 is a pictorial view of a first embodiment of an active dancer roll adjacent the unwind station.

Referring to FIG. 2. the process system 10 of the invention incorporates an unwind 12, including unwind motor 14 and roll 16 of raw material. A web 18 of the raw material is fed from roll 16, through a dancer system 20, to the further processing elements of the converting process downstream of dancer system 20.

In the dancer system 20, web of material 18 passes under fixedly mounted turning roll 22 before passing over the dancer roll 24, and passes under fixedly mounted turning roll 26 after passing over the dancer roll 24. As shown, dancer roll 24 is carried by a first endless drive cable 28.

Starting with a first upper turning pulley 30, first endless drive cable 28 passes downwardly as segment 28A to a first end 32 of dancer roll 24, and is fixedly secured to the dancer roll at first end 32. From first end 32 of dancer roll 24, drive cable 28 continues downwardly as segment 28B to a first lower turning pulley 34, thence horizontally under web 18 as segment 28C to a second lower turning pulley 36. From second lower turning pulley 36, the drive cable passes upwardly as segment 28D to a second upper turning pulley 38. From second upper turning pulley 38, the drive cable extends downwardly as segment 28E to second end 40 of dancer roll 24, and is fixedly secured to the dancer roll at second end 40. From second end 40 of dancer roll 24, the drive cable continues downwardly as segment 28F to a third lower turning pulley 42, thence back under web 18 as segment 28G to fourth lower turning pulley 44. From fourth lower turning pulley 44, the drive cable extends upwardly as segment 28H to, and is fixedly secured to, connecting block 46. From connecting block 46, the drive cable continues upwardly as segment 28I to first upper turning pulley 30, thus completing the endless loop of drive cable 28.

Connecting block 46 connects the first endless drive cable 28 to a second endless drive chain 48. From connecting block 46, second endless drive chain 48 extends upwardly as segment 48A to a third upper turning pulley 50. From upper turning pulley 50, the endless drive chain extends downwardly as segment 48B to fifth lower turning pulley 52. From fifth lower turning pulley 52, the drive chain extends back upwardly as segment 48C to connecting block 46, thus completing the endless loop of drive chain 48.

Shaft 54 connects fifth lower turning pulley 52 to a first end of an actuator 56. Dancer roll position sensor 58 and dancer roll translational velocity sensor 60 extend from a second end of actuator 56, on shaft 61.

Load sensors 62, 64 are disposed on the ends of turning rolls 22, 26 respectively for sensing stress loading on the turning rolls transverse to their axes, the stress loading on the respective turning rolls being interpreted as tension on web 18.

Velocity sensor 66 is disposed adjacent the end of turning roll 26 to sense the turn speed of turning roll 26. Velocity sensor 68 is disposed adjacent second end 40 of dancer roll 24 to sense the turn speed of the dancer roll, the turning speeds of the respective rolls being interpreted as corresponding to web velocities at the respective rolls.

Acceleration sensor 69 is disposed on connecting block 46 and thus moves in tandem with dancer roll 24. Acceleration sensor 69 senses acceleration on the dancer roll in response to acceleration of connecting block 46. Of course, the direction of acceleration for connecting block 46 is directly opposite the direction of acceleration of dancer roll 24. Therefore, the direction of the sensed acceleration is given an opposite value to the actual value of the acceleration of connecting block 46.

Acceleration sensor 69 can also be mounted in proper orientation to selected segments such as 28A, of drive cable 28 moving in the same direction as dancer roll 24, or directly on the dancer roll. The acceleration of dancer roll 24 is measured and sent to computer controller 70.

Dancer system 20 is controlled by computer controller 70. Computer controller 70 is a conventional digital computer, which can be programmed in conventional languages such as "Basic" language, "Pascal" language, "C" language, or the like. Such computers are generically known as "personal computers," and are available from such manufacturers as Compaq and IBM.

Position sensor 58, velocity sensors 60, 66, 68, load sensors 62, 64 and acceleration sensor 69 all feed their inputs into computer controller 70. Computer controller 70 processes the several inputs, computing a velocity set point or target velocity using the equation:

$$V^*_p=[EA_o/(EA_o-F_c)][V_2(1-F_b/EA_o)-V_3(1-F_c/EA_o)],$$

where: $V_2$=Velocity of web 18 at dancer roll 24, $V_3$=Velocity of the web after the dancer roll, $V^*_p$=target translational velocity of the dancer roll 24, to be reached if the set point $V^*_p$ is not subsequently adjusted or otherwise changed, E=Actual modulus of elasticity of the web, $A_o$=Actual cross-sectional area of the unstrained web, $F_b$=Tension in the web ahead of the dancer roll, and $F_c$=Tension in the web after the dancer roll.

In one embodiment a target translational acceleration or acceleration set point is calculated using the equation:

$$A^*_p=[V^*_p=V_p]/\Delta T$$

where: ΔT=the scan time for the control system, and $A^*_p$=target translational acceleration command of dancer roll 24, to be reached if the set point $A^*_p$ is not subsequently adjusted or otherwise changed.

Using the calculated target acceleration $A^*_p$, a target actuator force command is generated using the equation:

$$F^*_{servo}=F^*_{d\ static}+F^*_{friction}\mathrm{Sign}(V_p)+b_a(V^*_p=V_p)+k_a(F^*_c-F_c)+M_a(A^*_p-A_p)+A^*_pM_e],$$

where: $F^*_{d\ static}=M_2g+2F^*_c$, in combination with $F^*_{friction}\mathrm{Sign}(V_p)$, comprises a first force component having a static force in the equation. The above equation utilizes the following constants and variables:

$F^*_{d\ static}$=Static vertical force component on the dancer roll.

$F^*_{friction}$=Friction, in either direction, resisting movement of the dancer roll, $F^*_c$=Target tension in web 18 after dancer roll 24 comprising a target set point, per process design parameters, $F^*_{servo}$=Force generated by actuator 56, preferably a servo-motor, $b_a$=Force control gain constant re dancer translational velocity, in newton seconds/meter, predetermined by user as a constant, $k_a$=Force control loop gain,=(P times $K_f$)/($E_e$ times $A_{oe}$)

$K_f$=Active spring constant, $M_2g$=Actual physical mass of dancer roll system times gravity, $M_{2e}$=Estimated physical mass of dancer roll, $M_a$=Active mass of the dancer roll, $M_e$=Effective mass defined as Active mass plus physical mass of the dancer roll ($M_2+M_a$), $V_p$=Instantaneous vertical velocity of the dancer roll immediately prior to application of the second variable vertical force component, vertical velocity equaling the translational velocity of dancer roll 24 within its operating window, Sign($V_p$)=positive or negative value depending on the direction of movement of the dancer roll, $A_p$=actual translational acceleration of the dancer roll immediately prior to application of the second variable vertical force component, ΔP=Change in dancer position in translational direction, P=Dancer position in translational direction, within operating window, $E_e$=Estimate of modulus of elasticity of the web, $A_{oe}$=Estimate of cross-sectional area of the unstrained web, and ZOH=Zero Order Hold or Latch (holds last force command value).

The overall torque applied by actuator 56 can be described by the equation:

$$T^*_{dancer}=r[F^*_{servo}]$$

using the following variables $T^*_{dancer}$=actuator torque command or force, and r=Radius of pulley on the actuator.

The response time is affected by the value selected for the gain constant "$b_a$." The gain constant "$b_a$" is selected to impose a damping effect on especially the variable force component of the response, in order that the active variable component of the response not make dancer roll 24 so active as to become unstable, such as where the frequency of application of the responses approaches a natural resonant frequency of the web and dancer roll. Accordingly, the gain constant "$b_a$" acts somewhat like a viscous drag in the system. For example, in a system being sampled and controlled at 1000 times per second, where the mass of dancer roll 24 is 1 kg, a suitable control gain constant "$b_a$" is 2.

Similarly, the gain constant "$k_a$" compensates generally for web tension errors in the system. A suitable gain constant "$k_a$" for the instantly above described processing system is 20. The gain constants "$b_a$" and "$k_a$" vary depending on the sampling rate of the system.

It is contemplated that the operation and functions of the invention have become fully apparent from the foregoing description of elements and their relationships with each other, but for completeness of disclosure, the usage of the invention will be briefly described hereinafter.

Figure 3:
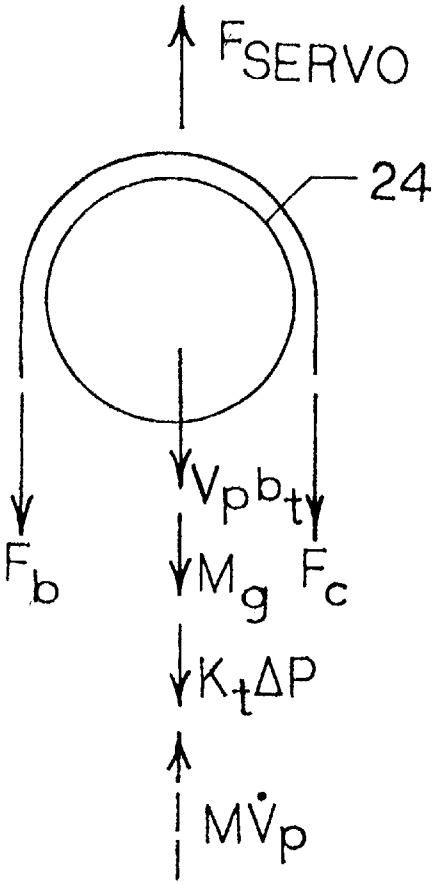
FIG. 3 is a free body force diagram showing the forces acting on a dancer roll.

In order for dancer roll 24 to operate as a "dancer" roll, the several forces acting on the dancer roll must, in general, be balanced, as shown in FIG. 3. FIG. 3 illustrates the forces being applied by actuator 56 balanced against the tension forces in web 18, the weight of dancer roll 24, any existing viscous drag effects times the existing translational velocity $V_p$ of the dancer roll, any existing spring effect $K_f$ times the change in positioning ΔP of the dancer roll, and dancer mass $M_2$ times its vertical acceleration at any given time.

Throughout this teaching the phrases "actuator", as well as servo motor, and $F^*_{servo}$ are utilized. All such phrases refer to an apparatus applying force to dancer roll 24. Such actuators can be conventional motors, rotating electric motors, linear electric motors, pneumatic driven motors, or the like. The phrase "$F_{servo}$" does not infer, or imply a specific type of motor in this application.

The actuator force $F_{servo}$ generally includes a first generally static force component $F^*_{d\ static}$, having a relatively fixed value, responsive to the relatively fixed static components of the loading on the dancer roll. The generally static force component $F^*_{d\ static}$ provides the general support that keeps dancer roll 24 balanced (vertically) in its operating window, between turning rolls 22, 26 and upper turning pulleys 30 and 38, responding based on the static force plus gravity. To the extent dancer roll 24 spends significant time outside a central area of the operating window, computer controller 70 sends conventional commands to the line shaft drivers or the like to adjust the relative speeds between e.g. unwind 12 and nip 72 in the conventional way to thus bring the dancer roll generally back to the center of its operating window.

The actuator force $F_{servo}$ optionally can include the force component $F^*_{friction}$, which relates to the force of friction overcome to begin moving dancer roll 24 in a translational direction, or to continue movement of the dancer roll. A value for the force component $F^*_{friction}$ can comprise a second static force value selected according to the particulars of dancer system 20. The force component $F^*_{friction}$ is then added to or subtracted from the overall force applied by actuator 56 depending on the direction of movement of dancer roll 24.

In other embodiments, force component $F^*_{friction}$ can be varied by computer controller 70 depending on the velocity of dancer roll 24. For example, when dancer roll 24 is stationary (not moving in either direction), force component $F^*_{friction}$ requires a greater force to initiate movement in a given direction. Likewise, after dancer roll 24 begins moving in a given direction, the amount of friction resisting the continued movement of the dancer roll is less than the at-rest friction resisting dancer roll movement. Therefore, the value of force component $F^*_{friction}$ decreases during movement in a given direction. Computer controller 70, in response to sensed velocity $V_p$ can appropriately change the value of force component $F^*_{friction}$, as needed, for use in the equations described earlier controlling dancer roll 24.

In other embodiments, the force component $F^*_{friction}$ need not be accounted for depending on the accuracy required for the overall system. However, computer controller 70 generally can be utilized to at least store a constant value that can be added or subtracted to the force applied by the servo-motor. Accounting for force component $F^*_{friction}$ generally improves the operation of dancer system 20.

In addition to the static force component $F^*_{d\ static}$ and the force component $F^*_{friction}$, actuator 56 exerts a dynamically active, variable force component, responsive to tension disturbances in web 18. The variable force component, when added to the static force component, represents the net vertical force command issued by computer controller 70, to actuator 56. Actuator 56 expresses the net vertical force command as torque $T^*_{dance}$ delivered through drive chain 48, drive cable 28, and connecting block 46, to dancer roll 24.

Accordingly, in addition to the normal passive response of dancer roll 24, based on such static forces as mass, gravity, and web tension, dancer system 20 of the invention adds a dynamic control component, outputted at actuator 56. The result is a punctuation of the normal dancer system response characteristic with short-term vertical forces being applied to dancer roll 24 by actuator 56, with the result that the dancer roll is much more pro-active, making compensating changes in translational velocity and translational acceleration much more frequently and accurately than a conventional dancer system that responds only passively. Of course, net translational velocity or net translational acceleration, at any given point in time, can be a positive upward movement, a negative downward movement, or no movement at all, corresponding to zero net translational velocity and/or zero net translational acceleration, depending on the output force command from computer controller 70. Computer controller 70, of course, computes both the value and direction of the variable force, as well as the net force $F^*_{servo}$.

Figure 4:
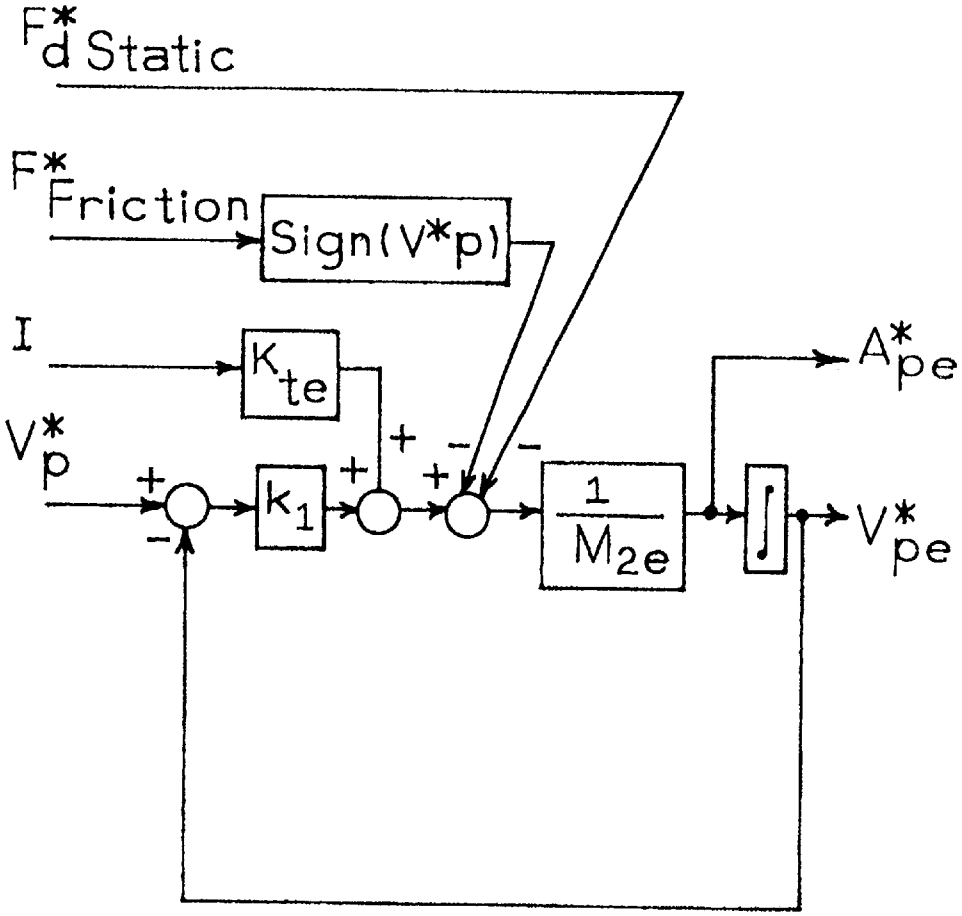
FIG. 4 is a control block diagram for an observer computing a set point for the desired translational acceleration of the dancer roll.

Another system for indirectly determining a set point for translational acceleration $A^*_p$ or target translational acceleration, is set forth in the observer of block diagram of FIG. 4.

The observer of FIG. 4, and observers shown in other FIGURES that follow, all model relationships between physical properties of elements of dancer system 20. In some embodiments, the observer merely comprises a computer program or subroutine stored in computer controller 70. In other embodiments, the respective observers can comprise discrete electronic circuitry separate from computer controller 70. The various observers disclosed herein all model various physical properties of the different elements of the various dancer systems.

In the observer of FIG. 4, an equation for a target set point for estimated acceleration $A^*_{pe}$ (Force applied divided by mass), is defined as follows:

$$A^*_{pe}=[k_1(V^*_p=V^*_{pe})+k_{te}I-F^*_{d\ static}-F^*_{friction}\mathrm{Sign}(V_p)]/M_{2e}$$

where, $k_1$=Observer gain

I=Actuator current $k_{te}$=Actuator torque constant estimate $M_{2e}$=Estimated physical mass of dancer roll 24

$A^*_{pe}$=Acceleration command estimate, target net acceleration (not a measured value)

$V^*_{pe}$=Translational velocity estimate or target for the dancer roll.

Therefore, estimated target acceleration $A^*_{pe}$ can be calculated from known parameters of the system using the above block diagram showing the observer of FIG. 4.

Likewise, a similar block diagram for the observer shown in FIG. 5 can utilize the following equation to estimate actual acceleration $A_{pe}$ as follows:

$$A_{pe}=[k_1(V_p=V_{pe})+k_{te}I-F^*_{d\ static}-F^*_{friction}\mathrm{Sign}(V_p)]/M_{2e}$$

where, $A_{pe}$=Estimate of actual translational acceleration of dancer roll (not a measured value), and $V_{pe}$=Estimate of actual translational velocity of dancer roll.

Figure 5:
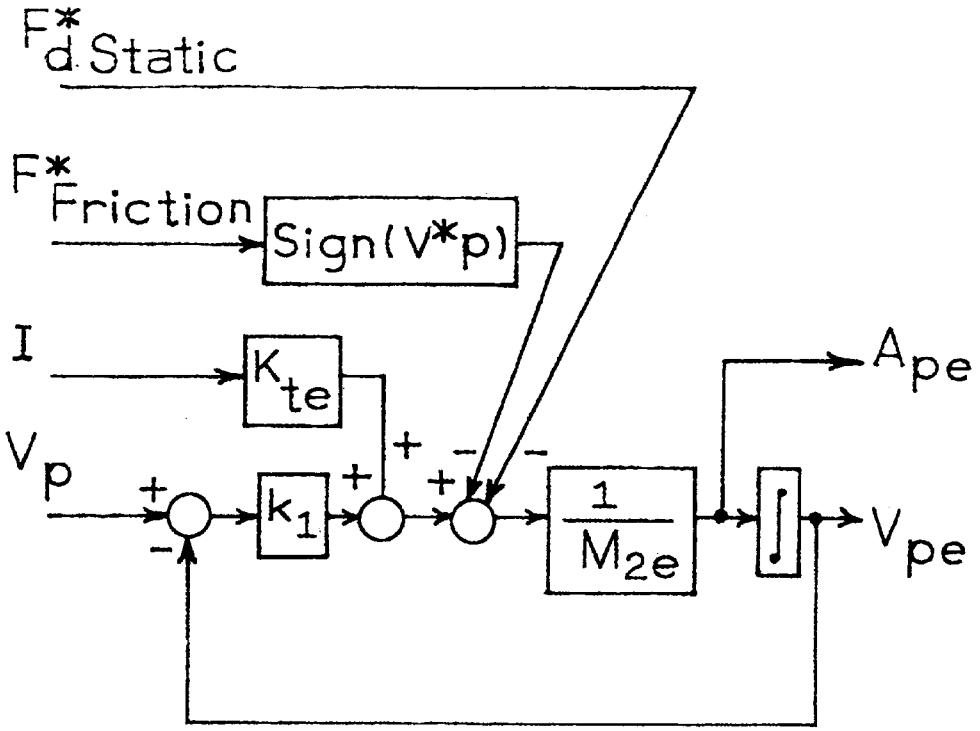
FIG. 5 is a control block diagram for an observer computing translational acceleration of the dancer roll from the dancer translational velocity command.

Therefore, estimated actual acceleration can quickly be computed from known parameters of the system using the observer of FIG. 5.

Of course, another way of determining actual translational acceleration of the dancer roll is utilizing the following equation:

$$A_{pe}=[V_p(\text{present})-V_p(\text{previous})]/\Delta T$$

where ΔT=the scan time for process system 10.

In this manner, average actual translational acceleration $A_{pe}$ also can be determined without direct measurement of acceleration.

Figure 6:
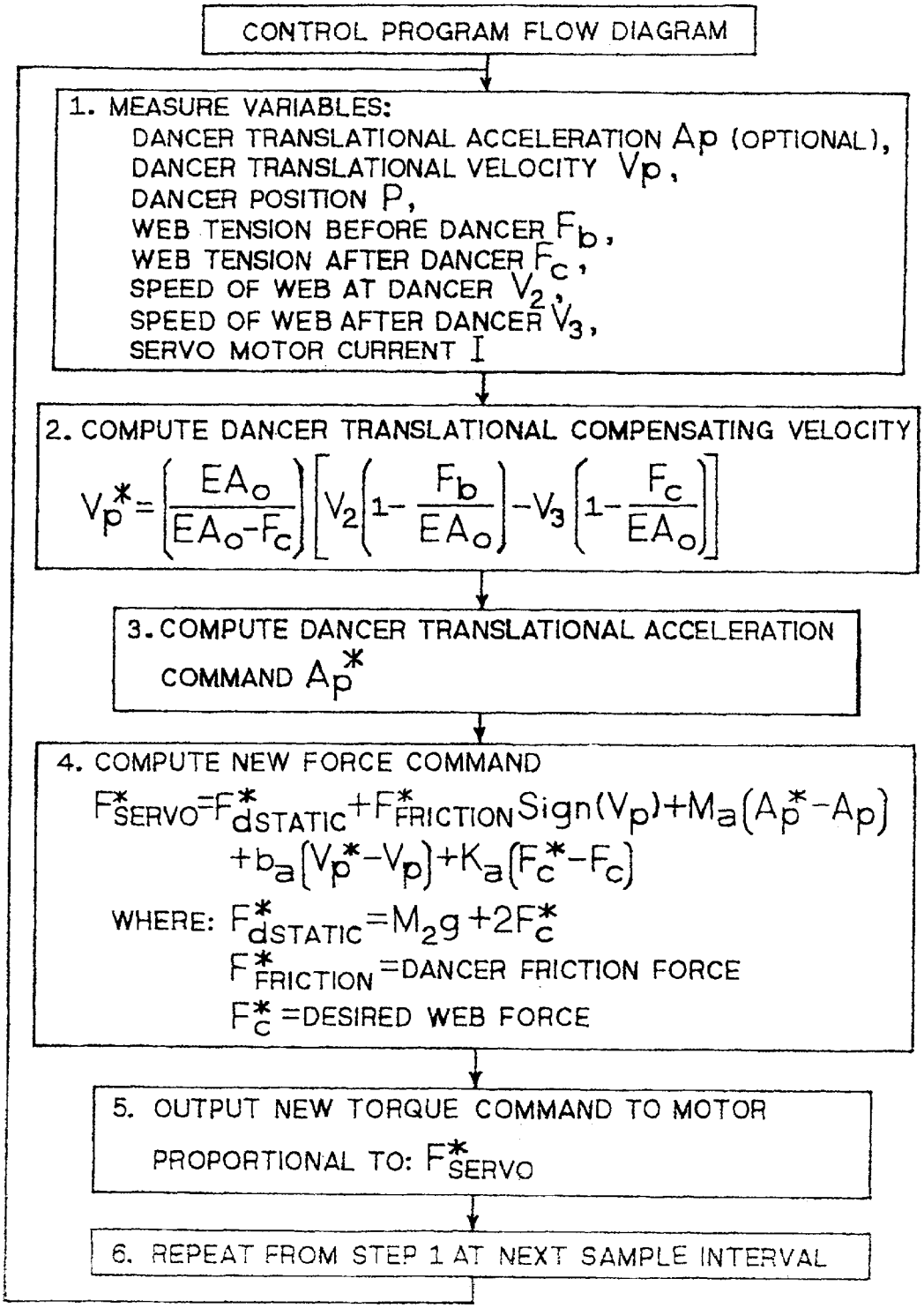
FIG. 6 is a program control flow diagram representing a control system for a first embodiment an active dancer system.
Figure 7:
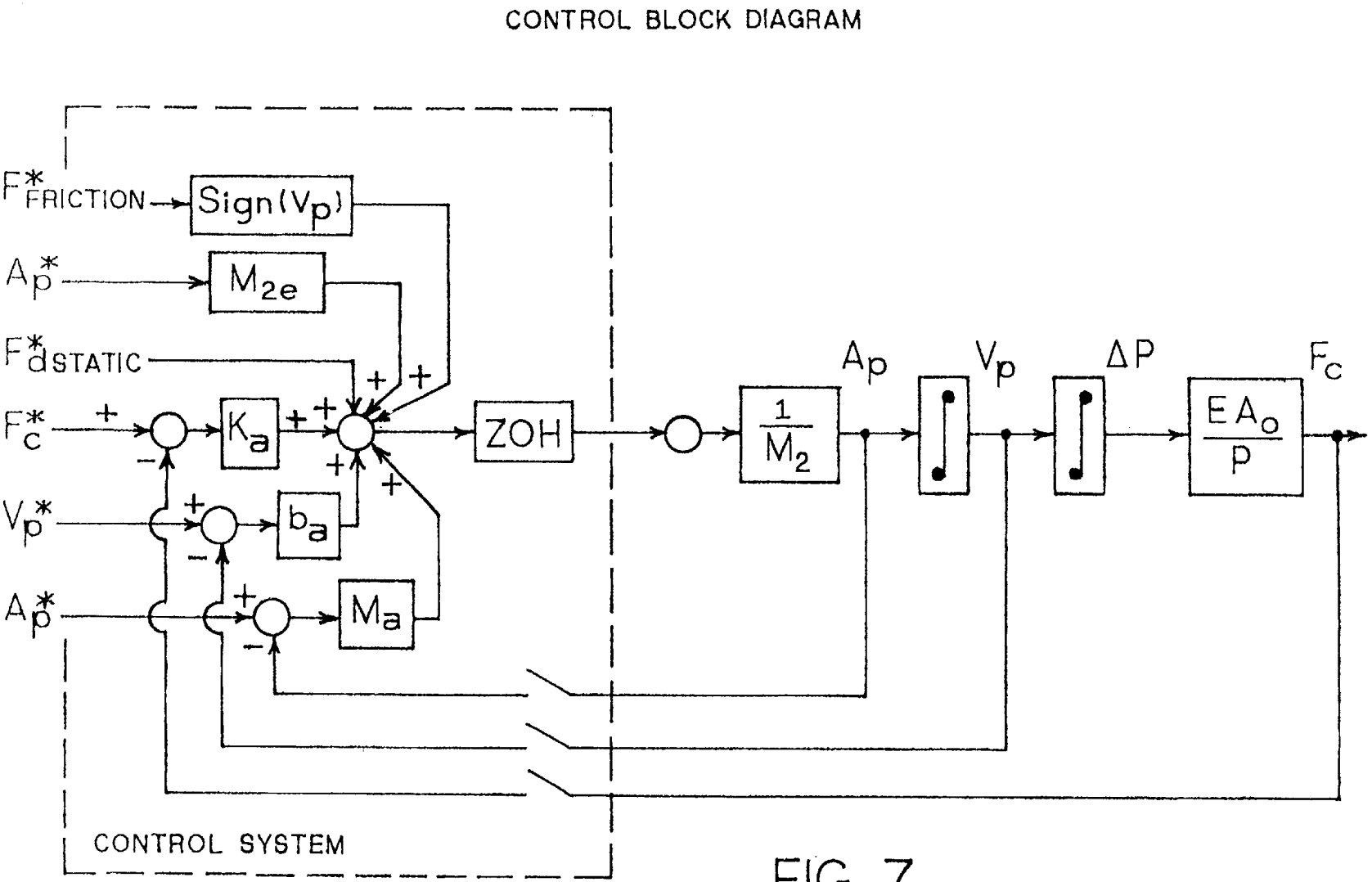
FIG. 7 is a control block diagram for the control flow diagram of FIG. 6.

The calculations set forth in FIGS. 4 and 5, when incorporated into the system set forth in the control program flow diagram and control block diagram of FIGS. 6 and 7, enable dancer system 20 to function effectively without direct measurement of acceleration $A_p$ (optional). Thus, in the embodiments shown, accelerometer 69 can be an optional element depending on the processing system, and computer program, being utilized.

The general flow of information and commands in a command sequence used in controlling the dancer system 20 is shown in the control program flow diagram of FIG. 6. In step 1 in the command sequence, the variable parameters $A_p$ (some embodiments), $V_p$, P, $F_b$, $F_c$, $V_2$, $V_3$, and I (some embodiments) are measured. Acceleration $A_p$ can also be estimated indirectly as $A_{pe}$, instead of being measured, as disclosed in the equations described earlier.

In step 2, the variables are combined with the known constants in computer controller 70, and the controller computes $V^*_p$, a set point for the desired or target translational velocity of dancer roll 24.

In step 3, $V^*_p$ can be combined with $V_p$ and divided by scan time ΔT to compute a value for $A^*_{pe}$. In another embodiment, as shown in FIG. 4, the observer can utilize motor current I, set point $V^*_p$, and the other variables or constants shown to estimate the target translational acceleration as described earlier.

In step 4, a new command $F^*_{servo}$ is computed using the computed variables and constants $F^*_{d\ static}$, $F^*_{friction}$, $F_c$, $F^*_c$, $b_a$, $k_a$, $V_p$, $\mathrm{Sign}(V_p)$, $A_p$, $A^*_p$, $V^*_p$, and $M_a$.

In step 5, the new force command $F^*_{servo}$ is combined with a servo constant "r" (radius) to arrive at the proportional torque command $T^*_{dancer}$ output from actuator 56 to dancer roll 24 through drive chain 48 and drive cable 28.

In step 6. the sequence is repeated as often as necessary, preferably at predetermined desired sample intervals (scan time ΔT or computation frequency) for the system to obtain a response that controls the tension disturbances extant in web 18 under the dynamic conditions to which the web is exposed.

In a first embodiment of a method of using the invention, a primary objective of dancer system 20 is to attenuate tension disturbances in web 18. Such tension disturbances might come, for example from unintended, but nonetheless normal, vibrations emanating from equipment downstream of dancer roll 24. Bearing vibration, motor vibration, and other similar occurrences are examples of sources of vibration that may affect the system. In the alternative, such tension disturbances can also be intentionally imposed on web 18 as the web is processed. An example of such intentional tension disturbances is shown in U.S. Pat. No. 4,227,952 to Sabee, herein incorporated by reference to show a tension disturbance being created with the formation of each tuck or pleat in the web of material being processed.

Whether the tension disturbances are imposed intentionally or unintentionally. the effect on web 18 is generally the same. As web 18 traverses processing system 10, the web is exposed to an average dynamic tension, representing a normal range of tensions as measured over a span of the web, for example between roll 16 of raw material and the next nip 72 downstream of dancer system 20.

Tension and other conditions should be sensed at a scan time of at least 1 time per second, preferably at least 5 times per second, more preferably at least 500 times per second, and most preferably at least 1000 times per second. Likewise, computer controller 70 preferably recomputes the net force $F_{servo}$ applied to dancer roll 24 at least 1 time per second, preferably at least 5 times per second, more preferably at least 500 times per second, and most preferably at least 1000 times per second. Faster scan times and computation rates improve the web tension control of dancer system 20 and the overall operating characteristics of process system 10.

Since, as discussed above, the first step in the control cycle is sensing/measuring the several variables used in computing the variable force component of the response, it is critical that the sensors measure the variables frequently enough, to detect any tension disturbance that should be controlled early enough, to respond to and suppress the tension disturbance. Thus having a short scan time (large frequency) is important to the overall operation of process system 10.

In order to have proper control of dancer system 20, it is important that the computed responses be applied to dancer roll 24 frequently enough to control the dancer system. Thus, at least 5 responses during the period of any tension disturbance is preferred. In order to provide sufficient frequency in the response application, especially where there is a variation in the frequency of occurrence of tension disturbances, it is preferred to measure the variables and apply a response at a multiple of the anticipated disturbance frequency.

Overall, the most critical frequency is the frequency at which steps 1 through 6 are executed in the Flow Diagram of FIG. 6.

Dancer system 20 of this invention can advantageously be used with any dancer roll, at any location in the processing line. If there are no abrupt disturbances in web 18, dancer roll 24 will operate like a conventional dancer roll. Then, when abrupt disturbances occur, control system 20 automatically responds, to attenuate resulting tension disturbances.

Referring to FIG. 7 showing the control block diagram of the first embodiment, the dashed outline, represents calculations that occur inside computer controller 70, with the resultant force output $F^*_{servo}$ being the output applied to actuator 56 via Zero Order Hold (ZOH). FIG. 7 illustrates the relationship between dancer roll acceleration $A_p$, dancer roll velocity $V_p$, change in position ΔP, and web tension $F_c$ downstream of dancer roll 24. Integration symbols in boxes merely illustrate the relationship between the various sensed elements.

In some embodiments, the integration symbols, contained in a block, such as in FIG. 7, illustrate a physical integration. The integration block in FIG. 7, as well as in other FIGURES, can comprise an operational amplifier or other separate physical circuit, as well as a computer software routine in computer controller 70 that integrates the value input. Operation of the control block diagram of FIG. 7 generally corresponds to the above described relationship in the control program flow diagram of FIG. 6 and the observers of FIGS. 4 and 5.

Zero order hold (ZOH), found in all of the embodiments, comprises a latch that stores and then outputs as appropriate, the computed value for $F^*_{servo}$. Other elements having an equivalent function can be substituted for the zero order hold element.

RELATIONSHIP OF ACTIVE MASS GAIN AND ACTUAL SYSTEM MASS

The relationship between active mass gain and actual mass gain assists the system in providing inertia compensation to process system 10.

Using block diagram algebra and neglecting the zero order hold dynamics, the closed loop system equation for the acceleration loop is:

$$A_p/A^*_p=M_a/(M_2+M_a)$$

From the above equation, the effective system mass for dancer system 20 is $M_e=M_2+M_a$.

Inertia compensation for dancer system 20 can be obtained by adjusting $M_a$ such that:

$$M_a=[J_2/(R_2)^2]-M_2$$

Where:

$J_2$=Polar inertia of dancer roll $R_2$=Outer radius of dancer roll $M_2$=System mass.

Solving the above equation for inertia compensation enables dancer system 20 to operate as an effective inertia compensated system. U.S. Pat. No. 3,659,767 to Martin, hereby incorporated by reference in its entirety, discloses a tension regulation apparatus using a flywheel to physically produce an apparatus having inertia compensation.

Using computer controller 70, the invention enables computer control and adjustment of $M_a$ such that dancer system 20 is inertially balanced without utilizing physical weights. Thus, the system disclosed herein, permits computer controller, using the above equations to adjust to changes in polar inertia, system mass, or other conditions, while maintaining dancer system 20 in an inertially compensated state.

Measuring all of the values set forth in box 1 of the control program flow diagram of FIG. 6 can be utilized to obtain extremely accurate results. However, in embodiments that follow, fewer conditions need to be sensed, and reasonably similar results are obtained. Thus, other embodiments have the advantage of fewer sensors that may fail and disable or skew the output results of computer controller 70. Therefore, all of the embodiments have unique advantages depending on the conditions required to be sensed.

Throughout the specification, the subscript notation "$_e$" is utilized to indicate when a value is estimated, or computed in such a manner that an exact, precise value generally is not received. For example, acceleration values "$A_{pe}$" and "$A_p$" can be considered interchangeable in use. In some embodiments, the value can be measured directly, such as by accelerometer sensor 69, and in other embodiments, the value can be estimated. For purposes of explanation, every occurrence of "$V_{pe}$" in the claims, can be considered to include "$V_p$" and vice versa, where no statement to the contrary is set forth therein. The interchangeability of actual and estimated values is not limited to the example of translational velocity listed above.

SECOND EMBODIMENT

Figure 8:
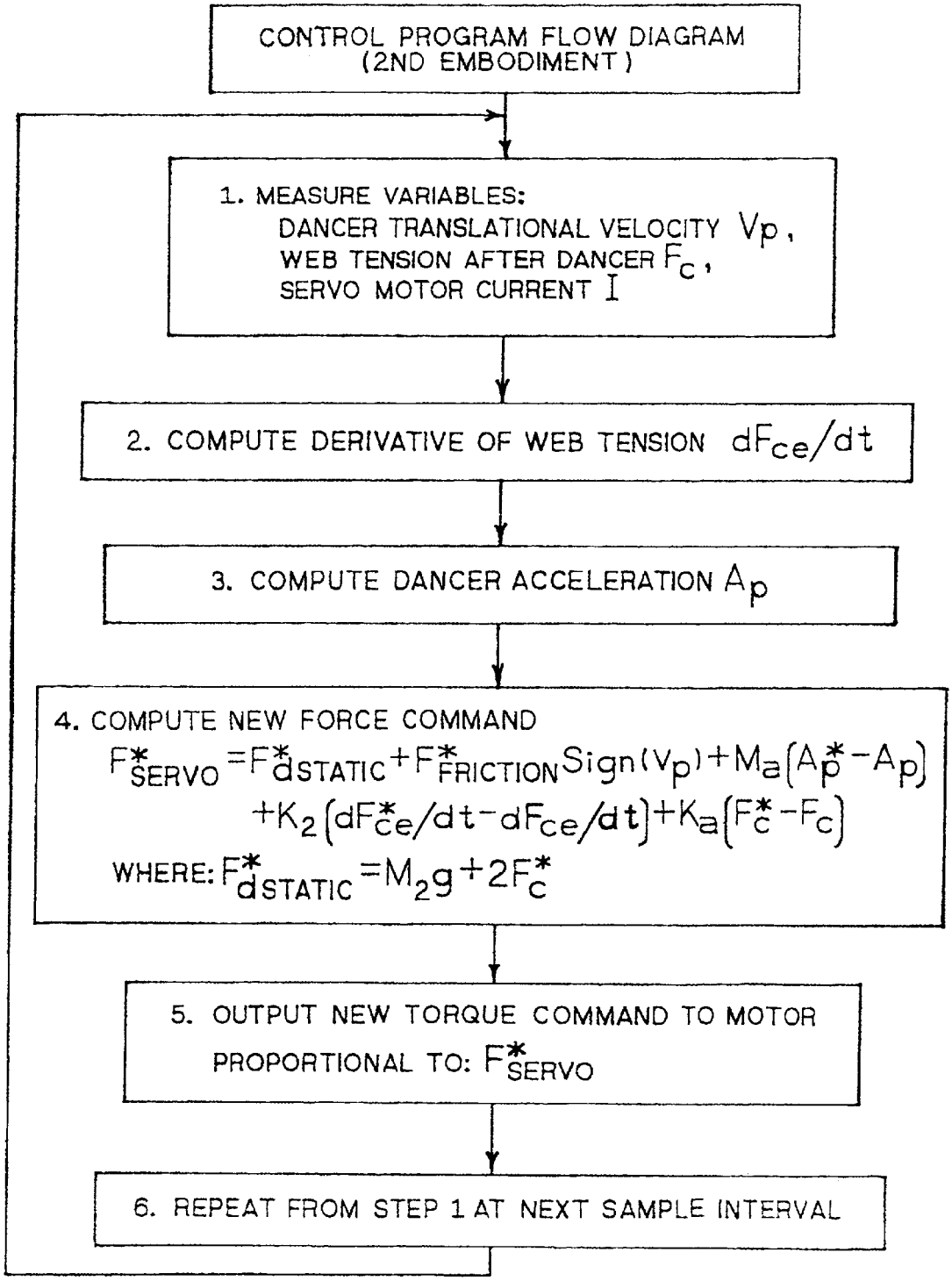
FIG. 8 is a control program flow diagram for a second embodiment of an active dancer system.

FIG. 8 shows a control program flow diagram for a second embodiment of the invention. In this embodiment, in step 1, the sensed variables are dancer translational velocity $V_p$, web tension $F_c$ after dancer roll 24, and actuator or servo motor current I are measured.

In step 2, the web tension derivative $dF_{ce}/dt$ is computed. In one method the average force derivative is estimated using the equation:

$$dF_{ce}/dt=[F_c(\text{present})-F_c(\text{previous})]/\Delta T$$

where $\Delta T$=scan time, $F_c$=measured web tensions (most resent and previous scans), and $dF_{ce}/dt$=derivative of web tension.

Thus, the derivative of web tension is simply calculated from changes in web tension over the time interval or scan time of the system.

In step 3, estimated dancer acceleration $A_{pe}$ can be computed using translational velocity as described earlier. Likewise, motor current I can be utilized, in combination with the other sensed values of step 1, to compute dancer acceleration $A_{pe}$.

In step 4, a new actuator force command $F^*_{servo}$ is computed using the computed variable values and stored constants $F^*_{d\ static}$, $F^*_{friction}$, $dF_c/dt$, $dF^*_c/dt$, $F_c$, $F^*_c$, $k_a$, $V_p$, Sign($V_p$), $A_p$, $A^*_p$, $b_a$, and $M_a$, respectively.

In step 5, the new force command $F^*_{servo}$ is combined with a servo constant "r" (radius) to arrive at the proportional torque command $T^*_{dancer}$ outputted from actuator 56 to dancer roll 24 through drive chain 48 and drive cable 28.

In step 6, the sequence is repeated as often as necessary, generally periodically, at desired sample intervals (scan time $\Delta T$ or computation frequency) that enable dancer system 20 to obtain a response that controls the tension disturbances extant in web 18 under the dynamic conditions to which the web is exposed.

Figure 9:
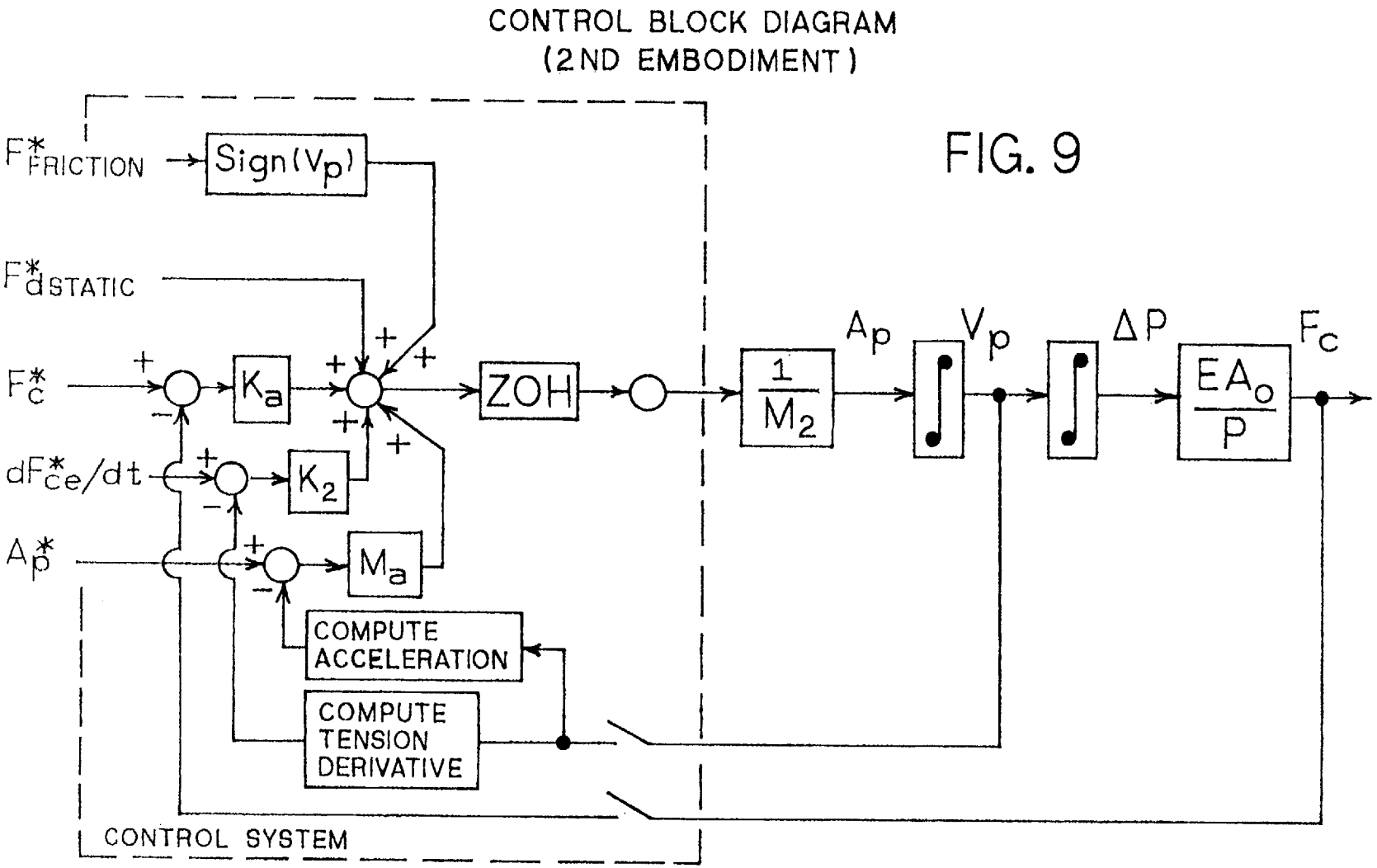
FIG. 9 is a control system block diagram for the control flow diagram of FIG. 8.

The second embodiment enables computer controller 70 to operate dancer system 20 in an active mode with better results than passive systems or dancer systems not accounting for acceleration properties. For ease of understanding, FIG. 9 shows a control block diagram illustrating the control program flow diagram of FIG. 8.

Figure 10:
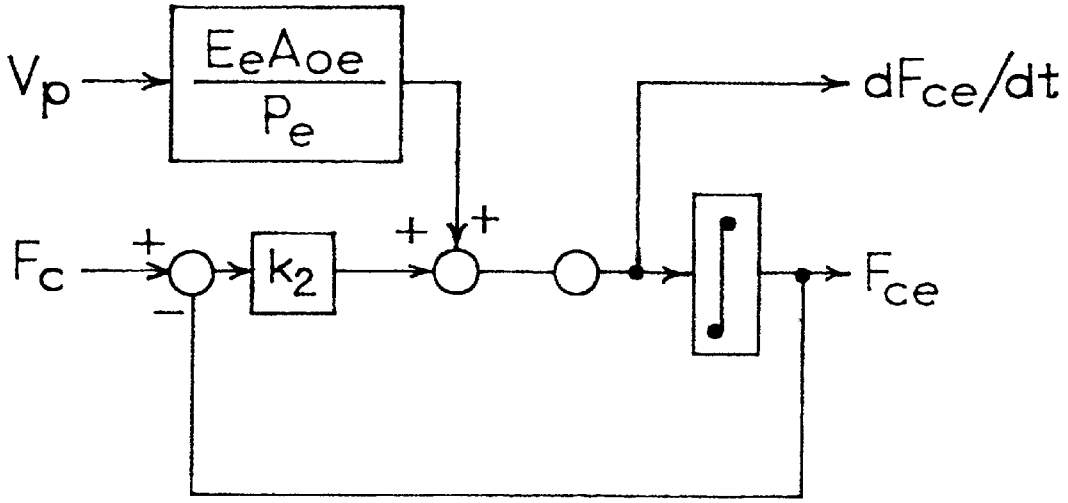
FIG. 10 is a control block diagram for an observer computing the derivative of web tension for the embodiment of FIGS. 8–9.

FIG. 10 illustrates an observer for estimating the derivative of web tension. Such an observer can comprise a separate electronic circuit performing calculations, or a subroutine in computer controller 70. The observer of FIG. 10 comprises a control block diagram showing physical results of the observer. The integration block in FIG. 10 can comprise an operational amplifier or computer software routine that integrates the derivative of force estimate and outputs an estimated web tension value. Thus the observer illustrated in FIG. 10 can be utilized to compute the derivative of web tension set forth in step 2.

In the observer of FIG. 10, the derivative of web tension is computed using the closed loop equation:

$$dF_{ce}/dt=k_2(F_c-F_{ce})+V_p(E_eA_{oe}/P_e)$$

where:

$k_2$=observer gain, $F_c$=web tension force, $F_{ce}$=estimated web tension force, $V_p$=translational velocity of the dancer roll $E_e$=estimate of elastic modulus of the web, $A_{oe}$=estimate of the cross-sectional area of the web, and $P_e$=estimate of the position of the dancer roll.

The observer of FIG. 10 models the physical properties of dancer system 20 and assists in accurate control of web 18.

THIRD EMBODIMENT

Figure 11:
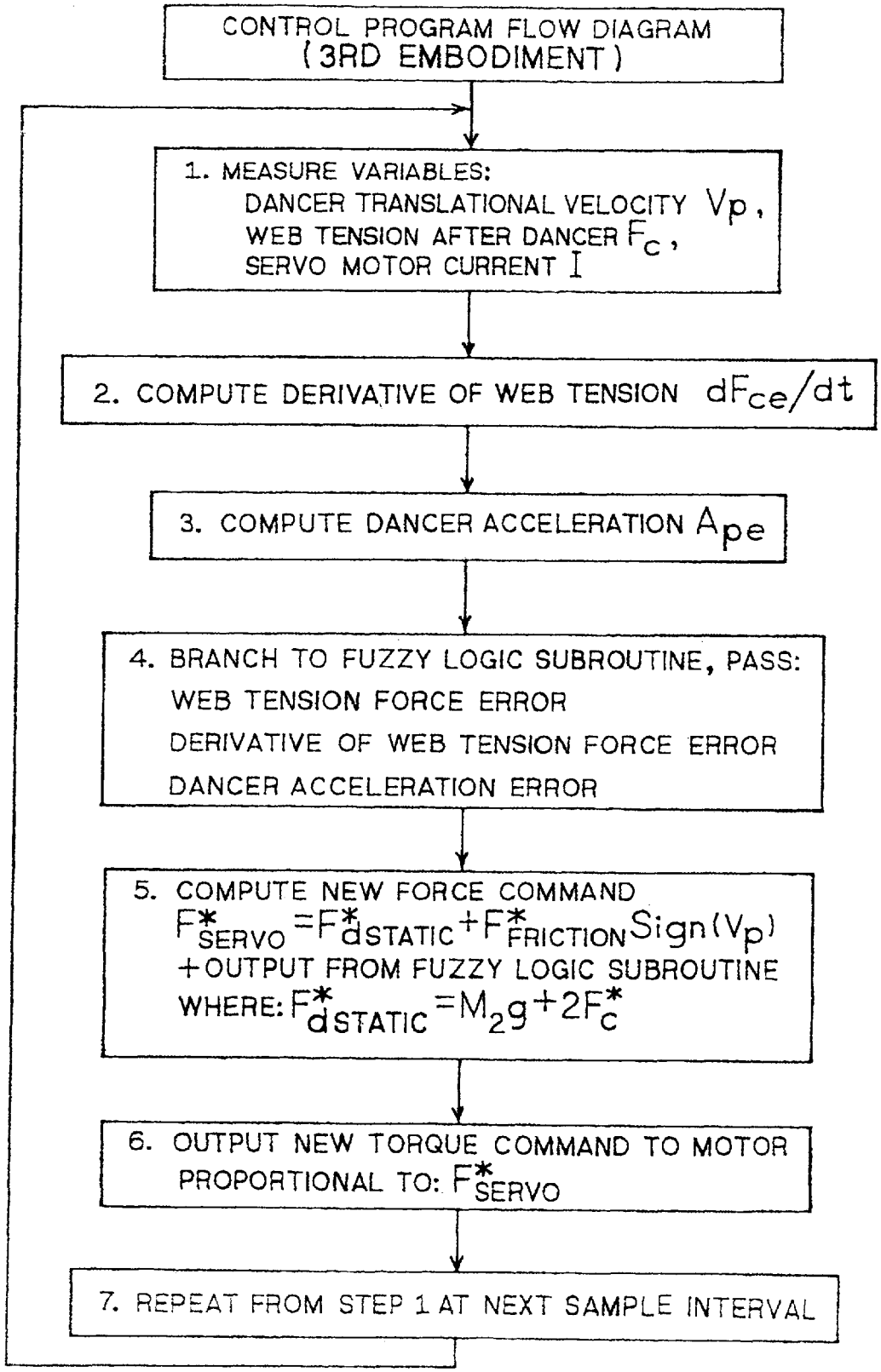
FIG. 11 is a control program flow diagram for a third embodiment of an active 25 dancer system.

FIG. 11 shows a control program flow diagram for a third embodiment of the invention. In this embodiment, in step 1, the variables of dancer translational velocity $V_p$, web tension $F_c$ after dancer roll 24, and actuator or servo motor current I are measured.

In step 2, the web tension derivative $dF_{ce}/dt$ is computed. In one method the average force derivative is estimated using the equation set forth earlier in the second embodiment. Of course, the derivative of web tension can also be estimated using the observer set forth earlier in FIG. 10 of the second embodiment.

In step 3, estimated dancer acceleration $A_{pe}$ can be computed using translational velocity, as described earlier. In another method for step 3, actuator current I can be utilized, in combination with the other sensed values of step 1, to compute dancer translational acceleration $A_{pe}$. Of course, in some embodiments, accelerometer 69 can be utilized to measure translational acceleration directly. Even though additional element 74, shown in FIG. 12, computes force derivative, such an additional element can be equivalent to the observer described earlier. Likewise additional element 76, shown in FIG. 12, for computing acceleration, can comprise the observer described earlier or other means for calculating or estimating acceleration.

Figure 12:
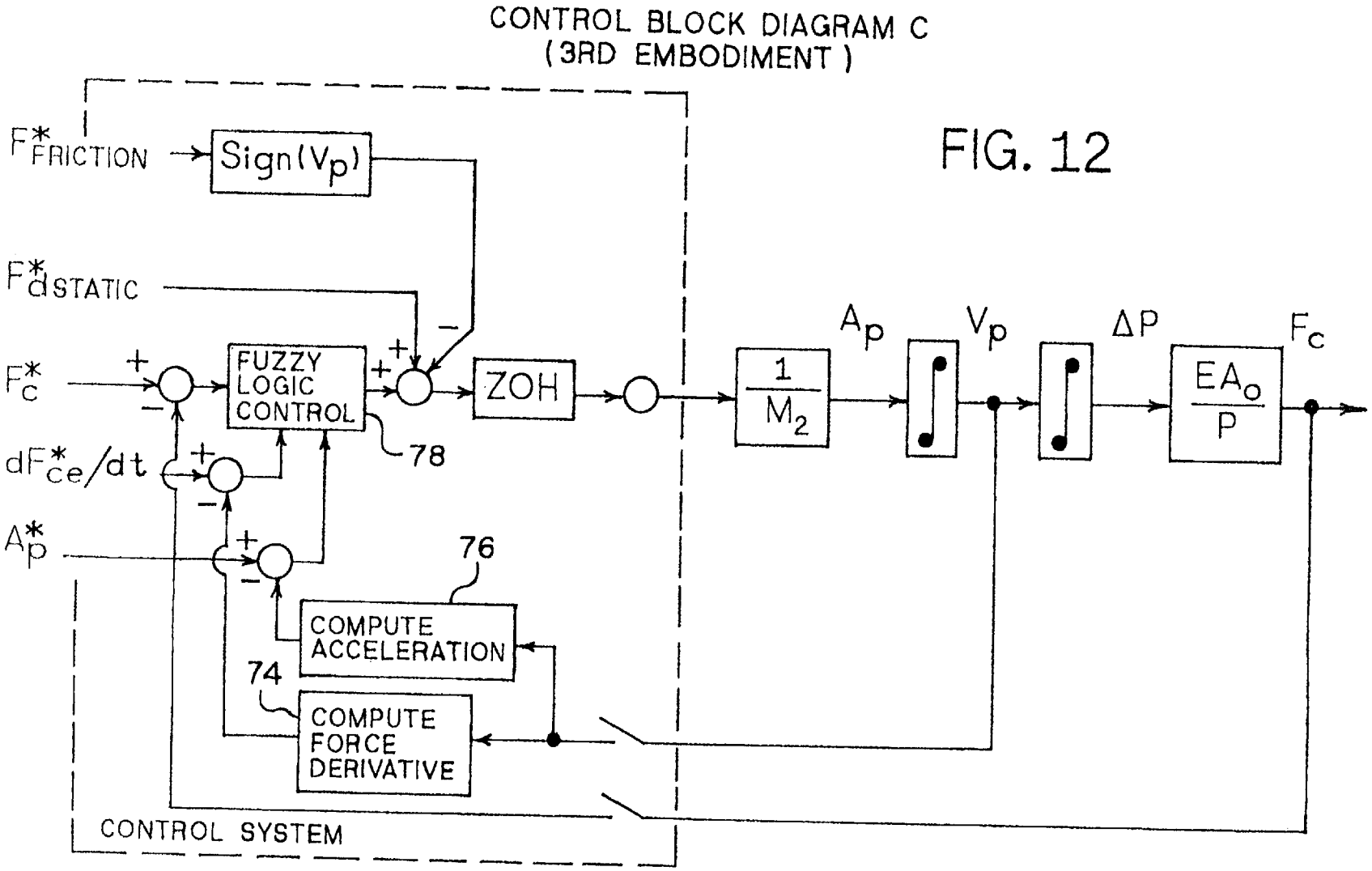
FIG. 12 is a control system block diagram for the control flow diagram of FIG. 11.
Figure 13:
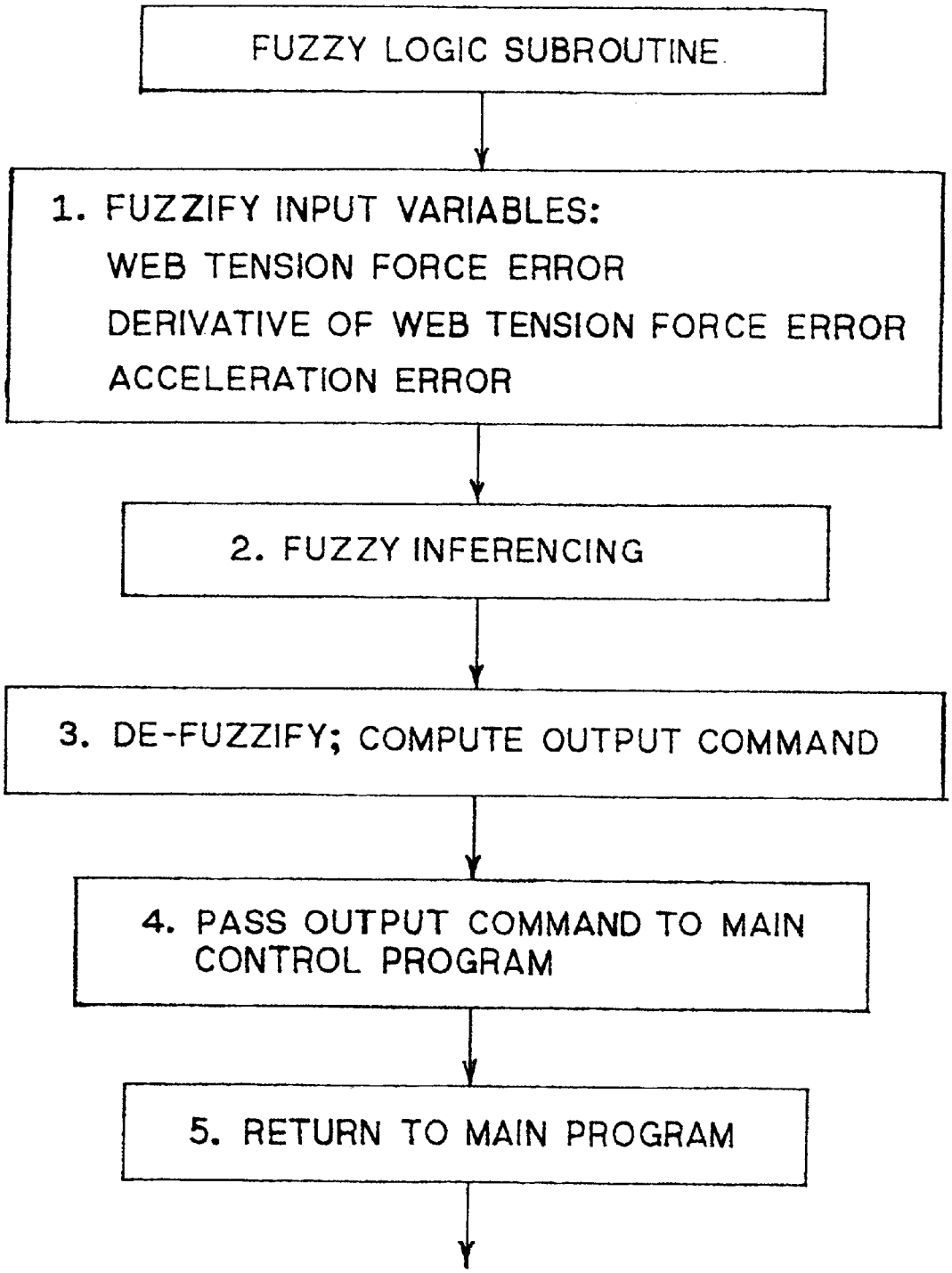
FIG. 13 is a fuzzy logic subroutine for use in the control program flow diagram of FIG. 11.

In step 4, web tension force error, derivative of web tension force error, and dancer acceleration error, as shown in the control block diagram of FIG. 12 enter fuzzy logic control 78. Fuzzy logic control 78 operates the fuzzy logic subroutine shown in FIG. 13.

The fuzzy logic subroutine preferably comprises a computer software program stored in computer controller 70 and executed at the appropriate time with the appropriate error values in step 4 of FIG. 11. As shown in step 1 of FIG. 13, the three variables are input into the fuzzy logic subroutine. Fuzzy inferencing occurs in subroutine step 2. In subroutine step 3, the output is de-fuzzified, and an output command is computed in response to the three input signals. In subroutine step 4, the output command of the fuzzy logic subroutine is sent to the main control program. In subroutine step 5, the subroutine returns to the main program.

Suitable subroutines are generally well known in the signal processing art. Fuzzy logic subroutines are available from Inform Software Corporation of Oak Brook, Ill. and other corporations. Fuzzy logic control circuits are generally known in the electrical art and explained in detail in the textbook "Fuzzy Logic and NeuroFuzzy Applications Explained" by Constantin von Altrock, published by Prentice Hall. However, to applicants' knowledge, this application contains the only known disclosure of fuzzy logic in a dancer system.

In step 5 of the main control program flow diagram of FIG. 11, the output from the fuzzy logic subroutine is used to compute a target force command $F^*_{servo}$ for actuator 56.

In step 6, a torque command proportional to $F^*_{servo}$ is sent to actuator 56 to power dancer roll 24. In step 7, the control program flow diagram of FIG. 11 is repeated and once again the fuzzy logic subroutine executes to generate an output command.

The novel use of fuzzy logic in a dancer system 20, provides superior results and performance when compared to other dancer systems sensing the same variables. Therefore, the fuzzy logic subroutine provides advantages previously unknown and unrecognized in the dancer roll control systems art.

FOURTH EMBODIMENT

Figure 14:
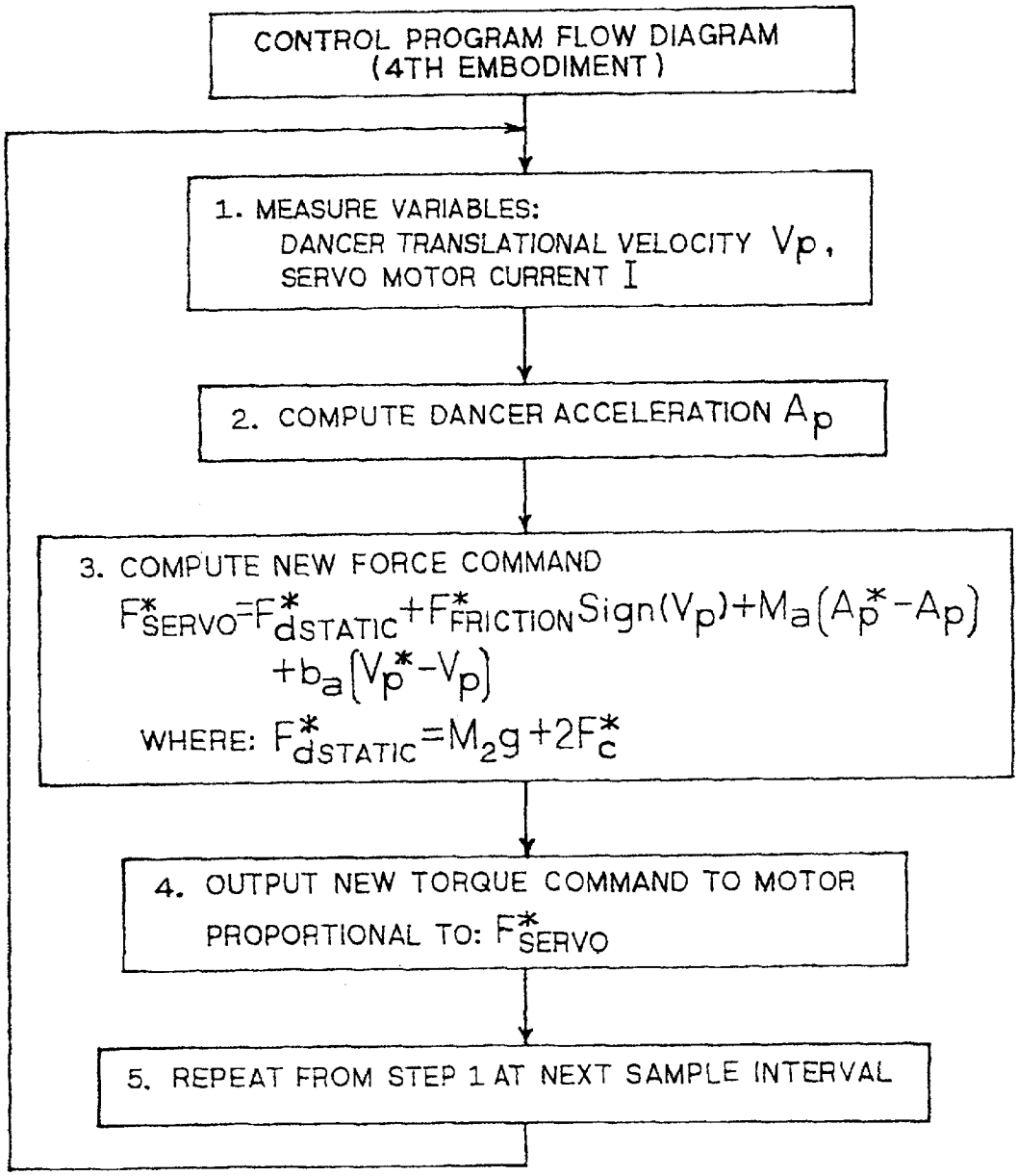
FIG. 14 is a control program flow diagram for a fourth embodiment of an active dancer system.

FIG. 14 shows a control flow program for a fourth embodiment of the invention. In this embodiment, in step 1, the only variables measured or sensed are dancer translational velocity $V_p$ and actuator or servo motor current I.

In step 2, dancer acceleration $A_{pe}$ can be computed or estimated by an observer using the equation described earlier:

$$A_{pe}=[k_1(V_p-V_{pe})+k_{te}I-F^*_{d\ static}-F^*_{friction}Sign(V_p)]/M_{2e}.$$

Thus estimated dancer acceleration is computed by an observer, as described earlier, using only dancer translational velocity $V_p$ and servo motor current I as measured inputs. All of the other elements are constants or values computed from translational velocity $V_p$.

In step 3, a new force command $F^*_{servo}$ is estimated using the equation shown therein. In step 4 a new output torque command proportional to $F^*_{servo}$ is output to actuator 56 via zero order hold (ZOH). Actuator 56, in most embodiments, comprises a servo motor for receiving the servo motor control signal and controlling force applied to dancer roll 24.

Figure 15:
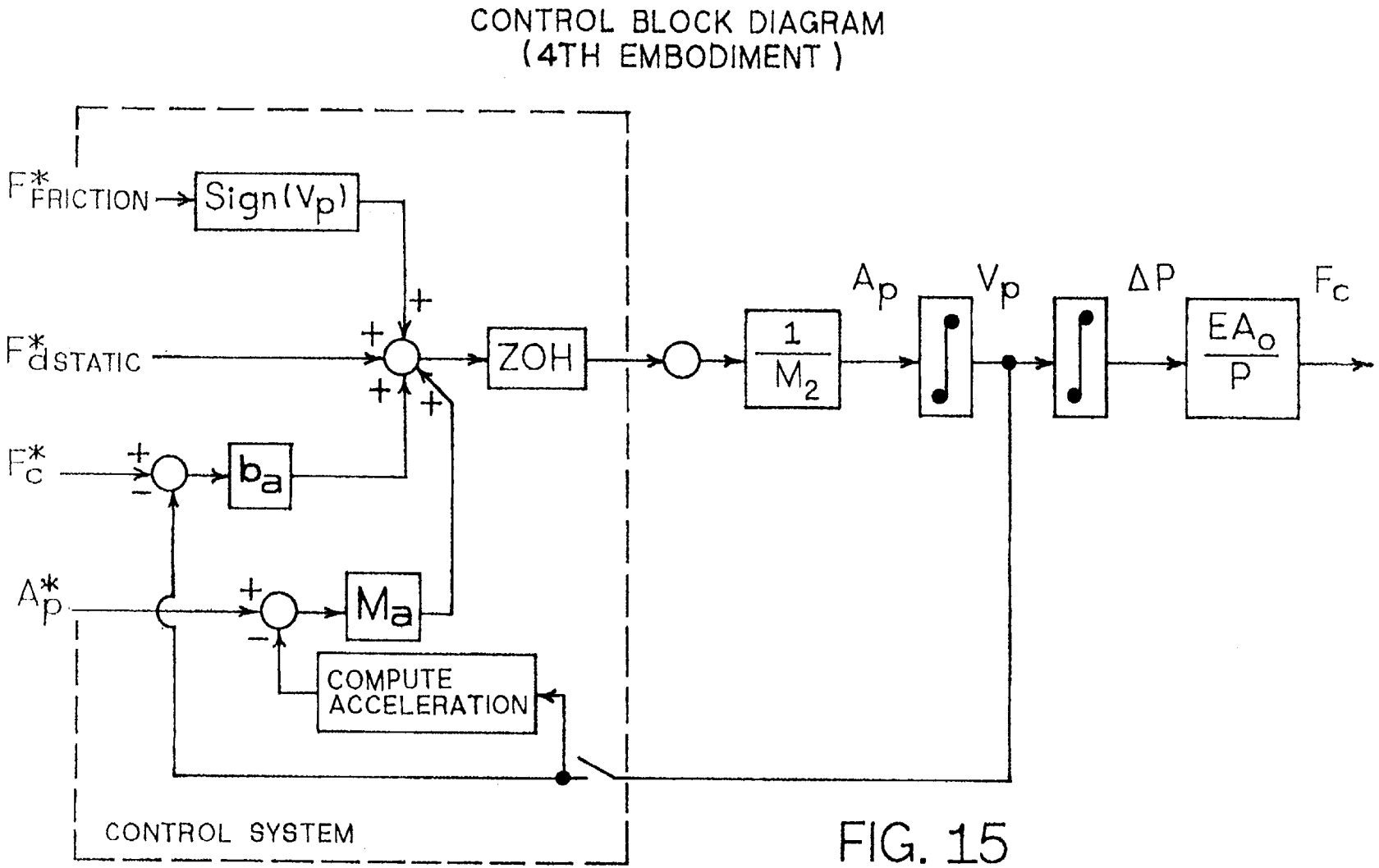
FIG. 15 is a control block diagram for the control flow diagram of FIG. 14.

Using the above values and $A^*_{pe}$, $V^*_{pe}$ computed from $A_{pe}$, $V_p$, and other constants or values shown in the control block diagram of FIG. 15, the embodiment of FIGS. 14 and 15 operates dancer system 20. Such a system actively compensates for coulomb and viscous friction, and also acceleration, to actively cancel the effects of mass. The result is virtually a pure web tensioning force free of dynamic effects from mass and drag. Dancer roll 20 still has polar inertia that is not compensated for, but the polar inertia can be minimized. For instance, the polar inertia can be minimized by decreasing the mass and/or radius of dancer roll 24.

FIFTH EMBODIMENT

The fifth embodiment of the invention comprises an embodiment that uses dancer translational position P to assist in generating force commands for actuator 56. As shown in step 1 of the control program flow diagram of FIG. 16, dancer translational position P, web tension $F_c$ after dancer roll 24, and actuator or servo motor current I. are measured or scanned periodically. The measured values are input into computer controller 70.

Figure 16:
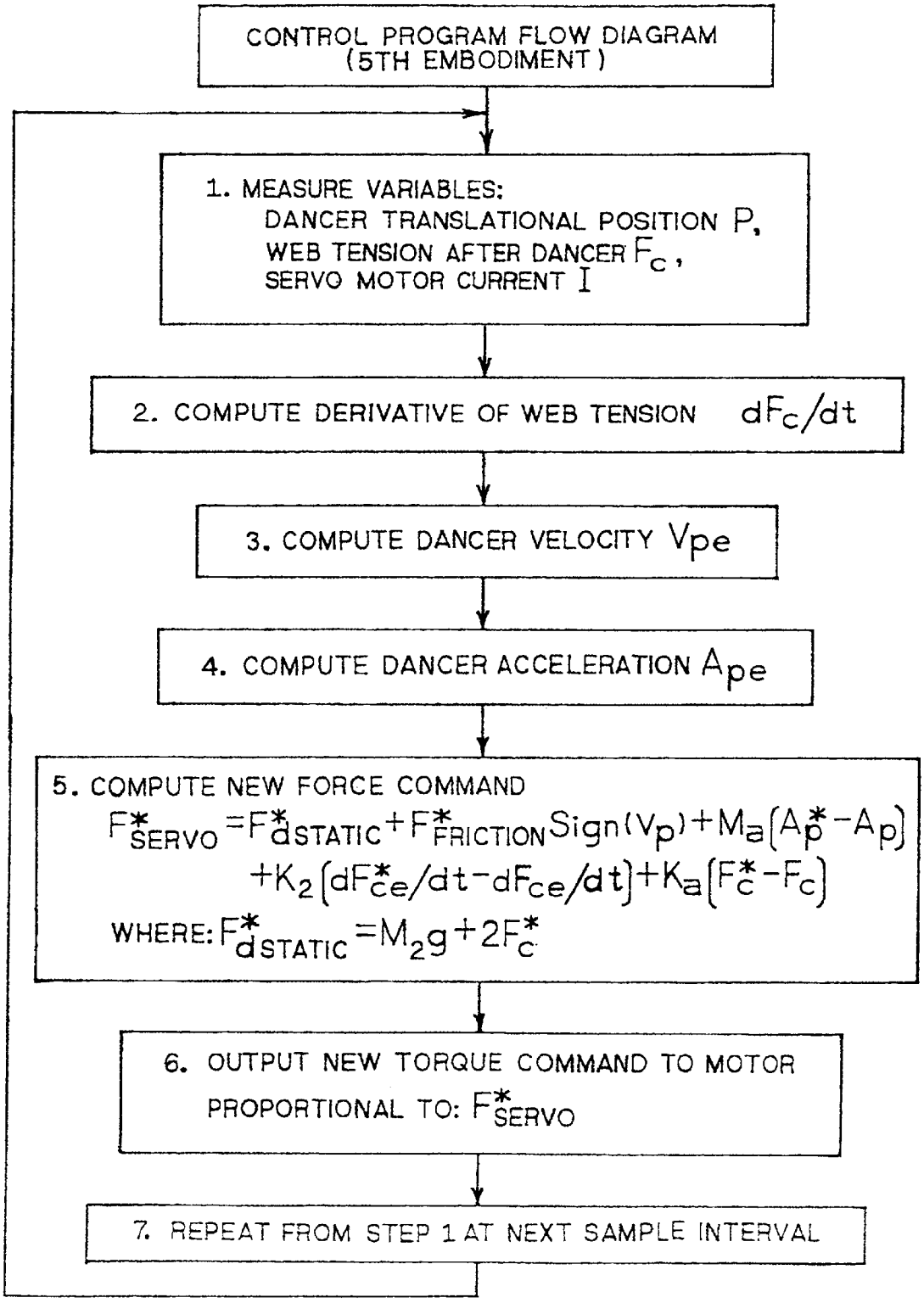
FIG. 16 is a control program flow diagram for a fifth embodiment of an active dancer system.

In step 2 of the diagram of FIG. 16, the measured values are then utilized to compute a derivative of web tension $dF_c/dt$. The derivative of web tension $dF_c/dt$ can be computed or estimated using the present and previous web tensions set forth earlier in the second embodiment.

In step 3, dancer velocity $V_p$ is computed. Such a computation can utilize the change in position P during the time period between scans of the position sensor. Dancer velocity $V_{pe}$ can also be computed using the observer shown in FIG. 17. The observer of FIG. 17 can be a separate physical circuit or can be a model of a computer program set forth in computer controller 70. The observer functions in a similar manner to earlier observers disclosed herein, except position error is multiplied by observer gain $k_3$. The other terms of the equation and relationships therefrom are known from earlier descriptions recited herein. Integration of the estimated translational acceleration $A_{pe}$, in step 4, computes an estimated translational velocity $V_{pe}$. Likewise, integrating the estimated translational velocity $V_{pe}$ generates an estimated translational position P.

In step 5, a force command for actuator 56 is computed using the equation listed therein and described earlier.

In step 6, a torque command is output to actuator 56 proportional to $F^*_{servo}$ In step 7, the above routine of steps is repeated again at a predetermined frequency or scan time.

For use in the force command equation in box 5 of FIG. 16, the value for $A^*_p$ can equal zero, or a value can be computed using an observer as disclosed herein.

Figure 18:
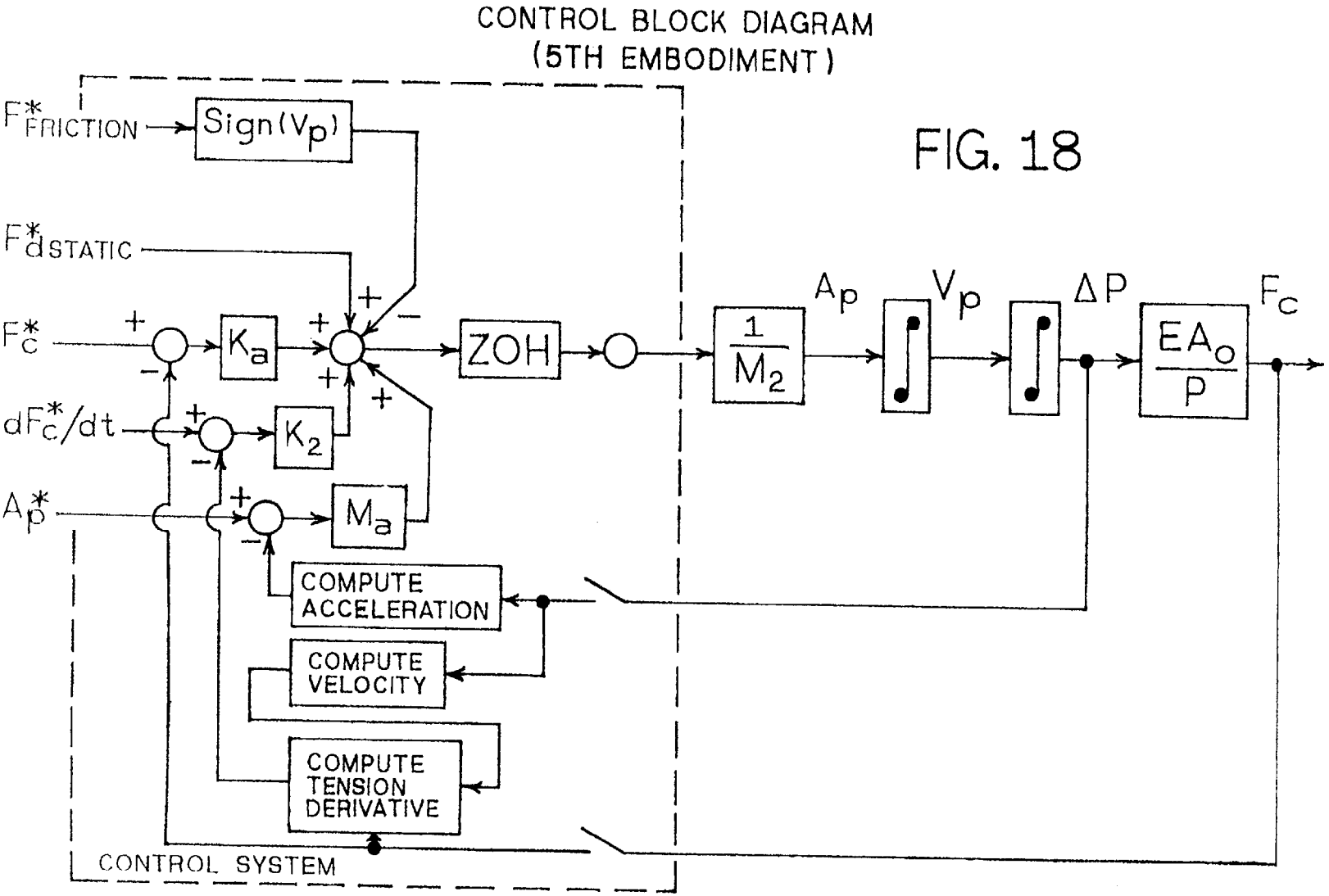
FIG. 18 is a control block diagram for the control program flow diagram of FIG. 16.

FIG. 18 shows a control block diagram corresponding to the control program flow diagram of FIG. 16. The control block diagram shows the operations of the control system and sensors. This fifth embodiment enables computer controller 70 to operate dancer system 20 in an active mode with better results than passive dancer systems or active dancer systems not accounting for acceleration properties.

SIXTH EMBODIMENT

Figure 19:
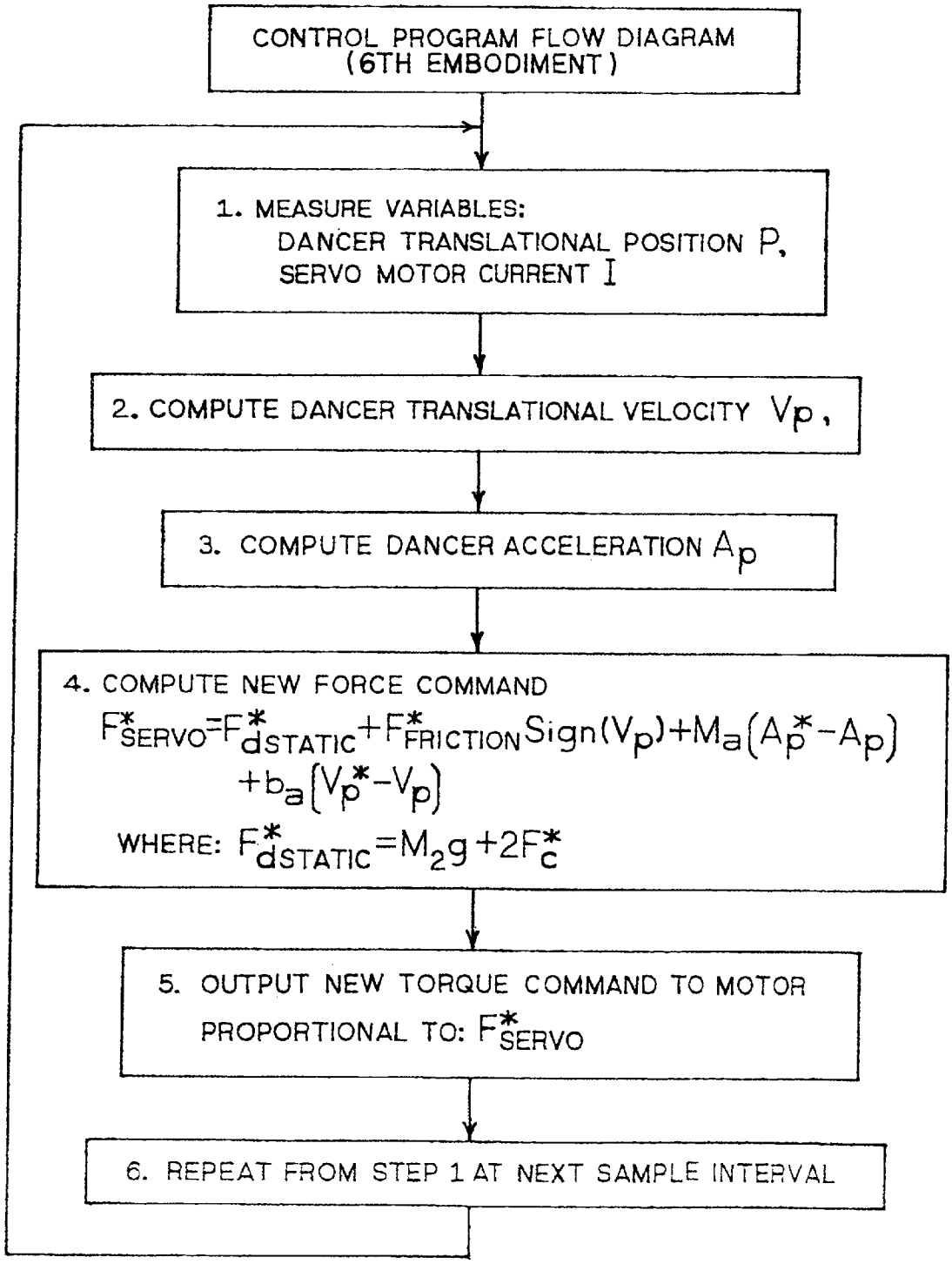
FIG. 19 is a control program flow diagram for a sixth embodiment of an active dancer system.
Figure 20:
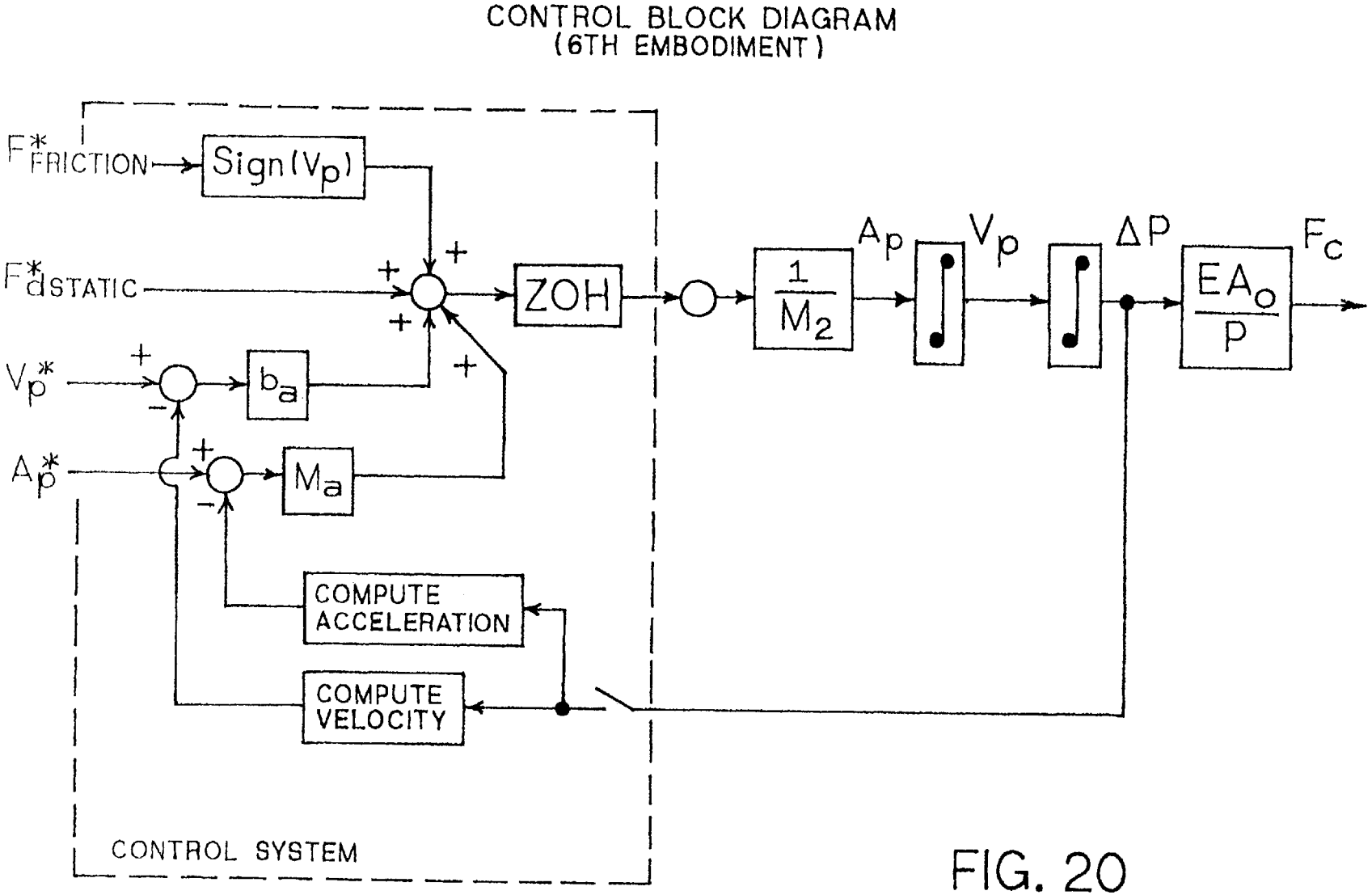
FIG. 20 is a control block diagram for the control program flow diagram of FIG. 19.

FIG. 19 shows Control Flow Program for a sixth embodiment of the invention. In this embodiment, in step 1, the variables measured or sensed are dancer translational position P and actuator or servo motor current I.

In step 2, dancer translational velocity $V_{pe}$ is computed or estimated using the equation described earlier or the equation:

$$V_{pe}=[P(\text{latest})-P(\text{previous})]/\Delta T$$

Figure 17:
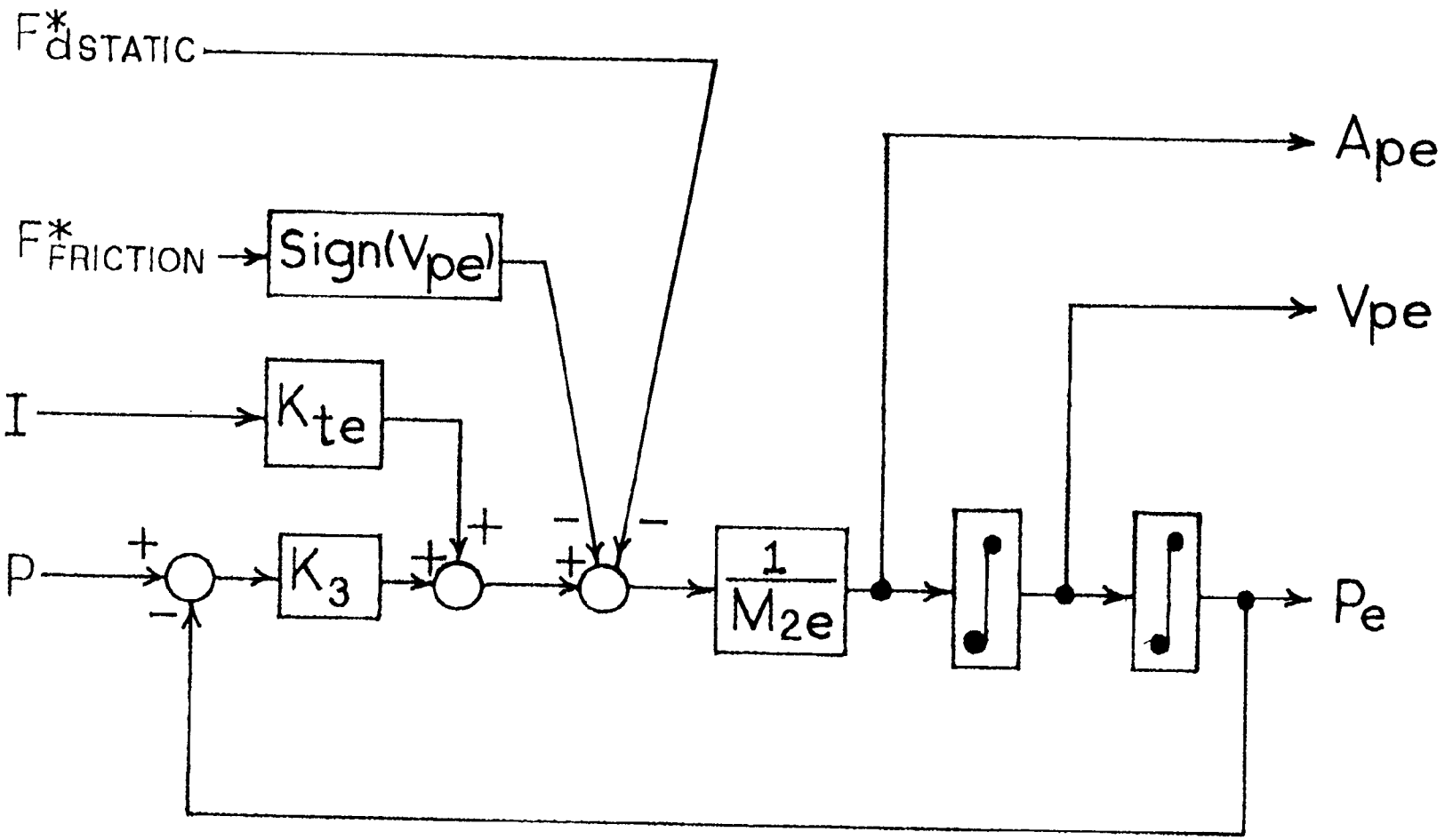
FIG. 17 is a control block diagram for an observer computing translational velocity and acceleration from a sensed position for the embodiment of FIG. 16.

Likewise a target set point for dancer translational velocity $V^*_{pe}$ can also be computed using an observer, as set forth earlier in FIG. 17, in response to actuator or servo motor current I and position P.

In step 3, dancer translational acceleration $A_p$ can be computed using previously computed values of $V^*_{pe}$ and $V_{pe}$ or other methods including an observer utilizing actuator or servo motor current I.

In step 4, a new target force command $F^*_{servo}$ is estimated using the equation shown therein. In step 5. a new torque command proportional to $F^*_{servo}$ is output to actuator 56 via zero order hold (ZOH). Actuator 56 receives the force signal and controls force applied to dancer roll 24. In step 6. the previous steps are repeated at the next sampling interval.

For use in the force command equation of step 4. the values for $A^*_p$ and $V^*_p$ can be computed by an observer as disclosed herein.

This embodiment has the advantage of requiring sensing of only actuator current I and dancer translational position P.

Thus this embodiment is simpler to operate and maintain than other embodiments having more sensors. Yet this embodiment uses velocity and acceleration to provide improved results over other active dancer systems 20.

SEVENTH EMBODIMENT

Figure 21:
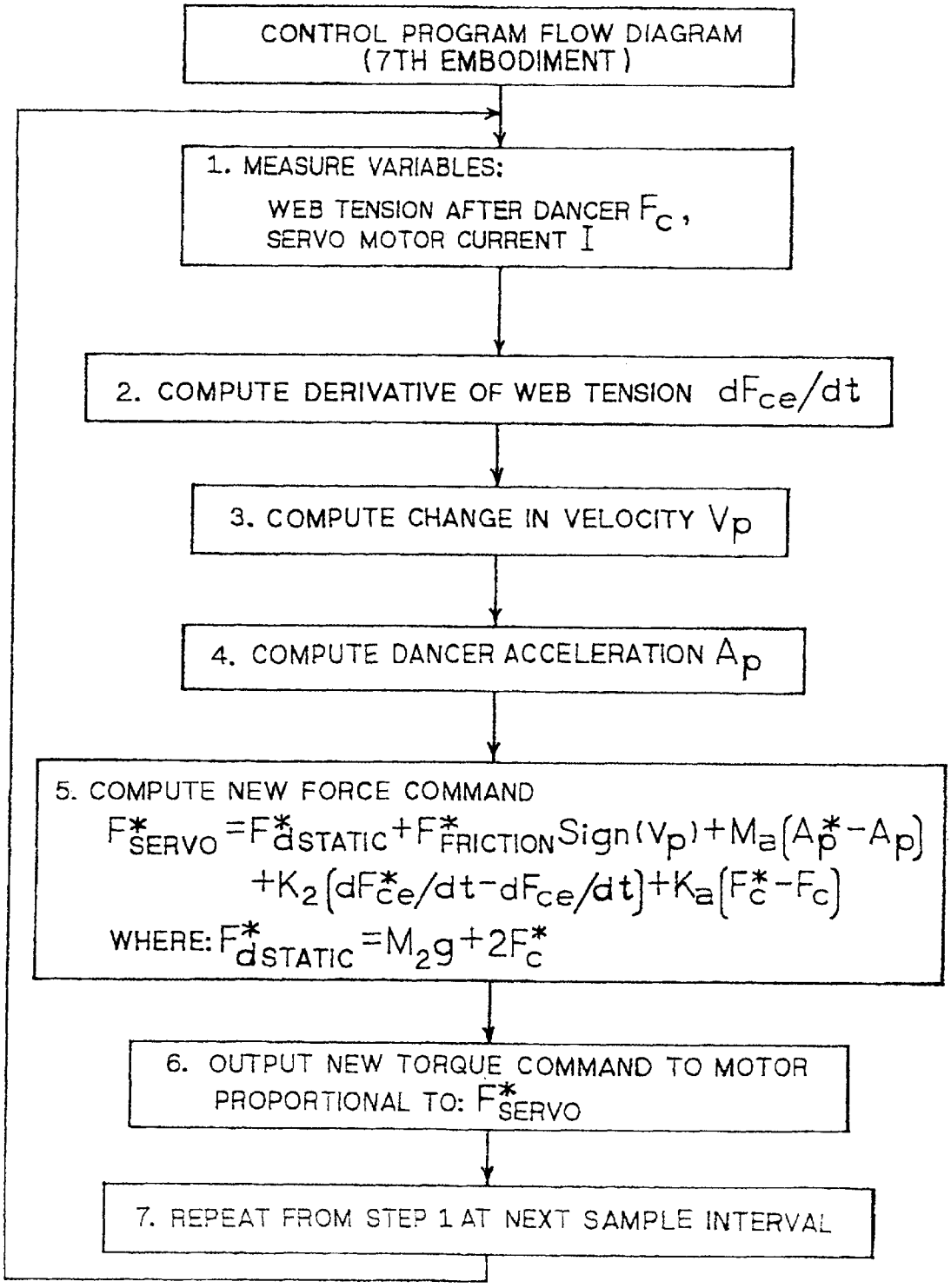
FIG. 21 is a control program flow diagram for a seventh embodiment of an active dancer system.

The seventh embodiment is illustrated in the control program flow diagram of FIG. 21. In this embodiment, the web tension $F_c$ and the actuator or servo motor current I are the only variables measured. This approach is attractive because the measured web tension is the variable that needs to be controlled and thus preferably should be sensed.

Figure 22:
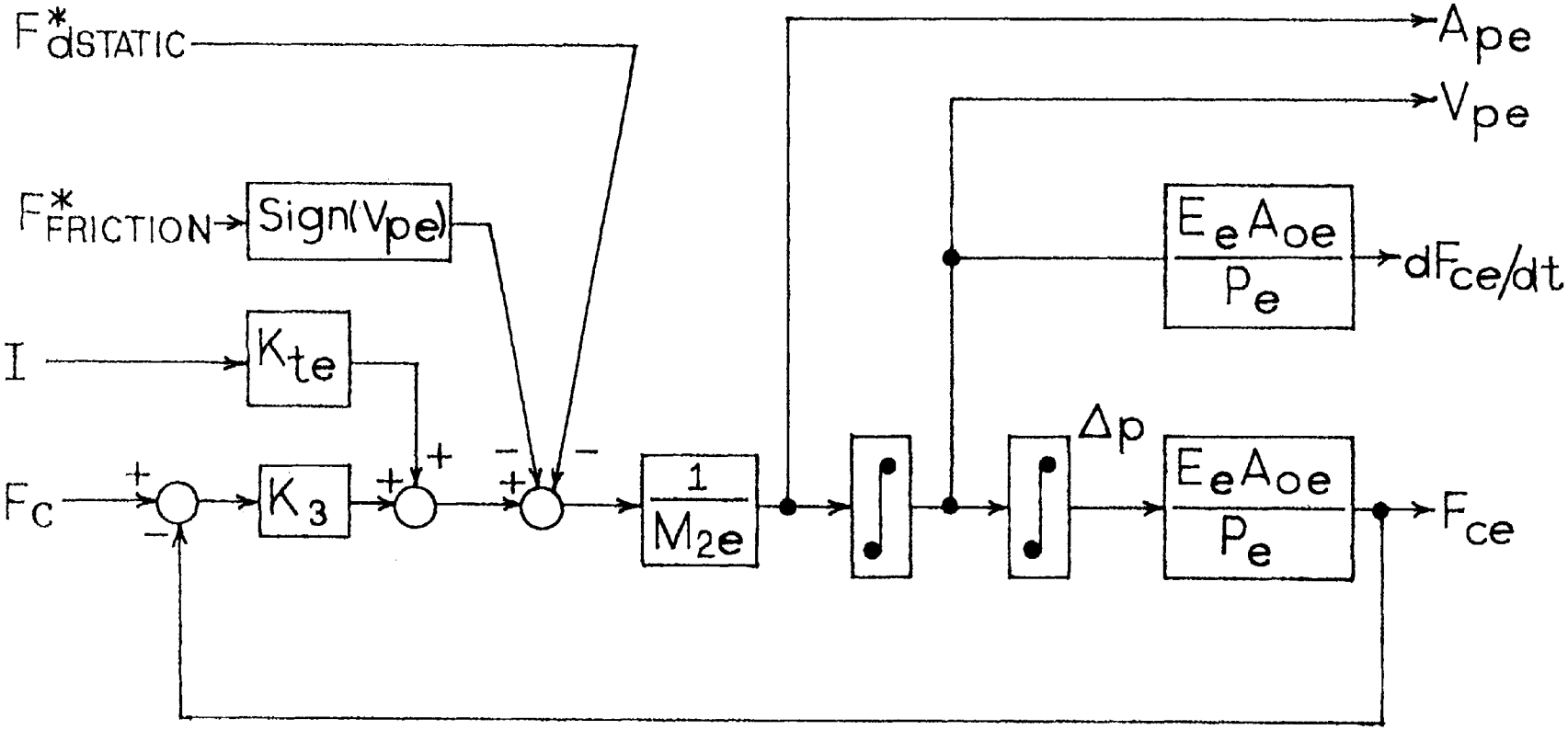
FIG. 22 is a control block diagram for an observer computing web tension derivative, translational velocity and translational acceleration for the embodiment of FIG. 21.

The observer of FIG. 22 comes from the recognition that the web force is related to web deflection which is actually a change in position ΔP. The observer, as in all of the cases described herein, can be thought of as a model of the physical system. The derivative of web force therefore relates to velocity $V_p$, and the second derivative of force relates to acceleration $A_p$.

Observer output $F_{ce}$ corresponds to the actual physically measured state, in this case web tension force $F_c$, which is input to the observer's closed loop controller. The value of the physically measured state is compared to the estimated value and the error gets multiplied by a controller gain $k_3$. The controller gain has no direct physical meaning. However, the controller gain has units of force per unit of error. The entire force, both static and variable force components (as in the earlier embodiments), is divided by an estimate of system mass $M_{2e}$. The result is an estimate of acceleration $A^*_{pe}$. The estimated acceleration gets integrated to yield an estimate of velocity. The estimate of velocity gets integrated to yield an estimate of web deflection. The estimated web deflection gets multiplied by web property estimates to yield the estimated web tension force $F_{ce}$.

This process continues until the closed loop control forces the estimated web tension $F_{ce}$ to converge with the actual measured web tension, $F_c$. The command feed forward portion of the observer improves the observer's accuracy during non-steady state operation, because the actuator current I is directly related to motor effort, which is directly proportional to acceleration. In this observer, the measured value of actuator current I is multiplied by an estimate of the motor torque constant $K_{te}$ which yields a value proportional to force. This value gets added directly to the force computed in the observer's error section. Thus, dynamic accuracy is improved because changes in effort immediately change the web tension estimate, as opposed to waiting for error to accumulate.

In step 1, the web tension $F_c$ and the servo motor current I are measured as described earlier.

In step 2, a derivative of web tension $dF_{ce}/dt$ can be computed as disclosed earlier in the second embodiment. Otherwise, derivative of web tension can be computed using the observer shown in FIG. 22. The observer can be implemented in software in computer 70 or by using operational amplifiers. As shown in FIG. 22, the output force is divided by the estimated physical mass $M_{2e}$ of the system to compute dancer acceleration $A_{pe}$ as required in step 4. Likewise, the acceleration value is integrated by software or an operational amplifier designated by the symbol "∫" in FIG. 22 to obtain an estimated velocity as set forth in step 3. Finally the equation:

$$dF_{ce}/dt=V_{pe}[(E_eA_{oe})/P_e].$$

In this manner, the observer can compute all of the values required, including $F_{ce}$ as illustrated in FIG. 22.

Figure 23:
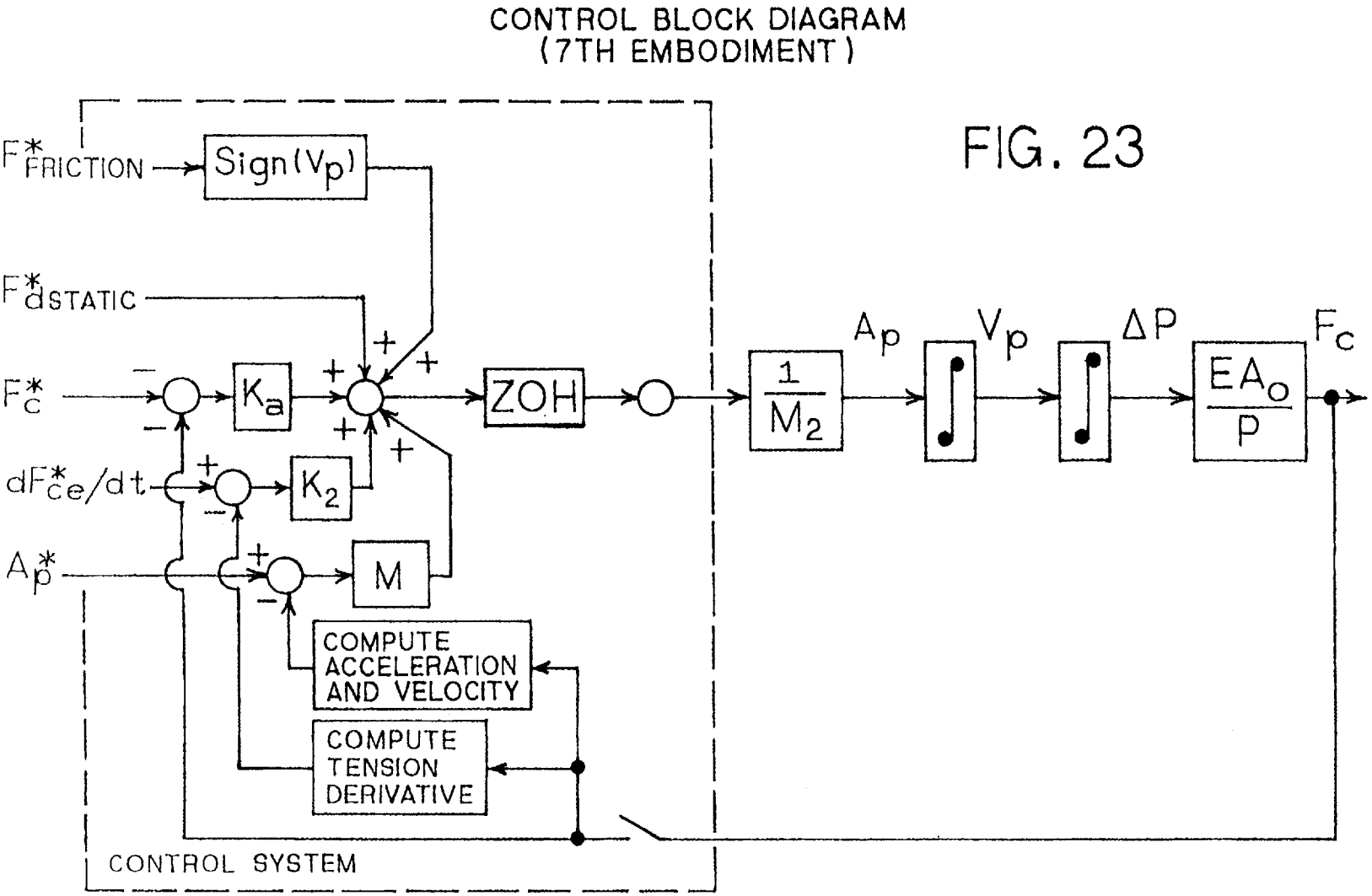
FIG. 23 is a control block diagram for the control program flow diagram of FIG. 21.

In step 5, the equation is solved for $F^*_{servo}$ and in step 6 the force value is applied by actuator 56 to drive dancer roll 24. Additional variables, as needed, are computed by the methods recited earlier. FIG. 23 illustrates a control block diagram for the control program flow diagram of FIG. 21 and better illustrates many of the values computed, such as $A_{pe}$ and $F_{ce}$.

For use in the force command equation of step 5, the values for $A^*_p$ and $V^*_p$ can be computed by an observer as disclosed earlier herein or preset to zero, if desired.

In step 6, a new torque command proportional to $F^*_{servo}$ is output to actuator 56 via zero order hold (ZOH).

In step 7, the flow diagram of FIG. 21 is repeated, and sampling of the web tension $F_c$ and the servo motor current I reoccurs. Once again, actuator 56 readjusts the force $F^*_{servo}$ applied to dancer roll 24 to maintain web tension $F_c$ at a constant value.

In conclusion, the seventh embodiment discloses a dancer system 20 which accounts for velocity and acceleration changes and maintains an improved web tension while only sensing web tension and servo current. Sensing only two variables enables much simpler wiring and other arrangements than, for example, the first embodiment.

EIGHTH EMBODIMENT

Figure 24:
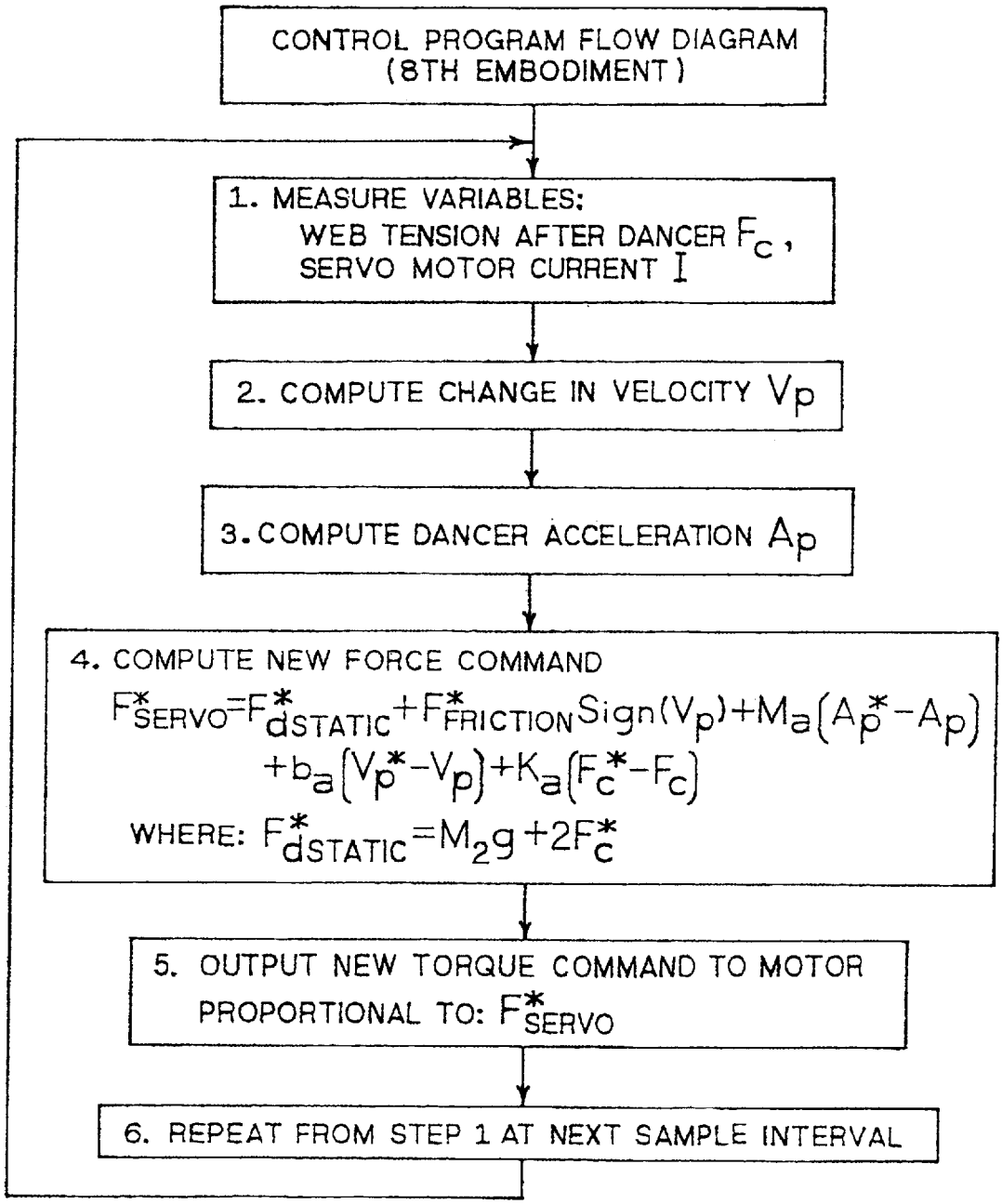
FIG. 24 is a control program flow diagram for an eighth embodiment of an active dancer system.

In the eighth embodiment, as in the seventh embodiment, the only values that need to be measured are web tension $F_c$ after dancer roll 24 and servo-motor current I. However, unlike the seventh embodiment, a derivative of force command $F^*_c$ need not be computed. The control program flow diagram of FIG. 24 illustrates operation of dancer system 20 in the eighth embodiment.

In a first step, values for web tension $F_c$ after dancer roll 24 and servo-motor current I are measured.

Figure 25:
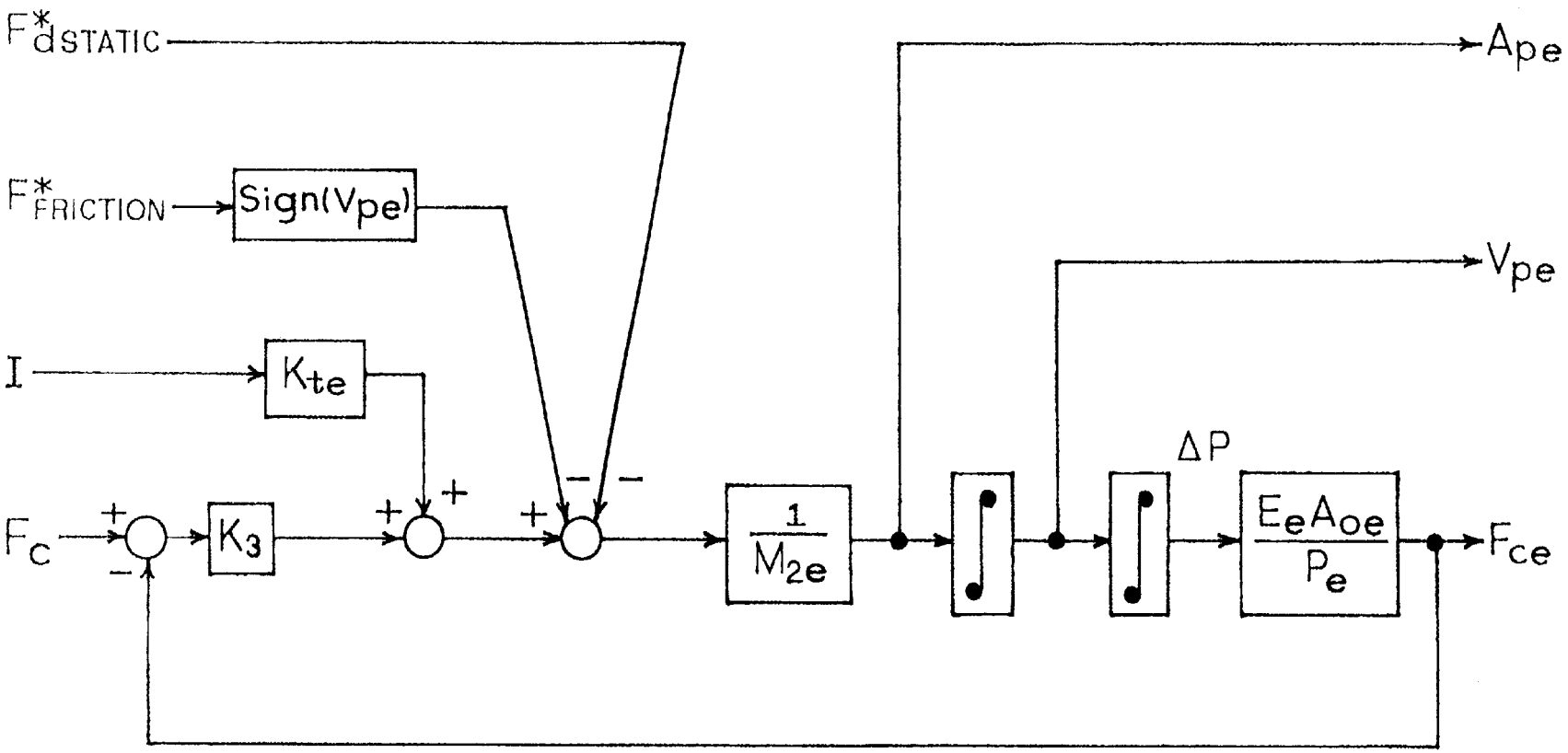
FIG. 25 is a control block diagram for an observer computing dancer translational velocity and acceleration from web tension.

In a second step, an observer, shown in FIG. 25, computes translational velocity $V_{pe}$.

In a third step, the observer computes translational acceleration $A_{pe}$ of dancer roll 24. Of course, the third and second steps can be computed in reverse order. The observer of FIG. 25 functions in a similar manner to the observers described earlier.

In a fourth step, a new force command $F^*_{servo}$ is computed using the earlier computed values as well as the force applied earlier by actuator 56 and derived from motor current I. The equation for computing force is shown in the block of the fourth step. Further, the control block diagram of FIG. 26 also shows all of the forces applied to dancer system 20.

For use in the force command equation of step 4, the values for $A^*_p$, $F^*_c$, and $V^*_p$ can be computed by an observer as disclosed earlier herein or preset to zero or another preselected value, as needed.

In a fifth step, a new torque command is output to actuator 56. In a sixth step, the process repeats at the next scan time or interval.

The eighth embodiment recognizes that the web force is related to web deflection which is actually a change in position ΔP. ΔP represents the change in dancer position due to elongation of the web. The derivative of force is therefore related to the web elongation velocity.

The observer operates as a model of dancer system 20 connected to a closed loop controller. Assuming the operating point position P of dancer roll 24 is essentially constant and that the web never goes slack, one can assume that $V_p=\Delta V_p$ (velocity due to elongation of the web) and $A_p=\Delta A_p$ (rate of change of the velocity of the elongation of the web). The output of the model, $F_{ce}$ corresponds to the actual physically measured state, for web tension force, that inputs to the observer's closed loop controller as shown in FIG. 25. The value of the physically measured state $F_c$ is compared to the estimated value and the error gets multiplied by controller gain $k_3$. Controller gain $k_3$ has no direct physical meaning, but does represent units of force per unit of error. As shown in the observer of FIG. 25, the estimated velocity $V_{pe}$ is integrated to yield an estimate of the web deflection $\Delta P$. $\Delta P$ is then multiplied by the web properties shown in FIG. 25 to compute an estimated web tension $F_{ce}$. The above steps continue until the closed loop control forces the estimated web tension to converge at the measured web tension. The command feed forward portion of the observer improves the observer's accuracy during non-steady state operation.

Figure 26:
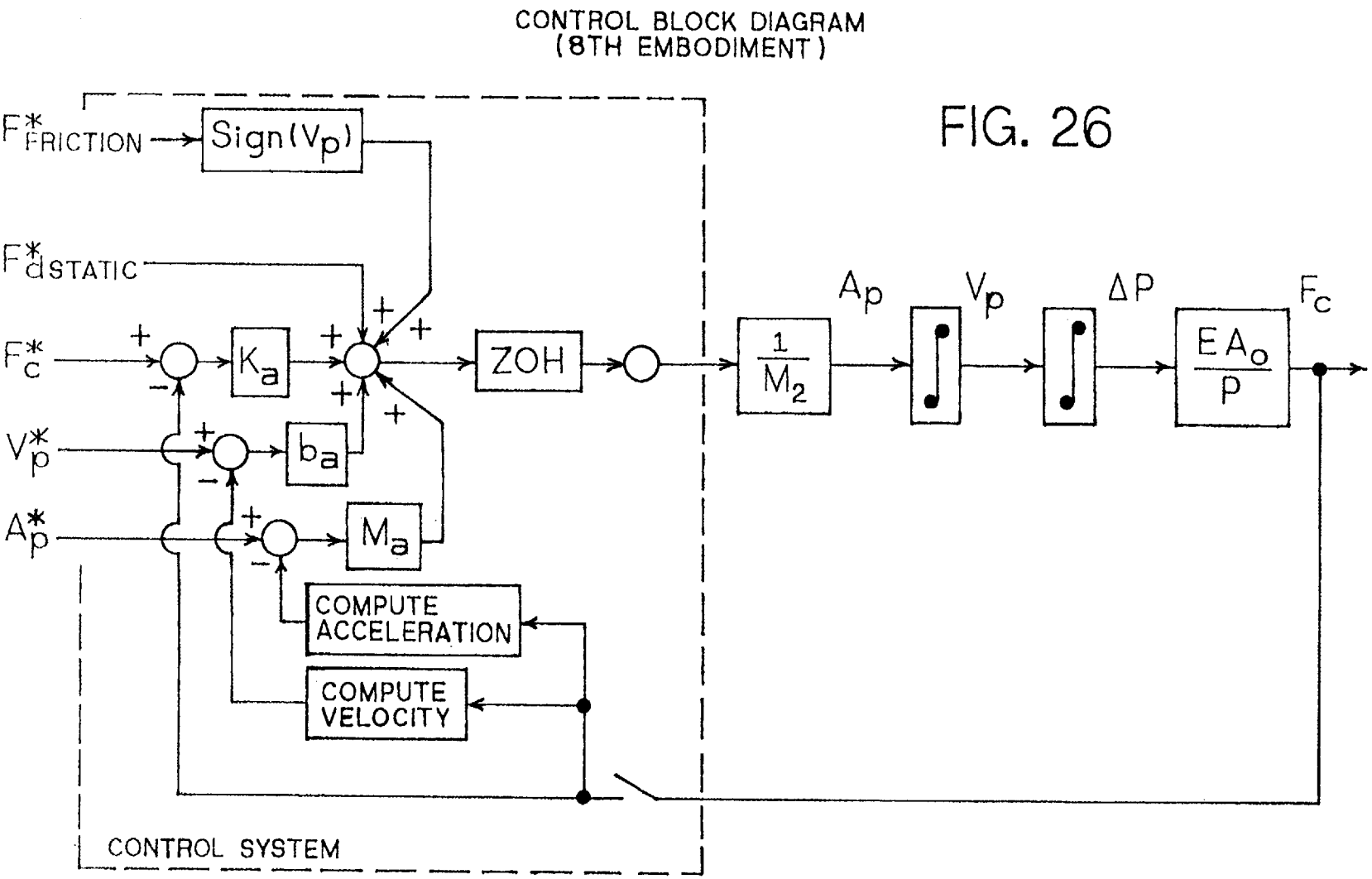
FIG. 26 is a control block diagram for the control program flow diagram of FIG. 24.

Actuator or motor current I is directly related to motor effort or force applied to dancer roll 24. In the embodiment of FIGS. 24–26, the measured value of motor current is multiplied by an estimate of the motor torque constant $K_{te}$ which yields a value proportional to force. This value gets added directly to the force computed in the observer's error drive section. Command feed forward improves dynamic accuracy because changes in effort or force immediately change the web tension estimate $F_{ce}$, as opposed to waiting for accumulated error to change the estimate. Therefore, command feed forward can be defined as a detected variable immediately being fed to the control variable of interest ($F_{ce}$) to enable fast convergence of the observer system.

NINTH EMBODIMENT

The ninth embodiment measures more variables than the eighth embodiment. However, this embodiment has all of the advantages of the first embodiment with three fewer measured variables. The addition of the specialized state observer of FIG. 25 used in the eighth embodiment, and used here in the ninth embodiment, enables accurate estimation of $\Delta P$, $V_{pe}$, and $A_{pe}$. Therefore, the accuracy of the first embodiment can be substantially maintained with a system having fewer sensors and hardware requirements.

Figure 27:
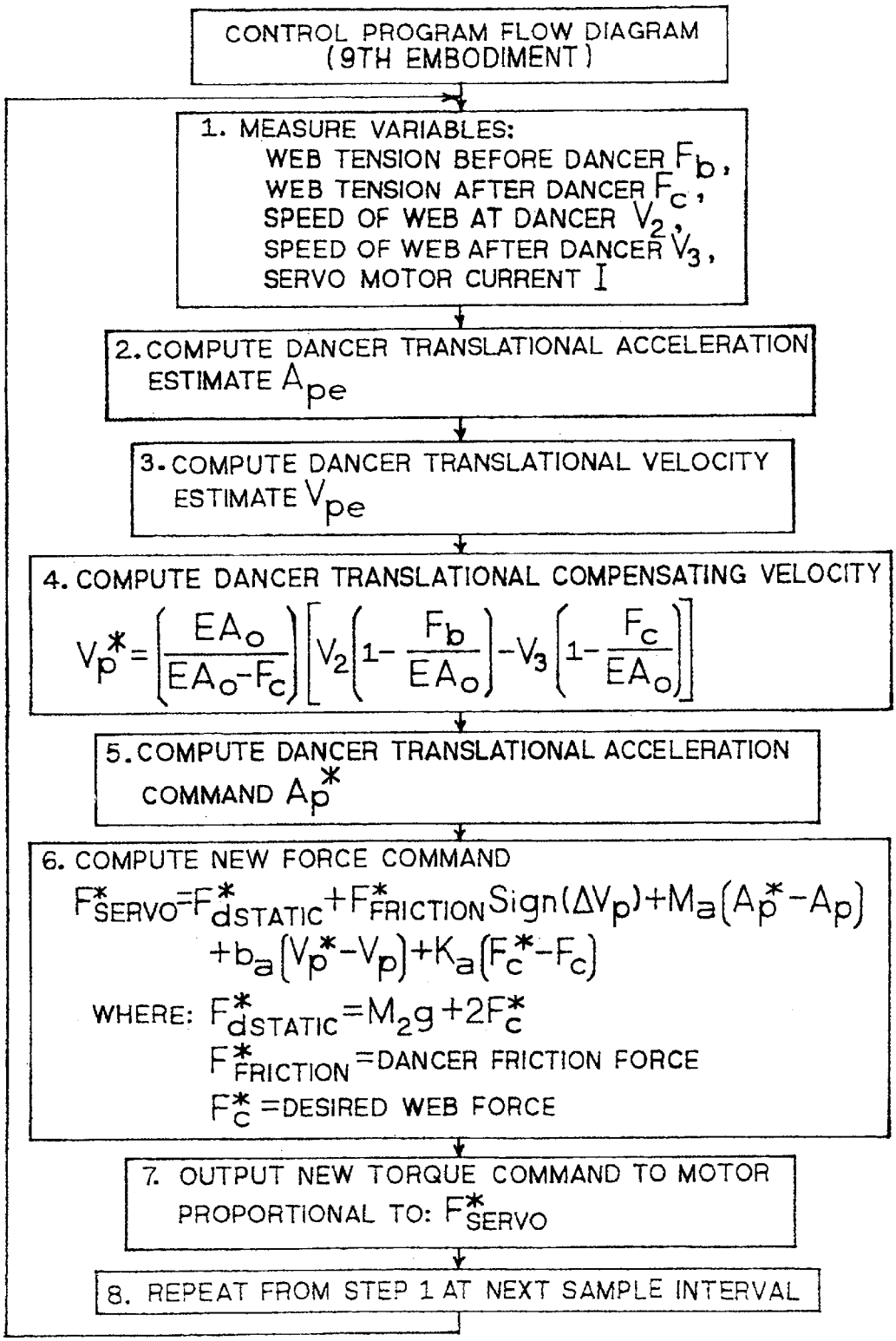
FIG. 27 is a control program flow diagram for a ninth embodiment of an active dancer system.

In a first step shown in the control program flow diagram of FIG. 27, values for web tension $F_b$ before dancer roll 24, web tension $F_c$ after dancer roll 24, web velocity $V_2$, web velocity $V_3$, and actuator or servo-motor current I are measured.

In a second step, the observer, shown in FIG. 25, computes translational acceleration $A_{pe}$.

In a third step, the observer computes translational velocity $V_{pe}$ by integrating the previously computed value for translational acceleration.

In a fourth step, a set point for a desired target translational velocity $V^*_{pe}$ is computed using the equation shown in FIG. 27 and including the variables $V_2$, $V_3$, and $F_c$.

In a fifth step, the observer computes a desired target translational acceleration $A^*_{pe}$ that acts as a set point.

Figure 28:
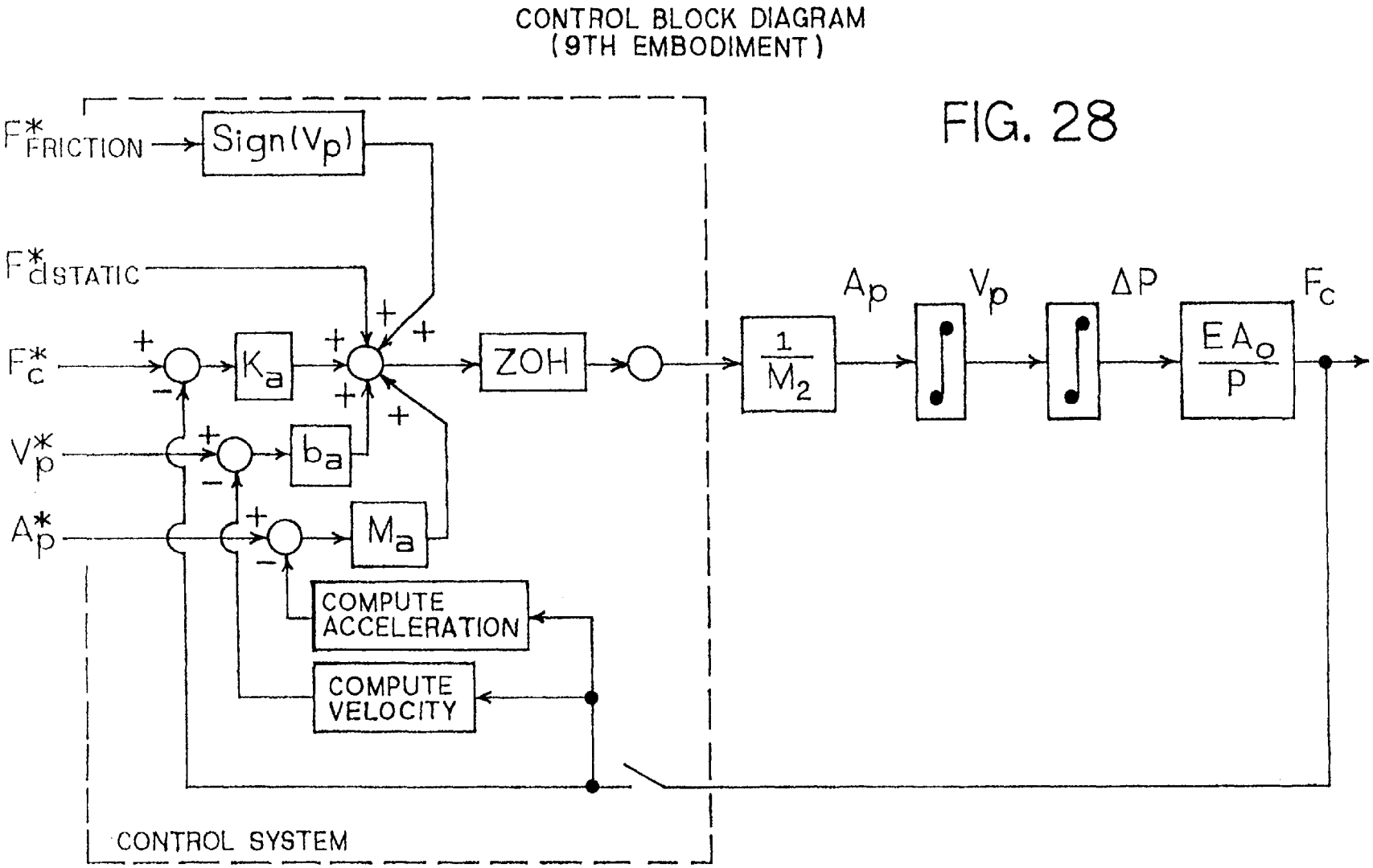
FIG. 28 is a control block diagram for the control program flow diagram of FIG. 27.

In a sixth step, a new force command $F^*_{servo}$ is computed using the earlier computed values as well as the force applied by actuator 56 and derived from motor current I. The equation for computing force is shown in the block of the sixth step. FIG. 28 illustrates a control block diagram essentially representing the equation in block 6 of FIG. 27.

In a seventh step, a new torque command is output to actuator 56. In an eighth step, the process repeats at the next scan time or interval.

VARYING TENSION EMBODIMENT

The above described embodiments discuss the use of dancer system 20 with respect to attenuating tension disturbances in the web. In corollary use, dancer system 20 can also be used to intentionally create temporary controlled tension disturbances. For example, in the process of incorporating LYCRA® strands (DuPont Corp. of Delaware) or threads into a garment, e.g. at a nip between an underlying web and an overlying web, it can be advantageous to increase, or decrease, the tension of the LYCRA at specific locations as it is being incorporated into each garment. Dancer system 20 of the invention can effect such short-term variations in the tension in the LYCRA.

Referring to FIG. 2, and assuming LYCRA (not shown) is being added at nip 72, tension on the web can be temporarily reduced or eliminated by inputting a force from actuator 56 causing a sudden, temporary downward movement of dancer roll 24, followed by a corresponding upward movement of the dancer roll which increases the tension. Similarly, tension can be temporarily increased by inputting a force from actuator 56 causing a sudden, temporary upward movement of dancer roll 24, followed by a corresponding downward movement which decreases tension. Such a cycle of increasing and decreasing the tension can be repeated more than 200 times, e.g. up to 300 times per minute or more using dancer system 20 of the invention.

For example, to reduce the tension quickly and temporarily to zero, computer controller 70 sends commands, and actuator 56 acts, to impose a temporary translational motion to dancer roll 24 during the short period over which the tension should be reduced or eliminated. The distance of the sudden translational movement corresponds with the amount of tension relaxation, and the duration of the relaxation. At the appropriate time, dancer roll 24 is again positively raised by actuator 56 to correspondingly increase the web tension. By such cyclic activity, dancer roll 24 can routinely and intermittently impose alternating higher and lower (e.g. substantially zero) levels of tension on web 18.

All of the embodiments previously disclosed, can be utilized to provide such effect of intentionally causing fluctuation of web tension. However, embodiments having a stable and constant target web tension $F^*_c$ or set point, are most effective. The desired value for web tension $F^*_c$ can be varied periodically, preferably as part of a timed set pattern, to form pleats as disclosed earlier in the U.S. Patent to Sabee, or to vary the tension of LYCRA at specific locations on web 18.

Figure 29:
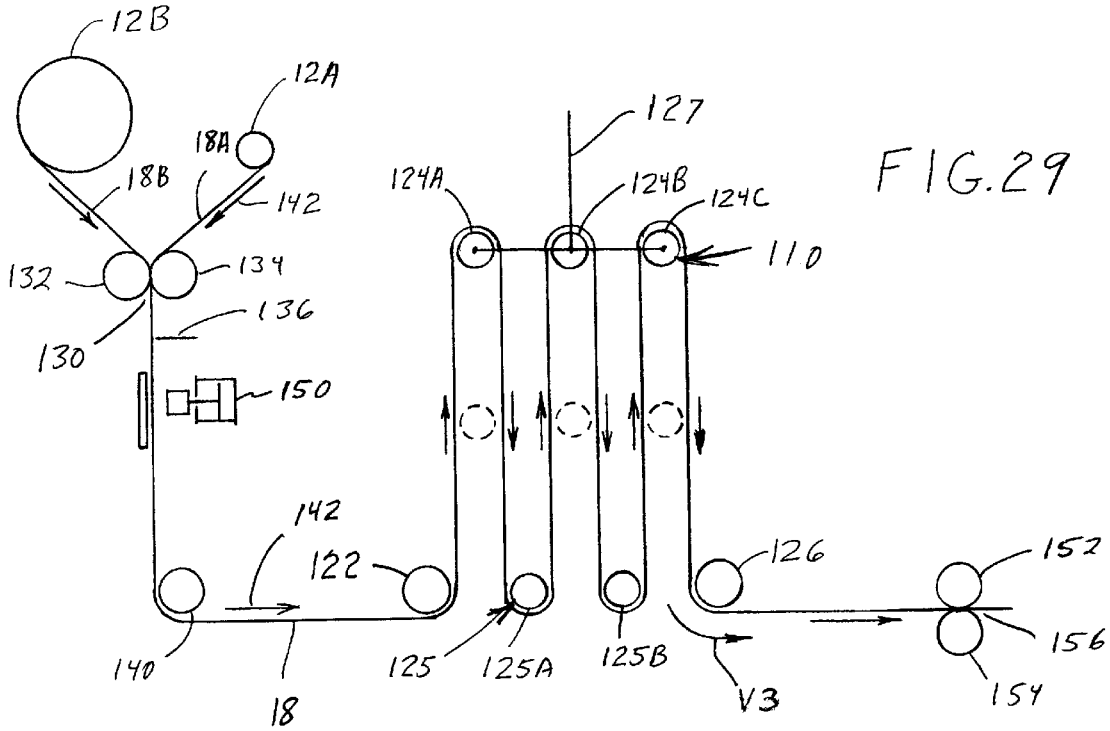
FIG. 29 is a representative side elevation view adjacent an unwind station and showing a festoon used both to control tension and to accumulate lengths of the continuous web.
Figure 30:
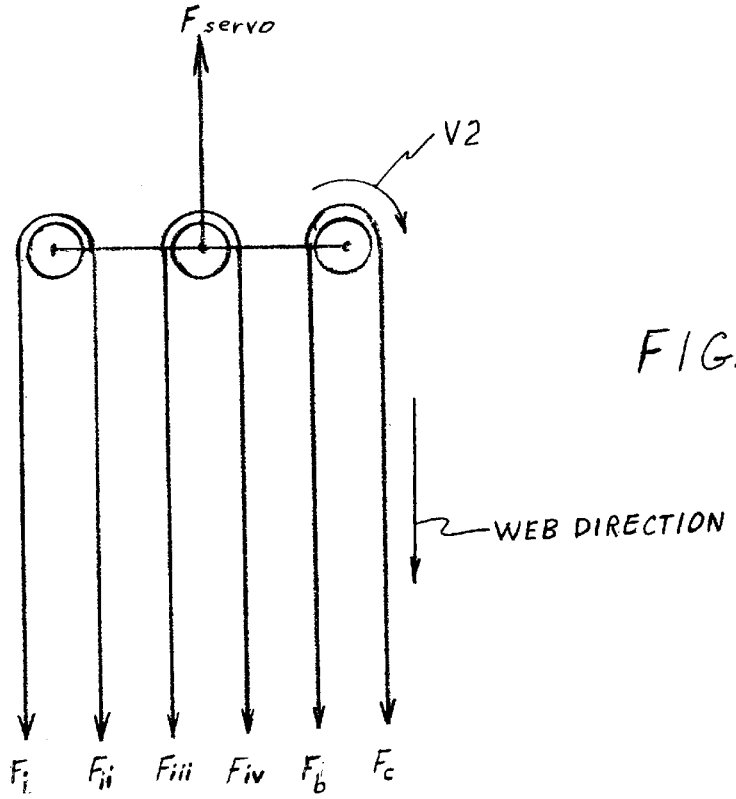
FIG. 30 is a representative free body force diagram as in FIG. 3 showing representative forces acting on a festoon as in FIG. 29.
Figure 31:
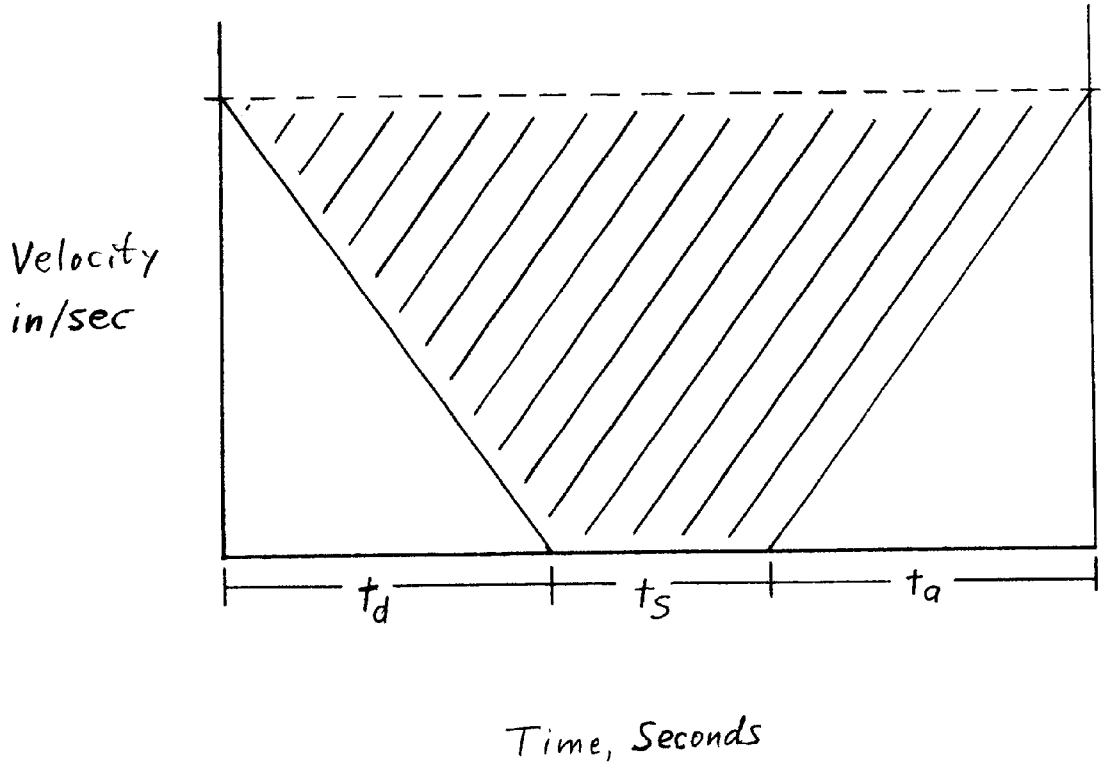
FIG. 31 is a graph illustrating the length of web pulled from the festoon, then replenished, during a downstream disturbance.

Referring now to FIGS. 29–31, an active drive as above, controlling both velocity and acceleration of a single dancer roll, can be applied as well to a festoon wherein the festoon in effect represents multiple such dancer rolls ganged together by a coupling in a cooperative relationship. Thus, referring to FIG. 29, festoon system 110 employs fixedly mounted lower intake and outlet rolls 122, 126 before and after the festoon, respectively. The festoon, itself, includes a plurality of upper festoon rolls 124A, 124B, 124C (at least two rolls) ganged together by coupling 127, and at least one fixedly mounted lower festoon roll 125. The upper festoon rolls move vertically up and down within an operating window defined between the lower festoon roll or rolls 125 and corresponding upper turning pulleys along the endless cable system illustrated in FIG. 2 as pulleys 30, 38.

Indeed, the festoon system here is similar to the dancer roll system of FIG. 2, with the primary difference between the dancer roll system of FIG. 2 and the festoon system of FIGS. 29–31 being the number of rolls over which the web passes in traversing the festoon as a web control system. Thus, for example, the festoon illustrated in FIGS. 29–30 includes 3 upper festoon rolls 124A, 124B, 124C and 2 lower festoon rolls 125A, 125B. Accordingly, the web traversing festoon 110 traverses 6 vertical paths between the time the web enters the festoon at roll 122 and exits the festoon at roll 126. By contrast, a dancer roll is limited by definition to traversing the web along only 2 vertical paths. Using a festoon system, the number of vertical paths is limited only to the extent such length would otherwise be limited in a conventional festoon system. Such length can be changed by either or both of (i) changing the number of festoon rolls or (ii) changing the height of the operating window.

Referring to FIG. 29, all the upper festoon rolls are ganged together by coupling 127 for common movement along a vertical path as driven by a drive chain corresponding to drive chain 28 of FIG. 2, while lower festoon rolls 125 remain vertically stationary while rotating freely to facilitate passage of web 18 over such lower rolls. Thus, and now referring to FIGS. 2 and 29 in combination, the lifting force, or downwardly-directed force, exerted by cable 28 on dancer roll 24 in FIG. 2 is divided equally between upper festoon rolls 124A, 124B, 124C by coupling 127, in FIGS. 29 and 30. All the remaining components of the servo force, illustrated in detail with respect to FIG. 2, apply to the festoon system, while dividing all external forces equally among the upper festoon rolls, and adding the respective mass and friction contributions of the respective upper festoon rolls, as well as the friction components of the lower festoon rolls.

In addition, all the above equations shown for the dancer roll can be applied to the festoon system, dividing the vertical forces on the festoon equally among the respective upper festoon rolls.

The positions of the upper festoon rolls in the operating window, relative to the top of the window adjacent the upper turning pulleys and the bottom of the window adjacent the lower turning roll or rolls is sensed by a respective position transducer as in FIG. 2. A generally static force having a vertical component is provided to the festoon support system for the upper festoon rolls by an air cylinder corresponding to the air cylinder in FIG. 3. Variable forces are applied by controller 70 to coupling 127 as described above for the dancer roll.

To the extent the process take-away speed exceeds the speed at which the web of raw material is supplied to the festoon. the static forces on the festoon cause the upper festoon rolls to move downwardly together within the operating window. As the festoon rolls move downwardly, the change in position is sensed by a position transducer, which sends a corrective signal to the unwind motor to increase speed of the unwind. The speed of the unwind increases enough to return the festoon rolls to the mid-point in their operating window.

Similarly, when the take-away speed lags the speed at which web material is supplied to the festoon, the static forces on the festoon cause the upper festoon rolls to move upwardly within the operating window. As the festoon rolls move upwardly. the change in position is sensed by a position transducer. As the festoon rolls rise above the mid-point in the operating window, the position transducer sends a corresponding corrective signal to the unwind motor to decrease the speed of the unwind, thereby returning the upper festoon rolls to the mid-point in the operating window.

In either case, the corrective speed change can be made at the take-away nip rather than at the unwind. However, changing speed at the unwind is typically simpler and is therefore preferred.

FIG. 2 is next referred to for the general layout of the operating control system while FIG. 29 is referred to in combination to show differences between the dancer system of FIG. 2 and the festoon system of FIG. 29. FIG. 2 illustrates the overall system. FIG. 29 shows replacing the dancer roll of FIG. 2 with a festoon. Such exchange works in the context of the driving system illustrated herein. In such driving system, the active control of both velocity and acceleration makes the web control system/festoon system 110 operate, in terms of the affect on controlling tension in the web, as though the festoon system/web control system has no mass.

The control system for the festoon includes all equations illustrated for the dancer system, appropriately modified to account for dividing the external forces among multiple festoon rolls, namely according to the number of vertical strands of the web.

In the festoon system, and referring to FIG. 29, web material 18 is e.g. unwound from a parent roll at unwind 12A. Web 18 passes through a first nip 130 defined between nip rolls 132, 134. Web 18 passes through knife station 136 which can be activated as desired to cut web 18, through taping station 138 which can be activated as desired to tape respective lengths of the web together. and over turning roll 140, all in the directions indicated by arrows 142. The web then enters the festoon system at turning roll 122, passes over turning roll 122, and from there enters the festoon, itself. Festoon 110 includes upper festoon rolls 124A, 124B, 124C, lower festoon rolls 125A, 125B, and coupler 127. Web 18 enters the festoon at turning roll 122 and departs the festoon at turning roll 126 and passes out of the festoon system upon departing turning roll 126. Between rolls 122 and 126, the festoon, along with controller 70, controls both the tension in the web and the length of web accumulated in the festoon. After exiting the festoon system, the web passes through a second set of nip rolls 152, 154 which define a second nip 156. The second nip or equivalent is required in order to define the section of the web, and the section of the processing line, in which the festoon is operable.

By employing multiple upper festoon rolls, the festoon defines a multiple of the accumulating capacity of a corresponding dancer roll. By controlling the festoon in the same manner as above described for the dancer roll, the festoon can be used to provide both the tension control function of the dancer roll and the accumulation function of the festoon.

Whereas a festoon normally employs only a fixed static force in biasing the festoon for vertical movement of the upper festoon rolls along the prescribed vertical path, by employing active force components as described above for the dancer roll, the festoon responds in function like the above-described active dancer, albeit with additional accumulation capacity.

The festoon couplings 127 are mounted to cable 28 on opposing ends of the upper festoon rolls like the mounting of ends 32, 40 of the dancer roll in FIG. 2. Drive cable 28 is mounted the same way about turning pulleys, connected to actuator 56, and monitored and controlled in the same way by controller 70. The force $F_{servo}$ of the servo, however is modified to reflect the additional turning rolls. See FIG. 30. Thus, the equation is $$F_{servo}F_b+F_i+F_{ii}+F_{iii}+F_{iv}+F_c+V_pb_i+M_g+K_{i\Delta p}+MV_p$$

where $MV_p$=system mass x velocity change.

FIG. 29 illustrates the upper festoon rolls at the top of the operating window, and shows the mid-point of the window in dashed outline. In typical steady state operation, the upper festoon rolls are positioned near the mid-point of the operating window. When a minor disturbance occurs, the festoon functions like a dancer roll, whereby the upper festoon rolls make minor changes in vertical position while the position sensor signals the controller of a change in position. The controller signals suitable drive speed changes in order to return the upper festoon rolls to the mid-point location.

When a substantial, but temporary. disturbance occurs, which may or may not be anticipated, the festoon operates more like a festoon, such that the upper festoon rolls move substantially within the operating window, thus to play out accumulated web material or to accumulate additional web material until such time as the incoming and outgoing web speeds are again in balance. An example of such substantial but temporary disturbance is replacing an empty web supply roll at the unwind with a full web supply roll. Thus, as illustrated in FIG. 29, an empty supply roll unwind 12A is shown alongside a full supply roll unwind 12B.

In making the splice between web material of the expired roll and the new roll, both webs are fed through nip 130 to knife 136 and tape applicator 150. As the web portions to be spliced together approach the knife and tape applicator, the unwind drive speed is brought to stop. As soon as the webs have stopped, the knife is activated to cut the exhausted web from the unwind stand, and the tape applicator tapes the tail end of the exhausted web to the leading end of the fresh web being fed from unwind 12B. As soon as the cut and taping actions have been completed, the unwind drive is restarted, whereupon the processing operation resumes. Meantime, accumulated web material is fed from festoon 110 to downstream operations in the processing line, downstream of second nip 156, so as to maintain continuity of the downstream operations while the splice is being made.

The total time involved in stopping the webs, cutting the exhausted web, and taping the two webs together, can be measured in a few seconds. By applying the known shutdown speeds and time, the start-up speeds and time to resume normal operating speed, and time at stop, one can calculate the length of web material which should be accumulated in the festoon in order to be able to continue processing web material along the rest of the processing line while making the splice. FIG. 31 illustrates such calculation wherein $t_d$=time of deceleration $t_s$=time at stop $t_a$=time of acceleration.

The shaded area in the curve of FIG. 31 defines the length of web 18 which must be accumulated in the festoon in order to continue operating the processing operation while making such stoppage. Other process can also be provided for, whereby the sizing of the festoon is designed according to the most demanding disturbance for which the festoon is expected to be used.

By so employing a festoon, driven and controlled as taught herein, to actively control both velocity and acceleration. the festoon can be operated so as to provide both tension control and accumulator functions. Accordingly, the festoon can be employed in the web section without use of a dancer roll, whereas without such acceleration and velocity control. a dancer roll is required for controlling tension and a separate and distinct festoon is required for providing the accumulation function.

Those skilled in the art will now see that certain modifications can be made to the invention herein disclosed with respect to the illustrated embodiments, without departing from the spirit of the instant invention. And while the invention has been described above with respect to the preferred embodiments, it will be understood that the invention is adapted to numerous rearrangements, modifications, and alterations, all such arrangements, modifications, and alterations are intended to be within the scope of the appended claims.

To the extent the following claims use means plus function language. it is not meant to include there, or in the instant specification, anything not structurally equivalent to what is shown in the embodiments disclosed in the specification.

What is claimed is:

1. Processing apparatus defining a processing line, for advancing a continuous web of material through a processing step along a given section of the processing line, the processing apparatus comprising:

(a) first and second rolls defining a first nip;

(b) third and fourth rolls defining a second nip, the first and second nips collectively defining the given section of the web;

(c) a festoon, including upper and lower festoon rolls, operating on the web in the given section of the processing line, thereby to control tension in the web and to accumulate a limited length of the web sufficient to sustain operation of the process on the length of web during routine temporary stoppages of web feed to the given section of the processing line or taking the web away from the given section of the processing line;

(d) an actuator applying net translational force to the upper festoon rolls; and (e) a controller driving the festoon, and computing and controlling net translational acceleration of the upper festoon rolls such that the festoon is effective to control tension, at a desired level of constancy, and to accumulate a limited length of the web, in the respective section of the processing line.

2. Processing apparatus as in claim 1, the actuator applying a first static force component to the festoon upper rolls, having a first value and direction, balancing said festoon upper rolls against static forces and the average dynamic tension in the respective section of the web, said controller outputting a second variable force component, through said actuator, effective to control the net actuating force imparted to said upper festoon rolls by said actuator, and effective to periodically adjust the value and direction of the second variable force component, each such value and direction of the second variable force component replacing the previous such value and direction of the second variable force component, and acting in combination with the first static force component to impart the target net translational acceleration to said upper festoon rolls, the second variable force component having a second value and direction, modifying the first static force component, such that the net translational acceleration of said upper festoon rolls is controlled by the net actuating force enabling said festoon to control the web tension, and further comprising apparatus for computing acceleration ($A_p$) of said upper festoon rolls, said controller comprising a computer controller providing control commands to said actuator based on the computed acceleration of said upper festoon rolls.

3. Processing apparatus as in claim 1, including a sensor for sensing tension in the web after said festoon, said controller being adapted to use the sensed tension in computing the value and direction of the second variable force component, and for imparting the computed value and direction through said actuator to said upper festoon rolls.

4. Processing apparatus as in claim 3, said sensor being effective to sense tension at least 1 time per second, and effective to recompute the value and direction of the second variable force component, thereby to adjust the value and direction of the computed second variable force component at least 1 time per second.

5. Processing apparatus as in claim 3, said sensor being effective to sense tension at least 500 times per second, said controller being effective to recompute the value and direction of the second variable force component, thereby to adjust the value and direction of the computed second variable force component at least 500 times per second, said actuator being effective to apply the recomputed second variable force component to said upper festoon rolls at least 500 times per second according to the values and directions computed by said controller, thus to control the net translational acceleration.

6. Processing apparatus as in claim 3, said sensor being effective to sense tension at least 1000 times per second, said controller comprising a computer controller effective to recompute the value and direction of the second variable force component and thereby to adjust the value and direction of the computed second variable force component at least 1000 times per second, said actuator being effective to apply the recomputed second variable force component to said upper festoon rolls at least 1000 times per second according to the values and directions computed by said computer controller, thus to control the net translational acceleration.

7. Processing apparatus as in claim 2, said controller controlling the actuating force imparted to said upper festoon rolls, and thus acceleration of said upper festoon rolls, including compensating for any inertia imbalance of said festoon not compensated for by the first static force component.

8. Processing apparatus as in claim 1, including an observer for computing translational acceleration ($A_p$) of said upper festoon rolls, said observer comprising one of (i) a subroutine in said computer program or (ii) an electrical circuit, which computes an estimated translational acceleration and an estimated translational velocity of said upper festoon rolls.

9. Processing apparatus as in claim 2, and further including:

(f) first apparatus for measuring a first velocity of the web after said festoon;

(g) second apparatus for measuring a second velocity of the web at said festoon;

(h) third apparatus for measuring translational velocity of said upper festoon rolls; and (i) fourth apparatus for sensing the position of said upper festoon rolls.

10. Processing apparatus as in claim 9, and further including:

(j) fifth apparatus for measuring web tension before said festoon; and (k) sixth apparatus for measuring web tension after said festoon.

11. Processing apparatus as in claim 10, said controller comprising a computer controller computing a force command using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein the translational velocity set-point $V^*_p$ of said upper festoon rolls reflects the equation:

$$V^*_p=[EA_o/(EA_o-F_c)][V_2(1-F_b/EA_o)-V_3(1-F_c/EA_o)],$$

to control said actuator based on the force so calculated, wherein:

$F^*_{d\ static}$=static force component on said upper festoon rolls and is equal to $Mg+2F^*_c$, $F_c$=tension in the web after the last movable festoon roller, $F^*_c$=tension in the web, target set point, per process design parameters, $F_b$=tension in the web ahead of the last movable festoon roller, $F^*_{friction}$=Friction in either direction resisting movement of the upper festoon rolls, $F^*_{servo}$=Force to be applied by said actuator, $b_a$=control gain constant regarding festoon translational velocity, in Newton seconds/meter, $k_a$=control gain constant regarding web tension, Mg=mass of said upper festoon rolls times gravity, $M_A$=active mass, $M_e$=active mass and physical mass, $V_p$=instantaneous translational velocity of said upper festoon rolls immediately prior to application of the second variable force component, Sign($V_p$)=positive or negative value depending on the direction of movement of the upper festoon rolls, $V_2$=velocity of the web at the last movable festoon roller, $V_3$=velocity of the web after the festoon, $V^*_p$=reference translational velocity of said upper festoon rolls, set point, r=radius of a respective pulley on said actuator, E=Modulus of elasticity of the web, $A_o$=cross-sectional area of the unstrained web, $A^*_p$=target translational acceleration of said upper festoon rolls, set point, and $A_p$=translational acceleration of said upper festoon rolls.

12. Processing apparatus as in claim 11, the target acceleration $A^*_p$ being computed using the equation:

$$A^*_p=[V^*_p-V_p]/\Delta T$$

where ΔT=scan time for said computer controller.

13. Processing apparatus as in claim 12, said computer controller providing control commands to said actuator based on the sensed position of said upper festoon rolls, and the measured web tensions, acceleration and velocities, and thereby controlling the actuating force imparted to said upper festoon rolls by said actuator thus either to maintain a substantially constant web tension or to provide a predetermined pattern of variations in the web tension.

14. Processing apparatus as in claim 2, and further including:

(f) first apparatus for measuring translational velocity of said upper festoon rolls;

(g) second apparatus for measuring web tension force after said festoon; and (h) third apparatus for sensing the current of said actuator.

15. Processing apparatus as in claim 14, said controller comprising a computer controller computing a derivative of web tension force from the web tension force over the past sensing intervals, and including an observer computing said translational velocity of said upper festoon rolls, and said computer controller computing a derivative of the web tension force.

16. Processing apparatus as in claim 14, said controller comprising a computer controller, and including a fuzzy logic subroutine stored in said computer controller for computing a derivative of web tension force from the web tension force and the translational velocity of said upper festoon rolls, said fuzzy logic subroutine inputting web tension force error, the derivative of web tension force error, and acceleration error, the fuzzy logic subroutine proceeding through the step of fuzzy inferencing of the above errors, and de-fuzzifying of inferences to generate a command output signal, said fuzzy logic subroutine being executed during each scan of said sensing apparatus.

17. Processing apparatus as in claim 2, and further including:

(f) first apparatus for measuring translational velocity of said upper festoon rolls; and (g) second apparatus for sensing the current of said actuator.

18. Processing apparatus as in claim 17, said controller computing the estimated translational acceleration of said upper festoon rolls from the equation:

$$A_{pe}=[k_1(V_p-V_{pe})+k_{te}I-F^*_{d\ static}-F^*_{friction}\mathrm{Sign}(V_p)]/M_{2e}$$

where $A_{pe}$=estimated translational acceleration of said upper festoon rolls, $F^*_{d\ static}$=static force component on said upper festoon rolls and is equal to $Mg+2F^*_c$, $F^*_{friction}$=Friction in either direction resisting movement of the upper festoon rolls, $\mathrm{Sign}(V_p)$=positive or negative value depending on the direction of movement of the upper festoon rolls, $k_1$=Observer gain, $V_p$=instantaneous translational velocity of said upper festoon rolls, $V_{pe}$=estimated translational velocity, $k_{te}$=Servo motor (actuator) torque constant estimate, I=actuator current, and $M_{2e}$=Estimated physical mass of the upper festoon rolls.

19. Processing apparatus as in claim 18, said processing apparatus including a zero order hold for storing force values for application to said upper festoon rolls.

20. Processing apparatus as in claim 18, said processing apparatus actively compensating for coulomb and viscous friction, and acceleration, to actively cancel the effects of mass.

21. Processing apparatus as in claim 2, and further including:

(f) first apparatus for measuring translational position of said upper festoon rolls;

(g) second apparatus for measuring web tension force after said festoon; and (h) third apparatus for sensing the motor current of said actuator.

22. Processing apparatus as in claim 21, including an observer for computing estimated translational velocity and estimated translational acceleration of said upper festoon rolls from the change in position of said upper festoon rolls.

23. Processing apparatus as in claim 2, and further including:

(f) first apparatus for measuring translational position of said upper festoon rolls; and (g) second apparatus for sensing the motor current of said actuator: and (h) an observer for computing translational acceleration of said upper festoon rolls.

24. Processing apparatus as in claim 2, and further including:

(f) first apparatus for measuring web tension $F_c$ after said festoon; and (g) second apparatus for sensing the motor current of said actuator.

25. Processing apparatus as in claim 24, including an observer utilizing the motor current and force on the web, in combination with an estimate of system mass $M_{2e}$, to compute an estimate of translational acceleration $A_{pe}$ of said upper festoon rolls.

26. Processing apparatus as in claim 25, said observer integrating the translational acceleration to compute an estimate of translational velocity $V_{pe}$ and integrating the estimated translational velocity to compute an estimated web tension force $F_{ce}$, and changing values until the estimated web tension force equals the actual web tension force.

27. Processing apparatus as in claim 2, said controller providing the control commands to said actuator thereby controlling the actuating force imparted to said upper festoon rolls by said actuator, and thus controlling acceleration of said upper festoon rolls, such that said actuator maintains inertial compensation for the festoon system.

28. Processing apparatus as in claim 1, the first nip comprising a wind-up roll downstream from the festoon and the second nip comprising driving rolls upstream from the festoon, the controller sending control signals to the wind-up roll and the driving rolls.

29. Processing apparatus as in claim 1, including first velocity apparatus for measuring a first velocity of the web after the festoon, and second velocity apparatus for measuring a second velocity of the web at the festoon, the controller comprising a computer controller computing a velocity command $V^*_p$ using the first and second sensed velocities and web tension before and after the festoon.

30. Processing apparatus as in claim 2, the controller comprising a computer controller intentionally periodically varying the variable force component to unbalance the system, and thus the tension on the web by periodically inputting command forces through the actuator causing sudden temporary alternating upward and downward movements of the upper festoon rolls such that the upper festoon rolls intermittently impose alternating higher and lower levels of tension on the web.

31. Processing apparatus as in claim 30, the periodic input of force causing the alternating movements of the upper festoon rolls to be repeated more than 200 times per minute.

32. In a processing operation wherein a continuous web of material is advanced through a processing step defined by first and second spaced nips, each nip being defined by a pair of nip rolls, a method of controlling web tension, and of accumulating a limited length of the web, in the respective section of web, the method comprising:

(a) providing a festoon, having upper and lower festoon rolls, operative on the respective section of web;

(b) applying a first generally static force component to the upper festoon rolls, the first generally static force component having a first value and direction;

(c) applying a second variable force component to the upper festoon rolls, the second variable force component having a second value and direction, modifying the first generally static force component, and thereby modifying (i) the effect of the first generally static force component on the upper festoon rolls and (ii) corresponding translational acceleration of the upper festoon rolls; and (d) adjusting the value and direction of the second variable force component repeatedly, each such adjusted value and direction of the second variable force component (i) replacing the previous such value and direction of the second variable force component and (ii) acting in combination with the first static force component to provide a target net translational acceleration to the upper festoon rolls.

33. A method as in claim 32, including adjusting the value and direction of the second variable force component at least 500 times per second.

34. A method as in claim 32, including sensing tension in the web after the festoon, and using the sensed tension to compute the value and direction of the second variable force component.

35. A method as in claim 32, including sensing tension in the respective section of the web at least 1 time per second, recomputing the value and direction of the second variable force component and thereby adjusting the value and direction of the computed second variable force component at least 1 time per second, and applying the recomputed value and direction to the festoon at least 1 time per second.

36. A method as in claim 32, including adjusting the force components and target net translational acceleration so as to maintain an average dynamic tension in the web throughout the processing operation while controlling translational acceleration such that system effective mass equals the polar inertia of the upper festoon rolls collectively, divided by outer radius of the rolls, squared.

37. A method as in claim 32, including periodically and intentionally varying the variable force component to unbalance the system, and thus the tension on the web by periodically inputting command forces through the actuator causing sudden temporary alternating upward and downward movements of the upper festoon rolls such that the upper festoon rolls intermittently impose alternating higher and lower levels of tension on the web.

38. A method as in claim 37, the periodic input of force causing the upward movement of the upper festoon rolls to be repeated more than 200 times per minute.

39. A method as in claim 32 wherein the first and second force components are applied simultaneously to the upper festoon rolls as a single force, by an actuator, and wherein the step of applying a force to the upper festoon rolls includes:

(e) measuring a first velocity of the web after the festoon;

(f) measuring a second velocity of the web at the festoon;

(g) measuring translational velocity of the upper festoon rolls;

(h) sensing the position of the upper festoon rolls;

(i) measuring web tension before the festoon; and (j) measuring web tension after the festoon, and (k) applying the force to the upper festoon rolls computed according to the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein:

$F^*_{d\ static}$=static force component on said upper festoon rolls and is equal to $Mg+2F^*_c$, $F^*_{friction}$=Friction in either direction resisting movement of the upper festoon rolls, $F_c$=tension in the web after the upper festoon rolls, $F^*_c$=tension in the web, target set point, per process design parameters, $F^*_{servo}$=*Force generated by the actuator,*

$b_a$=control gain constant regarding translational velocity of the upper festoon rolls, in Newton seconds/meter, $k_a$=control gain constant regarding web tension, Mg=mass of said upper festoon rolls times gravity, $M_A$=active mass, $M_e$=active mass and physical mass, $V_p$=instantaneous translational velocity of the upper festoon rolls immediately prior to application of the second variable force component, $\mathrm{Sign}(V_p)$=positive or negative value depending on the direction of movement of the upper festoon rolls, $A^*_p$=reference translational acceleration of the upper festoon rolls, set point, $A_p$=translational acceleration of the upper festoon rolls, and wherein the translational velocity set-point $V^*_p$ of the upper festoon rolls reflects the equation:

$$V^*_p=[EA_o/(EA_o-F_c)][V_2(1-F_b/EA_o)-V_3(1-F_c/EA_o)],$$

to control the actuator based on the force so computed, wherein:

$F_b$=tension in the web ahead of the last movable festoon roller, $V_2$=velocity of the web at the last movable festoon roller, $V_3$=velocity of the web after the festoon, $V^*_p$=reference translational velocity of the upper festoon rolls, set point, r=radius of a respective pulley on said actuator, E=Modulus of elasticity of the web, and $A_o$=cross-sectional area of the unstrained web.

40. A method as in claim 39, the target acceleration $A^*_p$ being computed using the equation:

$$A^*_p=[V^*_p-V_p]/\Delta T$$

where ΔT=scan time, the computations being repeated and the force adjusted at least 1 time per second.

41. A method as in claim 32 wherein the first and second force components are applied simultaneously to the upper festoon rolls as a single force, and wherein applying a force to the upper festoon rolls includes:

(e) measuring translational velocity of the upper festoon rolls;

(f) measuring web tension force after the festoon; and (g) sensing the current of said actuator, such measuring and sensing occurring during periodic sensing intervals, and (h) computing a derivative of web tension force from the web tension force based on present and past sensing intervals;

(i) computing the translational velocity of the upper festoon rolls; and (j) computing a derivative of the web tension force.

42. A method as in claim 41, wherein applying a force to the upper festoon rolls includes executing a fuzzy logic subroutine by inputting web tension force error, the derivative of web tension force error, and acceleration error, the fuzzy logic subroutine proceeding through the step of fuzzy inferencing of the above errors, and de-fuzzifying inferences to generate a command output signal, the fuzzy logic subroutine being executed during each of the measuring and sensing intervals.

43. A method as in claim 32 wherein the first and second force components are applied simultaneously to the upper festoon rolls as a single force, and wherein applying a force to the upper festoon rolls includes:

(e) measuring the translational velocity of the upper festoon rolls;

(f) sensing the current of an actuator; and (g) computing the estimated translational acceleration of the upper festoon rolls from the equation $$A_{pe}=[F^*_{d\ static}+F^*_{friction}\mathrm{Sign}(V_p)+k_l(V_p-V_{pe})+k_{te}I]/M_{2e}$$

where:

$A_{pe}$=estimated translational acceleration of the upper festoon rolls,

F*d static=static force component on the upper festoon rolls and is equal to $Mg+2F^*_c$, $F^*_{friction}$=Friction in either direction resisting movement of the upper festoon rolls, $\mathrm{Sign}(V_p)$=positive or negative value depending on the direction of movement of the upper festoon rolls, $k_l$=Observer gain, $V_p$=instantaneous translational velocity of the upper festoon rolls, $V_{pe}$=estimated translational velocity, $k_{te}$=Servo motor (actuator) torque constant estimate, I=actuator current, and $M_{2e}$=Estimated physical mass of the upper festoon rolls.

44. A method as in claim 32 wherein the first and second force components are applied simultaneously to the upper festoon rolls as a single force, and wherein applying a force to the upper festoon rolls includes:

(e) measuring the translational position of the upper festoon rolls;

(f) measuring web tension force after the festoon; and (g) sensing the motor current of an actuator applying the force to the upper festoon rolls, the above measuring and sensing occurring at each sensing interval, the method further including computing a derivative of web tension from the present measured web tension and the web tension measured in the previous sensing interval.

45. A method as in claim 44, including computing estimated translational velocity and estimated translational acceleration of upper festoon rolls from the change in position of the upper festoon rolls.

46. A method as in claim 32 wherein the first and second force components are applied simultaneously to the upper festoon rolls as a single force, and wherein applying a force to the upper festoon rolls includes:

(e) measuring the translational position of the upper festoon rolls; and (f) sensing the motor current of an actuator applying the force to the upper festoon rolls;

(g) computing an estimated translational velocity of the festoon upper rolls by subtracting the previous sensed value for translational position from the present sensed value of translational position and then dividing by the time interval between sensing of the values; and (h) computing a new force command for application to the actuator in response to the earlier computed values.

47. A method as in claim 32 wherein the first and second force components are applied simultaneously to the upper festoon rolls as a single force, and wherein applying a force to the upper festoon rolls includes:

(e) measuring web tension $F_c$ after the festoon;

(f) sensing motor current of an actuator; and (g) utilizing the motor current and force on the web, in combination with an estimate of system mass $M_{2e}$, to compute an estimate of translational acceleration $A_{pe}$.

48. A method as in claim 47, including integrating the translational acceleration to compute an estimate of translational velocity $V_{pe}$ and integrating the estimated translational velocity to compute an estimated web tension force $F_{ce}$.

49. In a processing operation wherein a continuous web of material is advanced through a processing step, a method of controlling the tension in the respective section of the web, comprising:

(a) providing a festoon, having upper and lower festoon rolls, operative for controlling tension on the respective section of web;

(b) providing an actuator to apply an actuating force to the upper festoon rolls;

(c) measuring a first velocity of the web after the festoon;

(d) measuring a second velocity of the web at the festoon;

(e) measuring motor current of the actuator;

(f) measuring web tension before the festoon;

(g) measuring web tension after the festoon;

(h) measuring translational velocity of the upper festoon rolls;

(i) sensing the position of the upper festoon rolls;

(j) measuring acceleration of the upper festoon rolls; and (k) providing force control commands to the actuator based on the above measured values, including computed acceleration $A^*_p$ of the upper festoon rolls, to thereby control the actuating force imparted to the upper festoon rolls by the actuator to control the web tension.

50. A method as in claim 49, including providing force control commands to the actuator based on the equation $$F^*_{servo}=F^*_{d\ static}+F^*_{friction}\mathrm{Sign}(V_p)+b_a(V^*_p-V_p)+k_a(F^*_c-F_c)+M_a(A^*_p-A_p),$$

wherein the translational velocity set-point $V^*_p$ of the upper festoon rolls reflects the equation $$V^*_p=[EA_o/(EA_oF_c)][V_2(1-F_b/EA_o)-V_3(1-F_c/EA_o)],$$

to control the actuator based on the force so calculated wherein:

$F^*_{d\ static}$=static force component on the upper festoon rolls and is equal to $Mg+2F^*_c$, $F^*_{friction}$=Friction in either direction resisting movement of the upper festoon rolls, $F^*_{servo}$=Target force to be applied by the actuator, $F_c$=tension in the web after the festoon, $F^*_c$=target tension in the web, set point, $F_b$=tension in the web ahead of the last movable festoon roller, $b_a$=control gain constant re translational velocity of the upper festoon rolls, in Newton seconds/meter, $k_a$=control gain constant re web tension, Mg=mass of the upper festoon rolls times gravity, $M_A$=active mass, $M_e$=active mass and physical mass, $V_p$=instantaneous translational velocity of the upper festoon rolls, Sign($V_p$)=positive or negative value depending on the direction of movement of the upper festoon rolls, $V_2$=velocity of the web at the last movable festoon roller, $V_3$=velocity of the web after the festoon, $V^*_p$=target translational velocity of the upper festoon rolls, set point, r=radius of a respective pulley on the actuator, E=Modulus of elasticity of the web, $A_o$=cross-sectional area of the unstrained web, $A^*_p$=target translational acceleration of the upper festoon rolls, set point, and $A_p$=translational acceleration of the upper festoon rolls.

51. A method as in claim 50, including computing the target acceleration $A^*_p$ using the equation:

$$A^*_p=[V^*_p-V_p]/\Delta T$$

where ΔT=scan time or interval between sensing of translational velocity.

52. A method as in claim 49, including applying the actuator and thereby controlling acceleration of the upper festoon rolls, such that the actuator maintains inertial compensation for the upper festoon rolls.

53. Processing apparatus defining a processing line, for advancing a continuous web of material through a processing step along a given section of the processing line, the processing apparatus comprising:

(a) a first and second rolls defining a first nip;

(b) third and fourth rolls defining a second nip, the first and second nips collectively defining the given section of the web;

(c) a web storage buffer operating on the web in the given section of the processing line, thereby to control tension in the web and to accumulate a limited length of the web sufficient to sustain operation of the process on the length of web during routine temporary stoppages of web feed to the given section of the processing line or taking the web away from the given section of the processing line;

(d) an actuator applying net translational force to the web storage buffer; and (e) a controller driving the web storage buffer, and computing and controlling net translational acceleration of the web storage buffer such that the web storage buffer is effective to control tension, at a desired level of constancy, and to accumulate a limited length of the we, in the respective section of the processing line.

* * * * *